US006719181B2

(12) United States Patent
Kanai et al.

(10) Patent No.: US 6,719,181 B2
(45) Date of Patent: Apr. 13, 2004

(54) MOTOR-DRIVEN STAPLER

(75) Inventors: Toshiyuki Kanai, Tokyo (JP); Takuya Kitamura, Tokyo (JP); Kiichi Haramiishi, Tokyo (JP)

(73) Assignee: Max Co., Ltd., Tokyo (JP)

( * ) Notice: Subject to any disclaimer, the term of this patent is extended or adjusted under 35 U.S.C. 154(b) by 0 days.

(21) Appl. No.: 10/355,015

(22) Filed: Jan. 31, 2003

(65) Prior Publication Data

US 2003/0111504 A1 Jun. 19, 2003

Related U.S. Application Data

(62) Division of application No. 09/611,667, filed on Jul. 6, 2000.

(30) Foreign Application Priority Data

Jul. 6, 1999 (JP) ..... 11-192045

(51) Int. Cl.[7] ..... B21S 15/28

(52) U.S. Cl. ..... 227/2; 227/3; 227/4; 227/154; 227/155

(58) Field of Search ..... 227/2, 4, 154, 227/155

(56) References Cited

U.S. PATENT DOCUMENTS

RE36,923 E * 10/2000 Hiroi et al. ..... 227/2
6,325,267 B1 * 12/2001 Yoshie et al. ..... 227/2
6,505,829 B2 * 1/2003 Kawata ..... 271/208

* cited by examiner

*Primary Examiner*—Stephen F. Gerrity
*Assistant Examiner*—Gloria Weeks
(74) *Attorney, Agent, or Firm*—Oblon, Spivak, McClelland, Maier & Neustadt, P.C.

(57) ABSTRACT

A motor-driven stapler is disclosed which comprises a table (100) arranged as opposed to a staple drive portion for driving a staple and provided movably up and down on a stapler body, and a driver for driving a staple from the staple drive portion to sheets of paper when the table (100) has been moved to press the sheets of paper against the staple drive portion. The table (100) is moved up and down by allowing the table (100) to rotate about axles (27) that are provided on the side plate portions (24, 25) of the frame (12) of the stapler body (10).

4 Claims, 57 Drawing Sheets

MOTOR-DRIVEN STAPLER

BACKGROUND OF THE INVENTION

1. Field of the Invention

The present invention relates to an motor-driven stapler comprising a table that is arranged as opposed to a staple drive portion for driving a staple and is provided vertically movable on the stapler body.

2. Description of the Prior Art

Conventionally known is a motor-driven stapler comprising a table arranged as opposed to a staple drive portion of the stapler body and provided vertically movably, a driver for driving staples from said staple drive portion, a cartridge in which sheet staples are accommodated in a stacked configuration, and a feed mechanism for feeding the sheet staples, accommodated in the cartridge in a stacked configuration, to the staple drive portion.

Such motor-driven stapler allows the driver to be downwardly positioned to-cause said staple drive portion to drive the staples when said table has been moved upwardly to press sheets of paper against said staple drive portion. The tip portions of a staple driven penetrate the sheets of paper and are then clinched by a clincher that is provided on said table.

In such a motor-driven stapler, the table is adapted to move vertically in parallel and thus collides with the staple drive portion with the initial attitude thereof maintained. This caused a loud impact noise to occur.

Moreover, the impact or the like would cause the sensor means for sensing the home position of the table to malfunction.

In addition, the feed mechanism for feeding sheet staples to the staple drive portion is provided on the stapler body and the cartridge is attached to the stapler body detachably. Accordingly, the positional relation between the cartridge and the stapler body is critical to feed the sheet staples in the cartridge to the staple drive portion and requires both the cartridge and the stapler body for strict accuracy in dimensions.

SUMMARY OF THE INVENTION

A first object of the present invention is to provide a motor-driven stapler that can reduce impact noise.

A second object of the present invention is to provide a motor-driven stapler that can prevent the sensor means for sensing the home position from malfunctioning due to impacts.

Furthermore, a third object of the present invention is to provide a motor-driven stapler that requires the control of dimensional accuracy of only the cartridge.

According to a first aspect of the present invention, the motor-driven stapler is characterized by comprising a table arranged as opposed to a staple drive portion for driving a staple and provided movably up and down on a stapler body, and a driver for driving staples from said staple drive portion to sheets of paper when the table has been moved to press the sheets of paper against said staple drive portion, wherein the table is pivotally carried on the stapler body about axles to move up and down.

According to a second aspect of the present invention, the motor-driven stapler is characterized by comprising a table arranged as opposed to a staple drive portion for driving a staple and provided movably up and down on a stapler body, and a driver for driving a staple from said staple drive portion to sheets of paper when the table has been moved to press said sheets of paper against said staple drive portion, said motor-driven stapler being provided with a position sensor mechanism for sensing a home position of said table, wherein said position sensor mechanism comprises a position cam provided on a drive shaft for moving said table up and down, a one end of which is rotatably pivoted, and arm sensor means for sensing that said sensor arm has rotated to a predetermined position, said position cam is provided, on a circumferential surface thereof, with a recessed portion for indicating said home position and a projected portion symmetrically opposite to the recessed portion, and said sensor arm has a first arm portion where a first top end portion is slidingly in contact with the circumferential surface of said position cam, a second arm portion where a second top end portion is slidingly in contact with the circumferential surface of said position cam, wherein said first top end portion and said second top end portion sandwich said position cam, said first top end portion is slidingly in contact with said recessed portion, and said second top end portion is slidingly in contact with said projected portion and said sensor arm rotates to a predetermined position.

According to a third aspect of the present invention, the motor-driven stapler is characterized by comprising a table arranged as opposed to a staple drive portion for driving a staple and provided movably up and down on a stapler body, a driver for driving a staple from said staple drive portion to sheets of paper when said table has been moved to press said sheets of paper against said staple drive portion, and a cartridge for accommodating sheet staples, attached detachably to said stapler body, and provided with said staple drive portion, wherein said cartridge is provided with a mechanism for feeding sheet staples accommodated in said cartridge to said staple drive portion.

DETAILED DESCRIPTION OF THE EMBODIMENT

Figure 1:
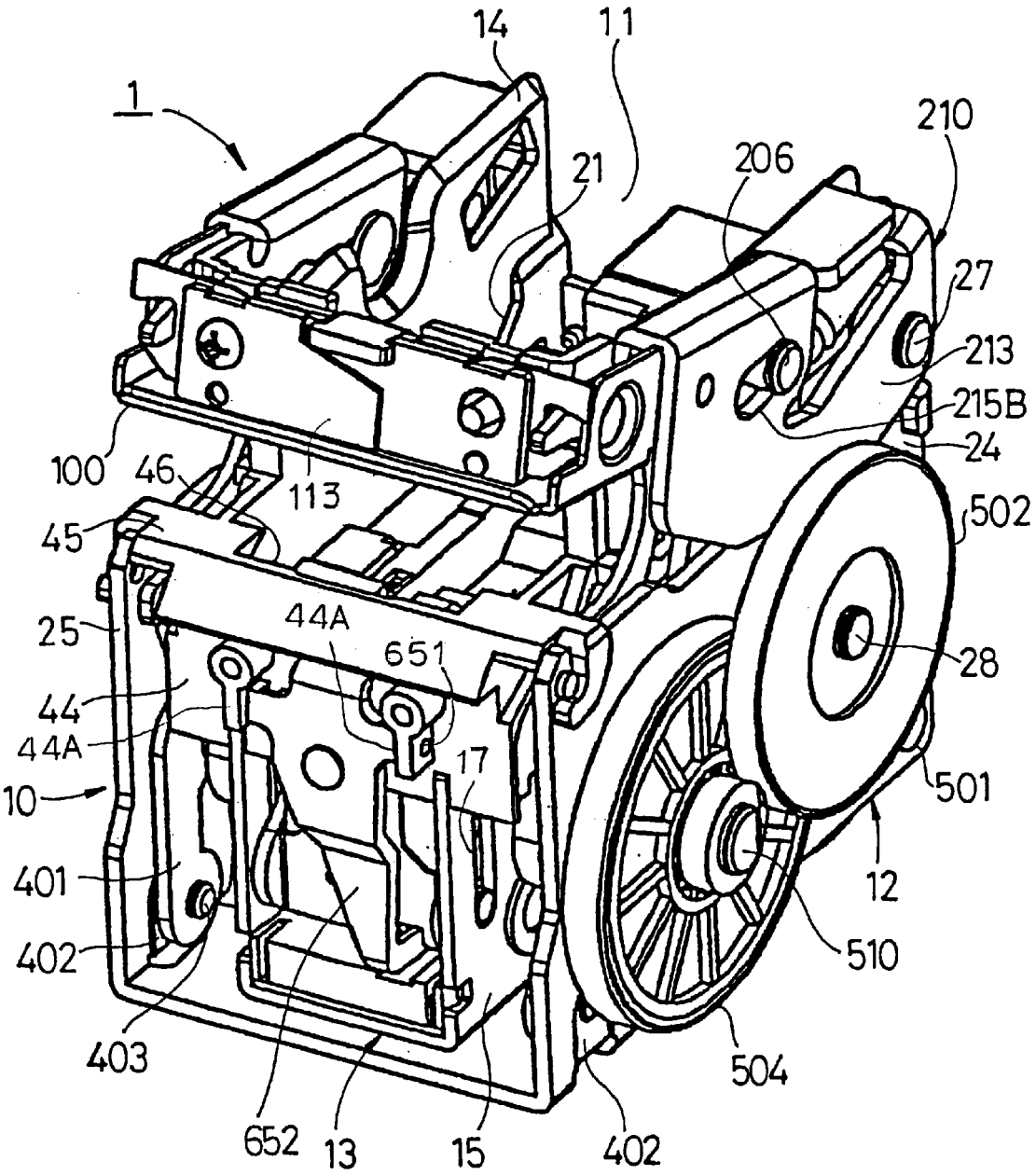
FIG. 1 is a perspective view showing a motor-driven stapler according to the present invention.
Figure 33:
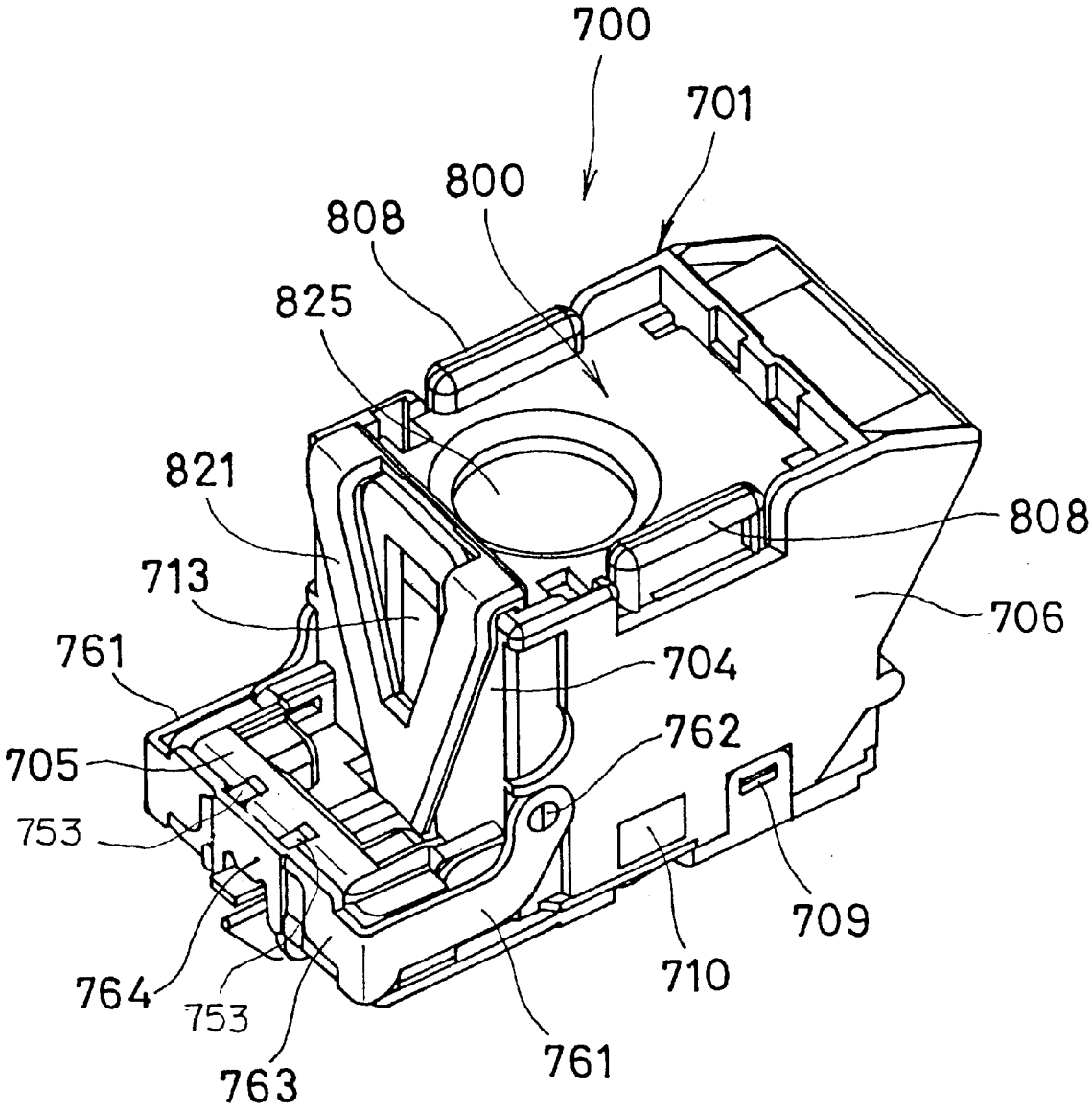
FIG. 33 is a perspective view showing a cartridge.

Embodiments of the motor-driven stapler according to the present invention will be explained with reference to the drawings. Referring to FIG. 1, for example, reference numeral 1 designates a motor-driven stapler to be attached to a copier or the like. The motor-driven stapler 1 comprises a stapler body 10 and a cartridge 700 (refer to FIG. 33) that is mounted detachably in a cartridge chamber 11 defined in the stapler body 10.

The stapler body 10 is provided with a table 100 that reciprocates up and down, a table mechanism 200 (refer to FIG. 13) that actuates the table 100 in a reciprocating manner, and a staple drive mechanism 300 (refer to FIG. 23) for driving staples Sa from a staple drive portion 50 arranged in the cartridge 700. The stapler body 10 is also provided with a clincher mechanism 400 (refer to FIG. 20) for clinching the tip portions of a staple driven; a drive mechanism 500 (refer to FIG. 7) for driving each of mechanisms 200, 300, 400; a position sensor mechanism 600 (refer to FIG. 24) for sensing the home position of the table 100; and a staple sensor mechanism 650 (refer to FIG. 25) for sensing whether the staples Sa are available in the staple drive portion 50.

The cartridge 700 is provided with a feed mechanism 900 (refer to FIG. 34) for feeding sheet staples ST, stacked inside the cartridge 700, to the staple drive portion 50.

Figure 2:
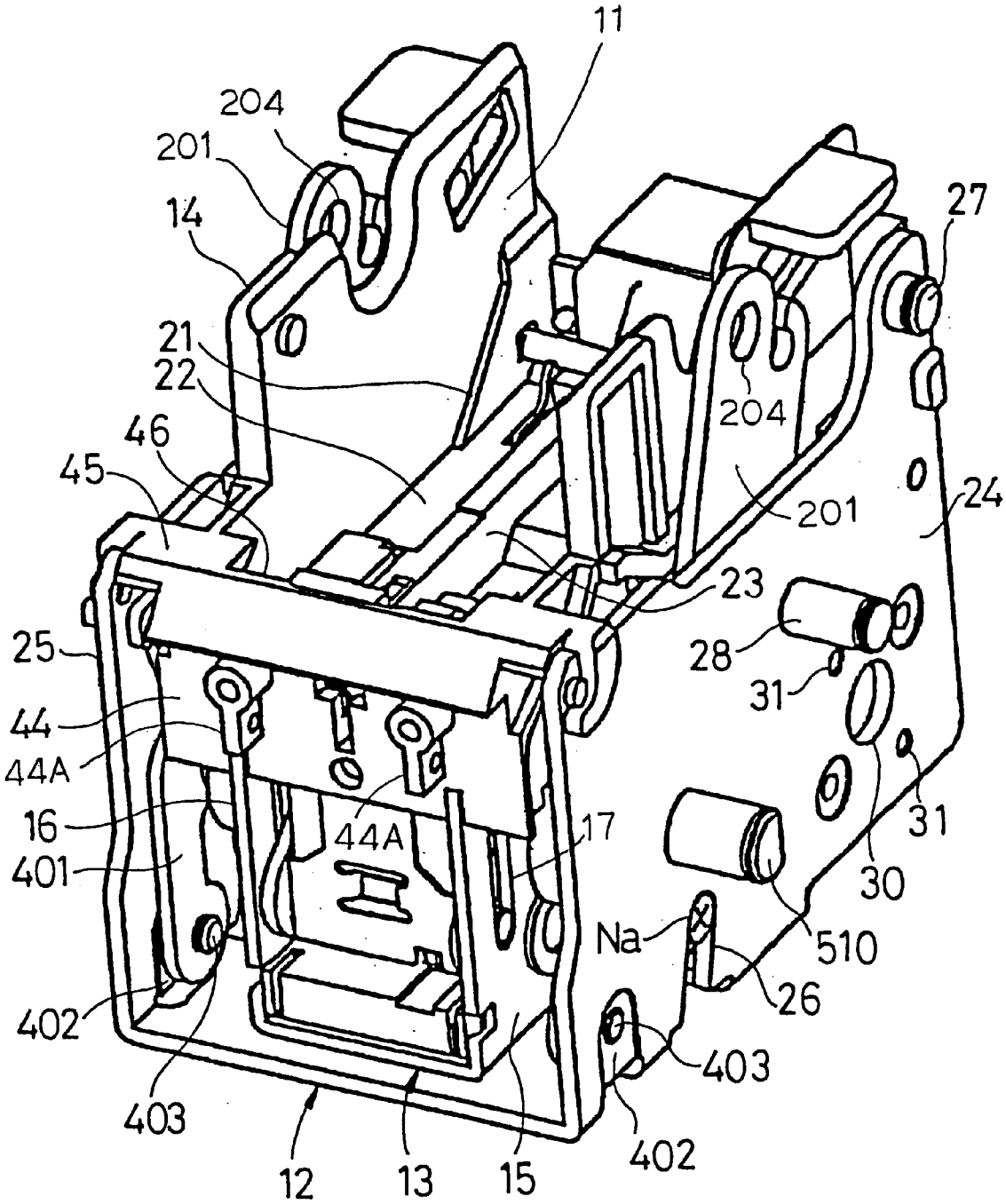
FIG. 2 is a perspective view of the motor-driven stapler shown in FIG. 1, part of which is not shown.
Figure 3:
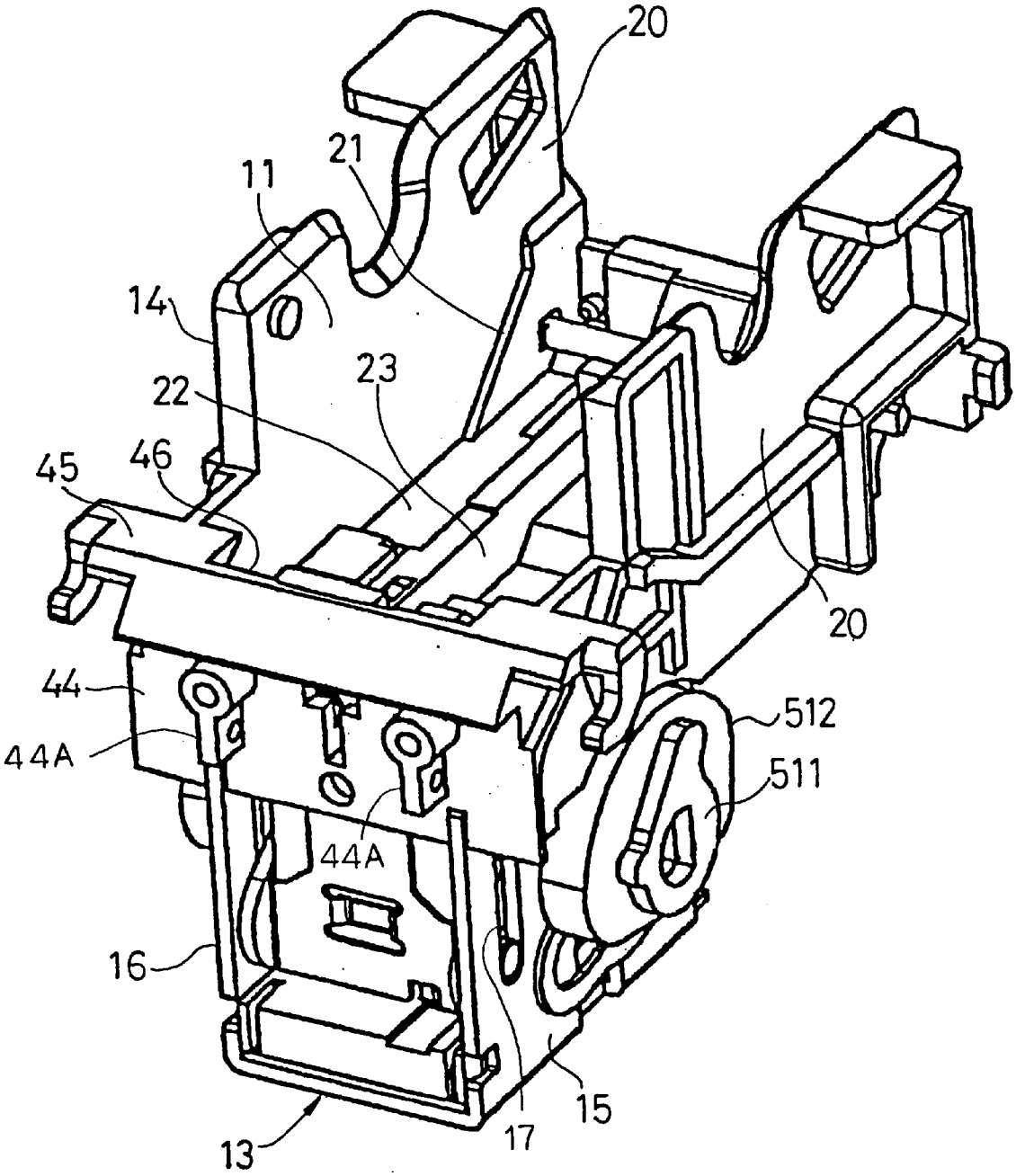
FIG. 3 is a perspective view showing the sub-frame and magazine of FIG. 1.

As shown in FIGS. 2 and 3, the stapler body 10 comprises a metal frame 12, a sub-frame 13 that is mounted inside the frame 12, and a plastic magazine 14 that is mounted to the sub-frame 13.

Figure 4:
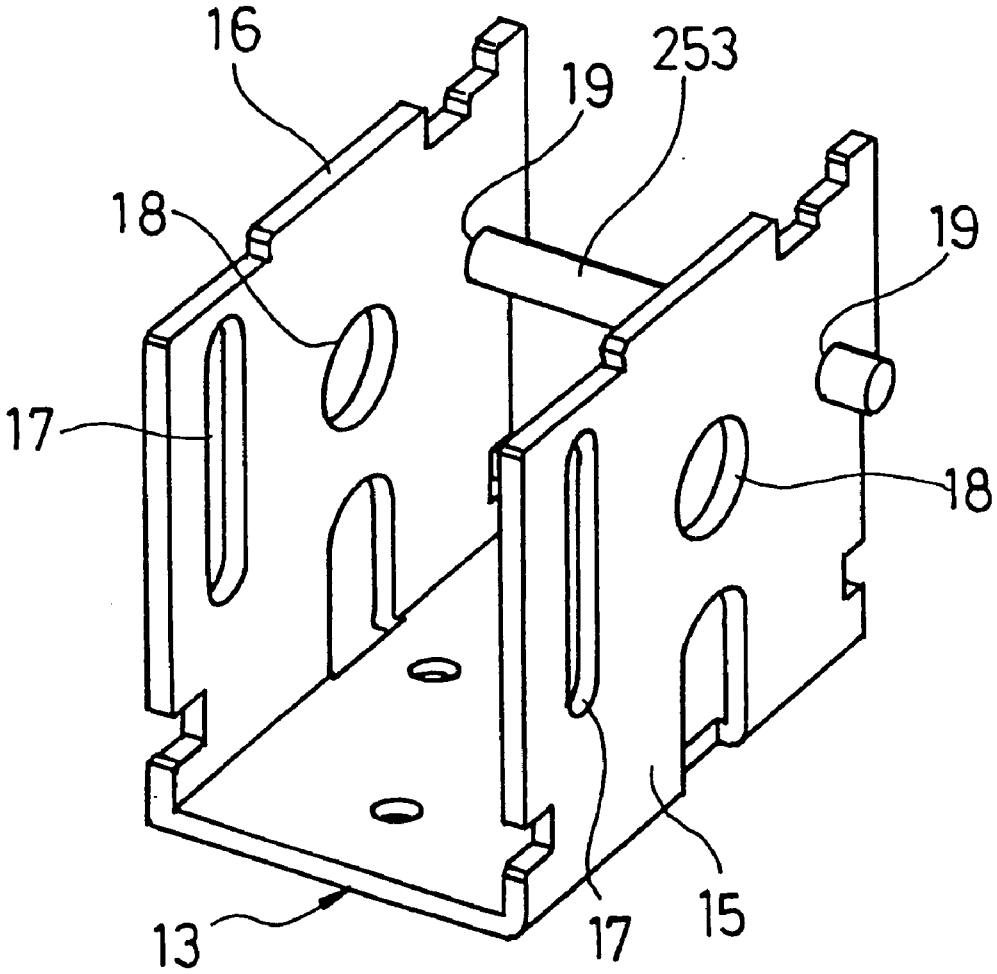
FIG. 4 is a perspective view showing the sub-frame shown in FIG. 1.

As shown in FIG. 4, the sub-frame 13 has upright spaced-apart side plate portions 15, 16, on which provided are long holes 17, 17 extending vertically, holes 18 for a drive shaft, and axle holes 19, etc. There is inserted an axle 253 through the axle holes 19.

The magazine 14 defines the cartridge chamber 11 and there are formed inclined guide portions 21 for guiding the cartridge 700 inside spaced-apart walls 20 of the magazine 14, respectively. In addition, there is formed a recessed portion 23 for accommodating the feed mechanism 900 of the cartridge 700 on the bottom portion 22 of the magazine 14.

Furthermore, there is formed a flat anvil 45 for pressing sheets of paper on the upper portion of a front wall portion 44 of the magazine 14. A recessed portion 46 is formed inside the anvil 45. The recessed portion 46 is adapted to engage a face plate of the cartridge 700, which is to be described later. Moreover, between the front wall portion 44 and the bottom portion 22, formed are holes (not shown) which a driver 350 and the face plate 351 go into, both of which are to be described later.

There are formed a pair of inclined guide holes 26 on the lower front portions of the upright spaced-apart side plate portions 24, 25 of the frame 12. There are provided a pair of axles 27 on the upper rear portions of the side plate portions 24, 25. In addition, a drive shaft 510 is rotatably inserted in between the side plate portions 24, 25.

There is provided a gear stud 28 projecting sideward on the side plate portion 24.

Figure 5:
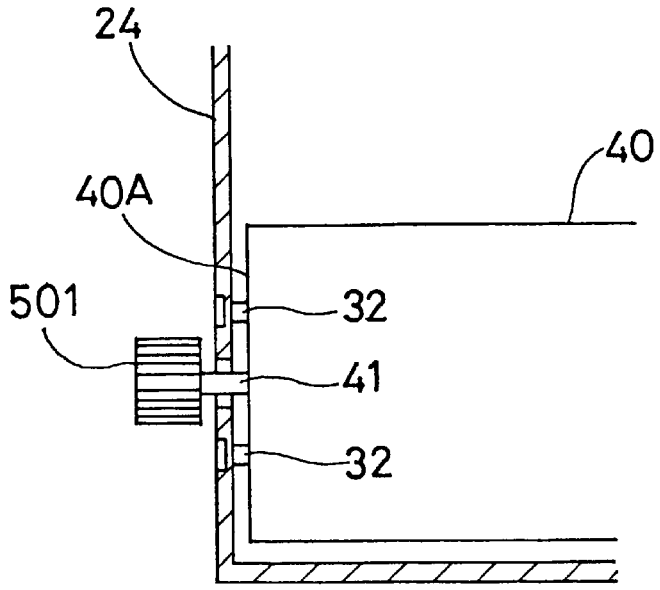
FIG. 5 is an explanatory view showing a motor mounted.
Figure 6:
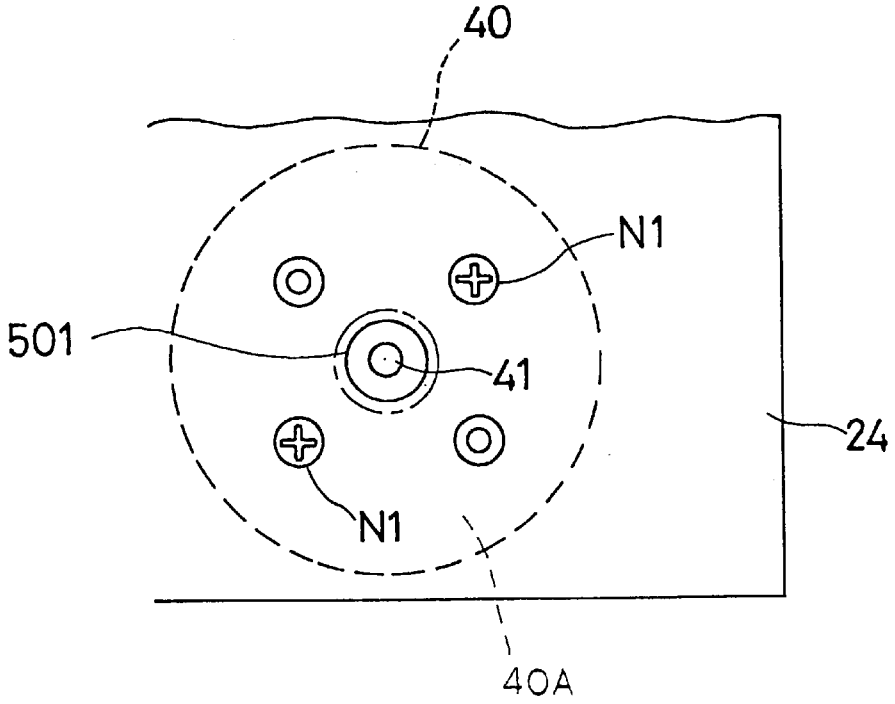
FIG. 6 is an explanatory view showing the positional relation between screws and bosses.

Furthermore, on the side plate portion 24, there are formed a shaft hole 30 for a motor, screw holes 31 near the shaft hole 30, and dowels 32, 32 projecting inwardly near the shaft hole 30 as shown in FIG. 5. AS shown in FIG. 6, screws N1 are screwed into the screw holes 31 of the side plate portion 24 to engage screw holes (not shown) on the front end surface 40A of the frame of a drive motor 40 shown in FIG. 5. Thus, the drive motor 40 is mounted to the side plate portion 24.

The dowels 32, 32 are in contact with the front end surface 40A of the frame of the drive motor 40 and the drive motor 40 is thus supported at four points with the screws N1, N1 and the dowels 32, 32. The four points are located near an output shaft 41 of the drive motor 40, serving to eliminate the adverse effect of waviness of the surface of the side plate portion 24 as much as possible. This allows the output shaft 41 of the drive motor 40 to be maintained at a right angle relative to the side plate portion 24 without waviness. Consequently, the output of the drive motor 40 can be transmitted to an intermediate gear 502, which is to be described later, without causing the output to be reduced.

[Drive mechanism 500]

Figure 7:
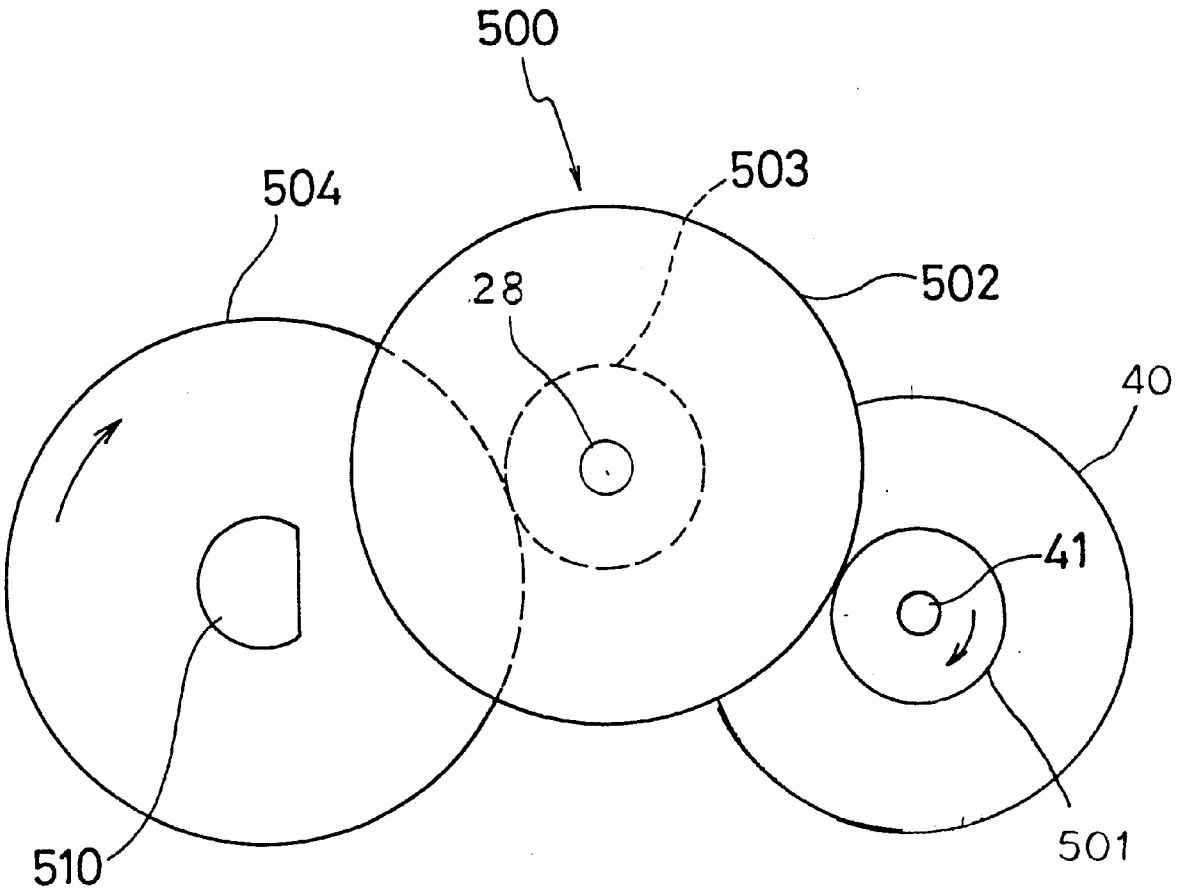
FIG. 7 is an explanatory view showing the configuration of a drive mechanism.

As shown in FIG. 7, the drive mechanism 500 comprises the drive motor 40 mounted to the side plate portion 24 of the frame 12, a gear 501 mounted to the output shaft 41 of the drive motor 40, intermediate gears 502, 503 engaged with the gear 501, a drive gear 504 engaged with the intermediate gear 503, and the drive shaft 510 rotating in conjunction with the drive gear 504. The intermediate gears 502, 503 are rotatably mounted to the gear stud 28.

The drive shaft 510 is driven by the drive motor 40 to rotate in the clockwise direction (in FIG. 7) via each of the gears 501–504.

Figure 8:
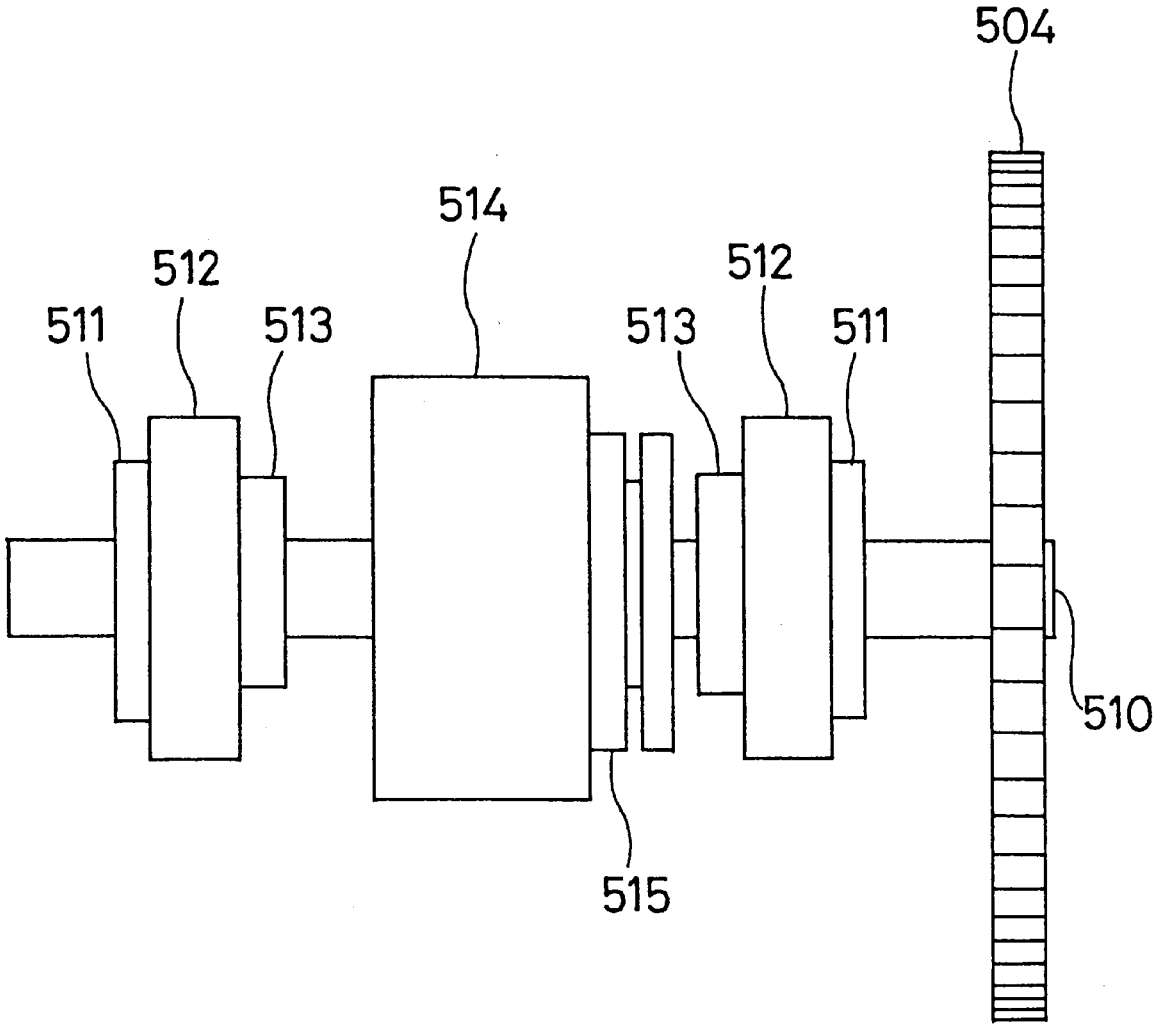
FIG. 8 is an explanatory view showing cams attached to a drive shaft.

As shown in FIG. 8, the drive shaft 510 is provided with a pair of clincher cams 511, 511, a pair of table link cams 512, 512, a pair of table return cams 513, 513 formed integrally with the table link cams 512, 512, a driver cam 514, and a position cam 515 for sensing the home position of the table 100.

The drive shaft 510 is rotatably inserted into the holes 18 of the side plate portions 15, 16 of the sub-frame 13. The sub-frame 13 has the driver cam 514 and the position cam 515 therein. There are disposed the clincher cams 511, 511, the table link cams 512, 512, and the table return cams 513, 513 in between the side plate portions 15, 16 of the sub-frame 13 and the side plate portions 24, 25 of the frame 12.

[Table 100]

Figure 9:
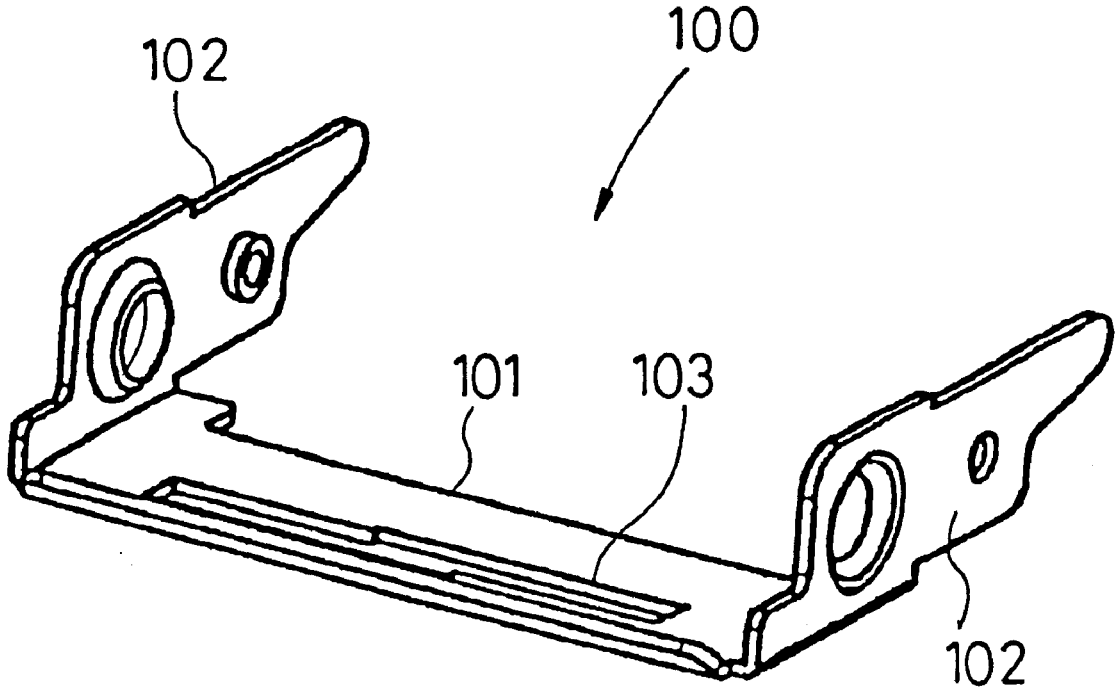
FIG. 9 is a perspective view showing a table.

As shown in FIG. 9, the table 100 has a flat table portion 101 extending sideward and arm portions 102, 102 extending rearward on the both ends of the table portion 101. There is formed an opening 103 extending sideward on the table portion 101. The arm portions 102 are mounted to side plate portions 211, 211 of a second table link 210 shown in FIGS. 10 and 11, respectively.

Figure 12:
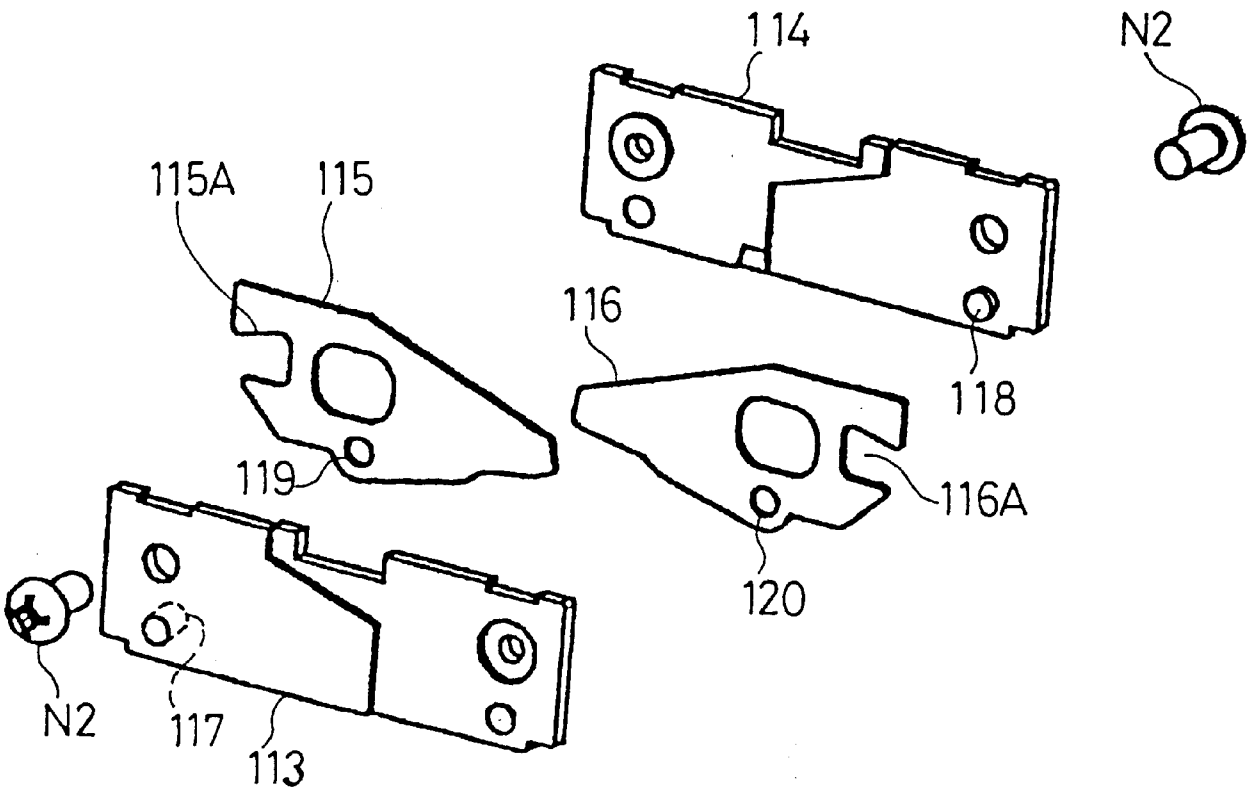
FIG. 12 is an exploded perspective view showing an assembly of a clincher.

A pair of clincher holders 113, 114, shown in FIG. 12, is provided as opposed to each other with screws N2 on a front end plate 212 of the second table link 210. There are disposed clinchers 115, 116 in between the clincher holders 113, 114 and above the opening 103 of the table 100. The clincher holders 113, 114 are provided with projected axles 117, 118 which are inserted into small holes 119, 120 of the clinchers 115, 116 to allow the clinchers 115, 116 to be rotatable about the projected axles 117, 118.

[Table mechanism 200]

Figure 13:
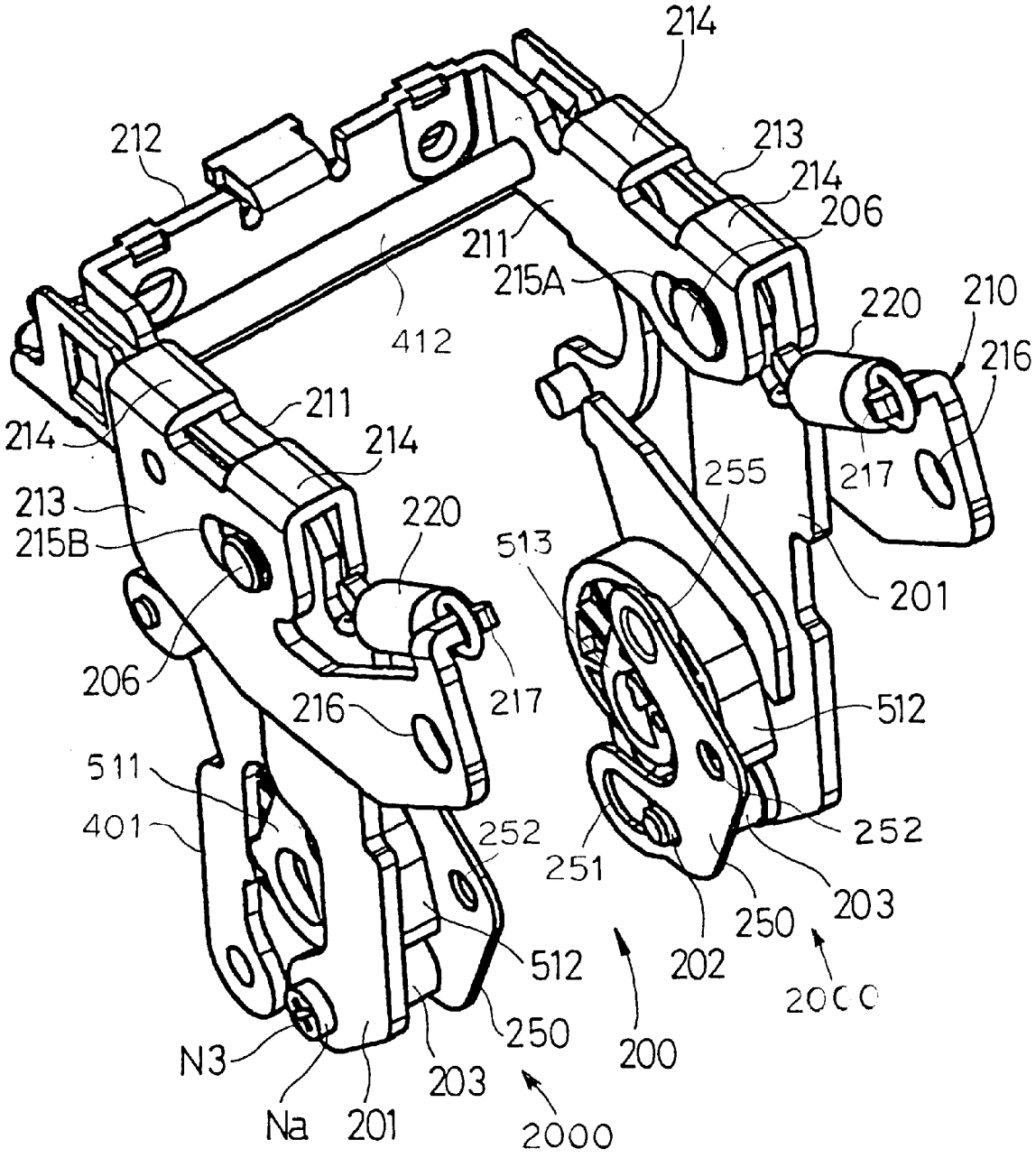
FIG. 13 is a perspective view showing the configuration of a table mechanism.
Figure 14:
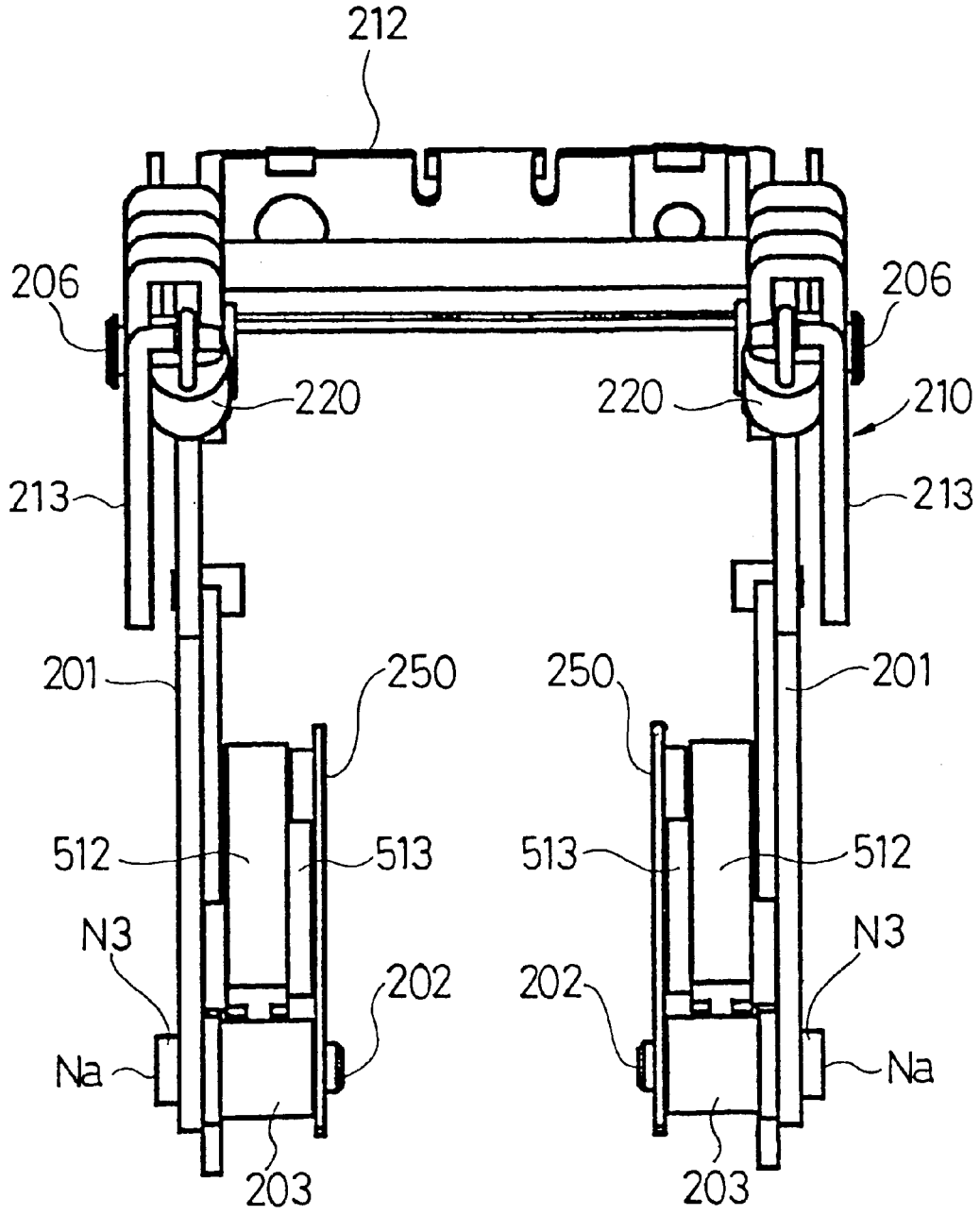
FIG. 14 is a rear view showing the table mechanism of FIG. 13.
Figure 15:
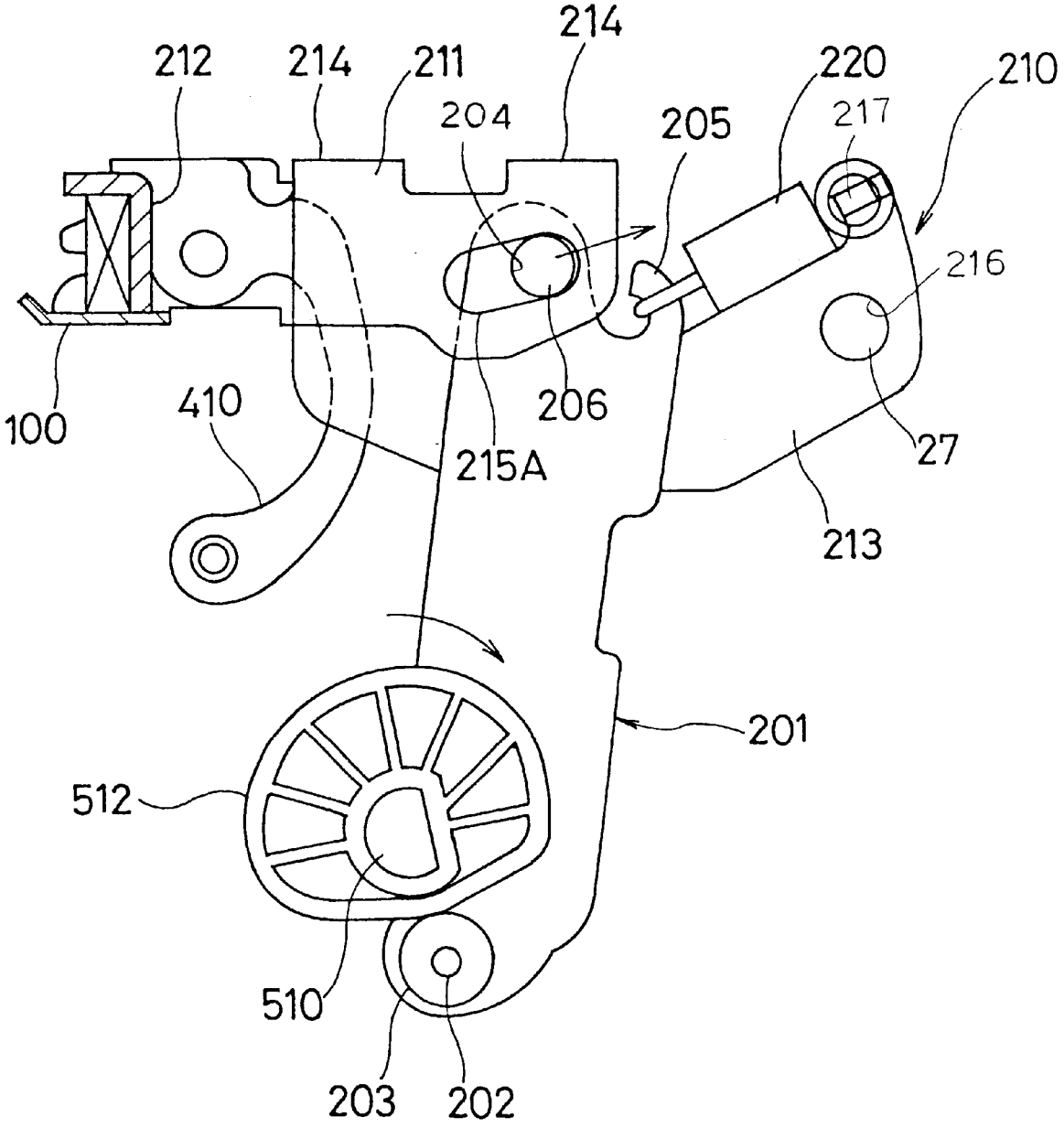
FIG. 15 is an explanatory view showing the configuration of the table mechanism.

As shown in FIGS. 13 to 15, the table mechanism 200 comprises a pair of the table link cams 512 provided on the drive shaft 510 (not shown in FIGS. 13 and 14), a pair of second table links 201, first table links (arm portions) 210, a pair of the table return cams 513, and a pair of table return levers 250.

Figure 16:
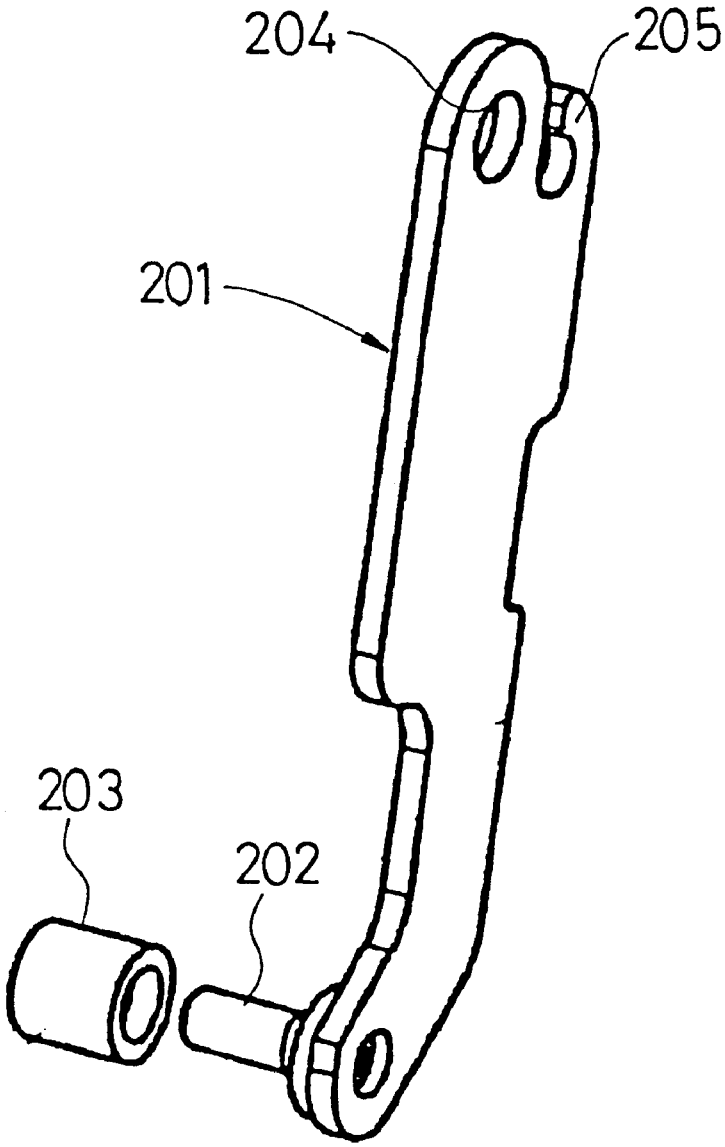
FIG. 16 is a perspective view showing a second table link.

As shown in FIG. 16, the second table link 201 extends vertically and is provided with an axle 202 on the lower portion thereof. The axle 202 is provided rotatably with a roller 203 that is in contact with the circumferential surface of the table link cam 512. Moreover, the axle 202 is provided with a screw N3 (refer to FIG. 13) and the head Na of the screw N3 is inserted into the guide hole 26 of the frame 12 (refer to FIG. 2). The second table link 201 is vertically movable along the guide hole 26. On the upper portion of the second table link 201, formed are a hole 204 and an engaging portion 205. An axle 206 is mounted in the hole 204 (refer to FIG. 15).

Figure 10:
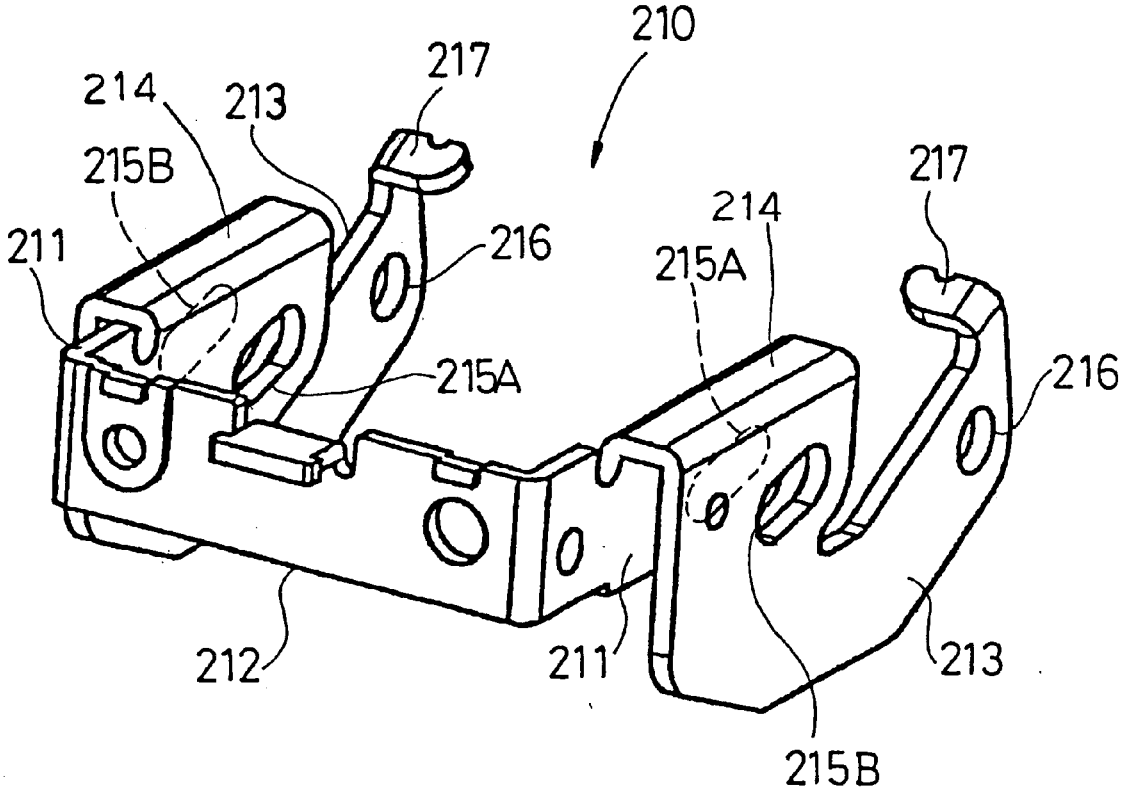
FIG. 10 is a perspective view showing a first table link.
Figure 11:
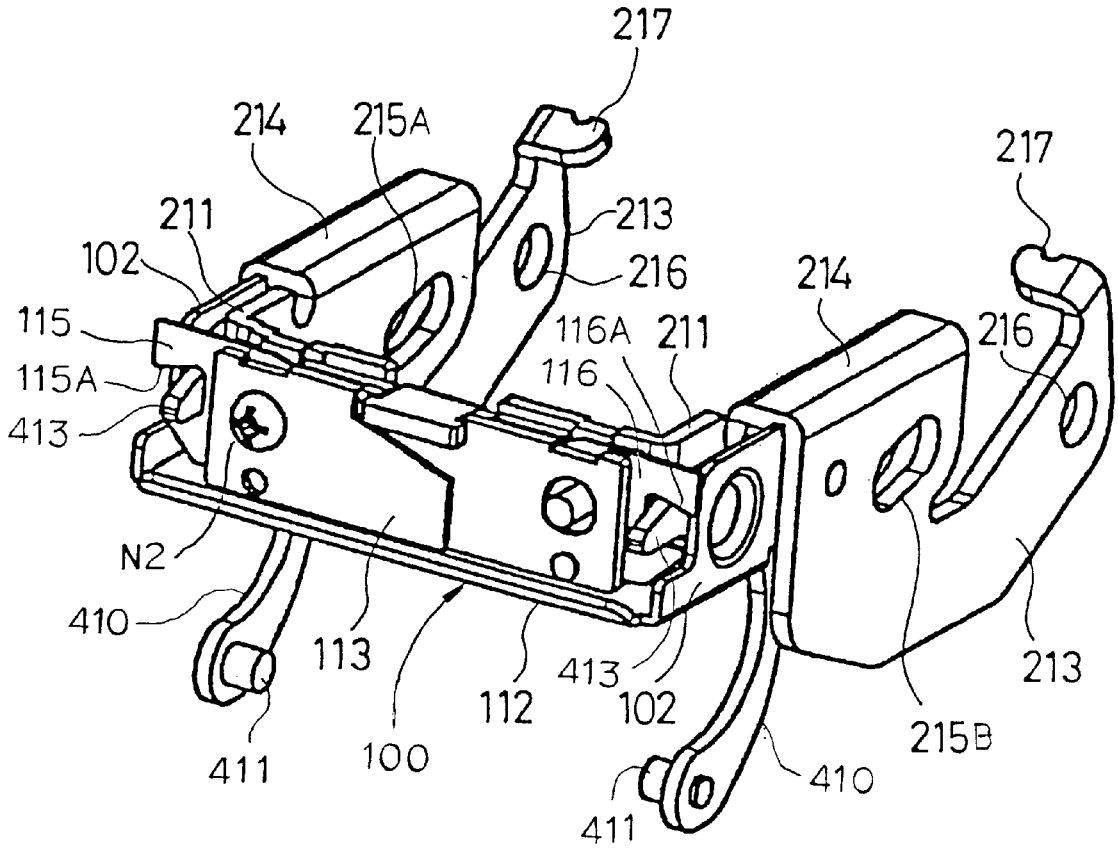
FIG. 11 is an explanatory view showing a table attached to the first table link.

As shown in FIG. 10, the first table link 210 has the side plate portions 211, 211 extending rearward from the both ends of the front end plate 212, and arm plate portions 213, 213 spaced apart from each other by a predetermined distance and provided on the outside of each of the side plate portions 211, 211. The upper portions of each of the side plate portions 211, 211 and of each of the arm plate portions 213, 213 are connected to each other with connecting portions 214, 214.

The side plate portions 211, 211 and the arm plate portions 213, 213 are provided with long holes 215A, 215B as opposed to each other. The long holes 215A, 215B are inclined upward and rearward, used for adjusting the thickness of sheets of paper. In addition, there is formed an axle hole 216 at the back of each of the long holes 215A, 215B in the rear portion of the arm plate portion 213. There is formed an engaging portion 217 on the upper end of the rear portion of each of the arm plate portions 213, 213.

The upper portion of the second table link 201 is disposed in between the side plate portion 211 and the arm plate portion 213 of the first table link 210. The axles 206 of the second table links 201 are inserted in the long holes 215A, 215B on the side plate portions 211 and the arm plate portions 213, respectively. The axles 206 are movable along the long holes 215A, 215B therein. Moreover, each of the axles 27 provided on the frame 12 is inserted in each of the axle holes 216 of the arm plate portions 213 of the first table link 210 to allow the first table link 210 to be rotatable about the axles 27. There are provided paper thickness adjusting springs 220 between the engaging portions 217 of the first table link 210 and the engaging portions 205 of the second table links 201, respectively. The paper thickness adjusting springs 220 energize the axles 206 of the second table links 201 in the direction of the arrow shown in FIG. 15.

Figure 17:
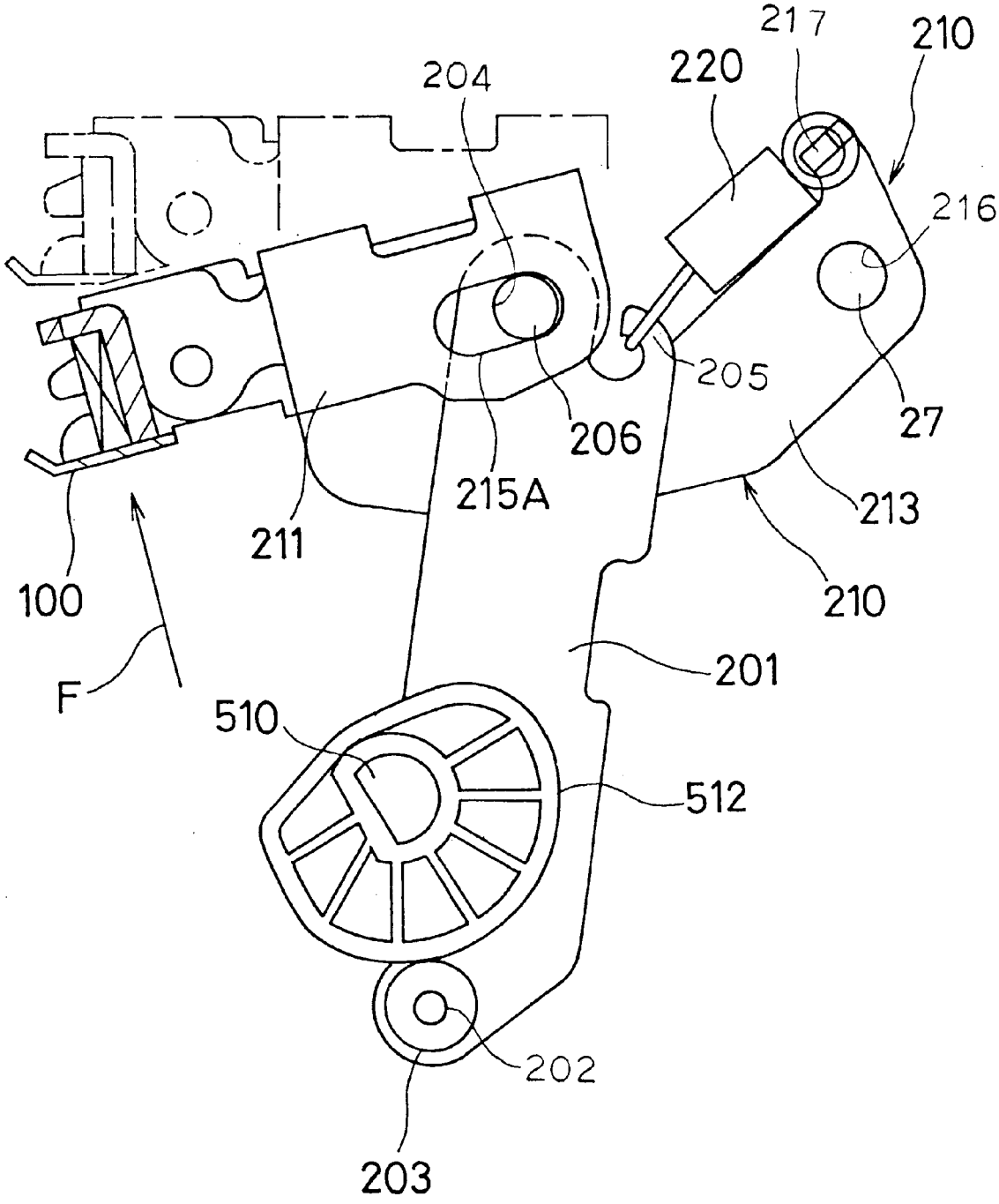
FIG. 17 is an explanatory view showing the second table link that has been rotated.

Since the second table links 201 allow the rollers 203 to contact with the circumferential surfaces of the table link cams 512, rotation of the table link cams 512 cause the second table links 201 to move downward from the position shown in FIG. 15 along the guide holes 26 of the frame 12 in conjunction with the rotation. The downward movement of the second table links 201 causes the first table link 210 to rotate in the anti-clockwise direction about the axles 27 of the frame 12 as shown in FIG. 17.

Figure 18:
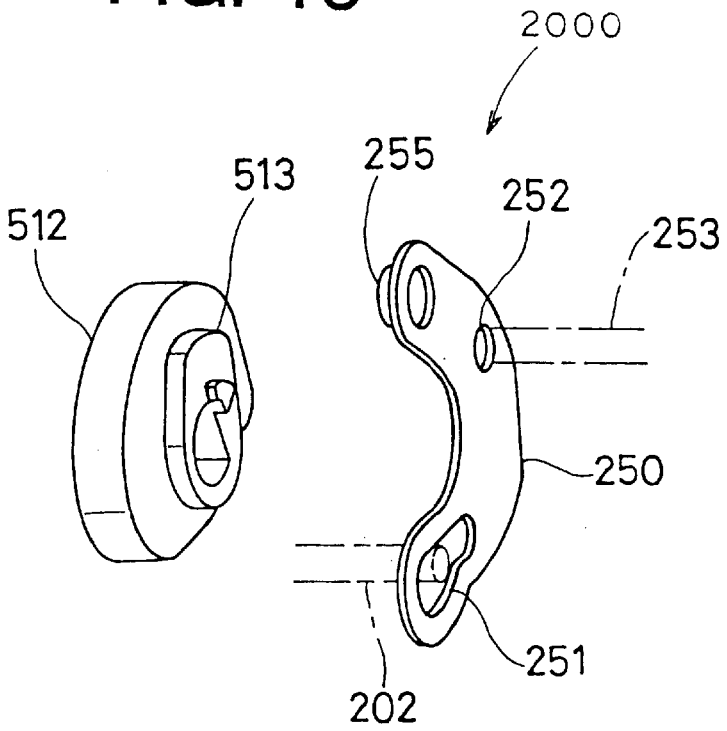
FIG. 18 is a perspective view showing a table return lever and a table return cam.

As shown in FIG. 18, the table return levers 250 are formed generally in the shape of letter C. There are formed a long hole 251 on the lower portion of the table return lever 250 and an axle hole 252 above the middle portion thereof, respectively. There is provided a roller 255 in the upper portion of the table return lever 250. The roller 255 is in contact with the circumferential surface of the table return cam 513 and the end portion of the axle 253 provided on the sub-frame 13 is inserted in the axle hole 252. Moreover, the axle 202 of the second table link 201 is inserted in the long hole 251.

Figure 19:
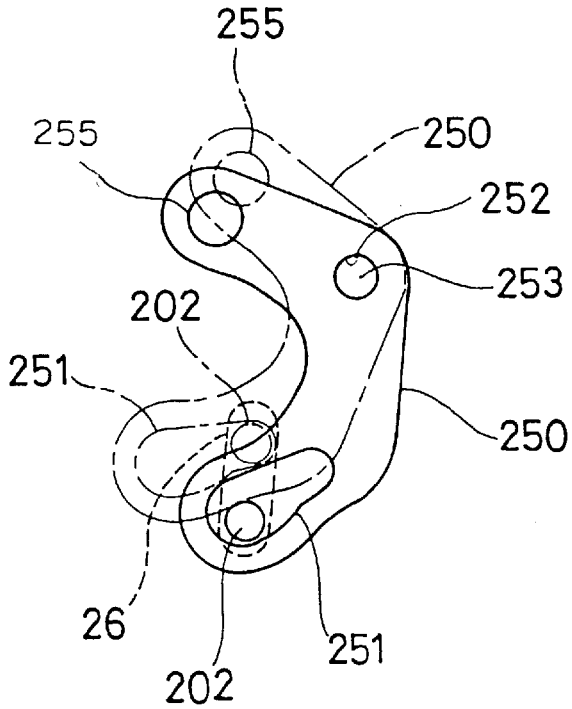
FIG. 19 is an explanatory view showing the motion of the table return lever.

Rotation of the table return cams 513 causes the table return levers 250 to move pivotally between the positions shown by the solid line and the chain line about the axle 253 as shown in FIG. 19. As shown in FIG. 17, the table return levers 250 are adapted to move to the position shown by the solid line in FIG. 19 when the second table links 201 move downward. On the other hand, as shown in FIG. 15, the table return levers 250 are adapted to move to the position shown by the chain line in FIG. 19 when the second table links 201 move to the upper position (the initial position).

The axle 202 of the second table link 201 is inserted in the long hole 251 of the table return lever 250 and the head Na of the screw N3 provided on the axle 202 is inserted in the guide hole 26 of the frame 12. Accordingly, the movement of the table return lever 250 from the position shown by the solid line to that shown by chain line as shown In FIG. 19 causes the axle 202 to be guided by the guide hole 26 to move upward. The movement causes the second table link 201 to move from the position shown in FIG. 17 to that (the initial position) shown in FIG. 15. The movement also causes the first table link 21D to rotate in the clockwise direction and move from the position shown in FIG. 17 to that shown in FIG. 15. The movement further causes the first table link 210 to bring the table 100 back to the stand-by position (home position) shown in FIG. 1.

The table return levers 250, the table return cams 513 and the like constitute table return mechanism 2000 for returning the table 100 to the original position. (the stand-by position). The table return mechanism 2000 obviates the need to provide springs that allow the roller 203 to be in contact with the circumferential surface of the table link cam 512 all the time. Accordingly, this allows the table 100 to be moved downward without rotating the table link cams 512 against the energized force of the springs, so that the motor 40 should provide only a small amount of output.

[Clincher mechanism 400]

Figure 20:
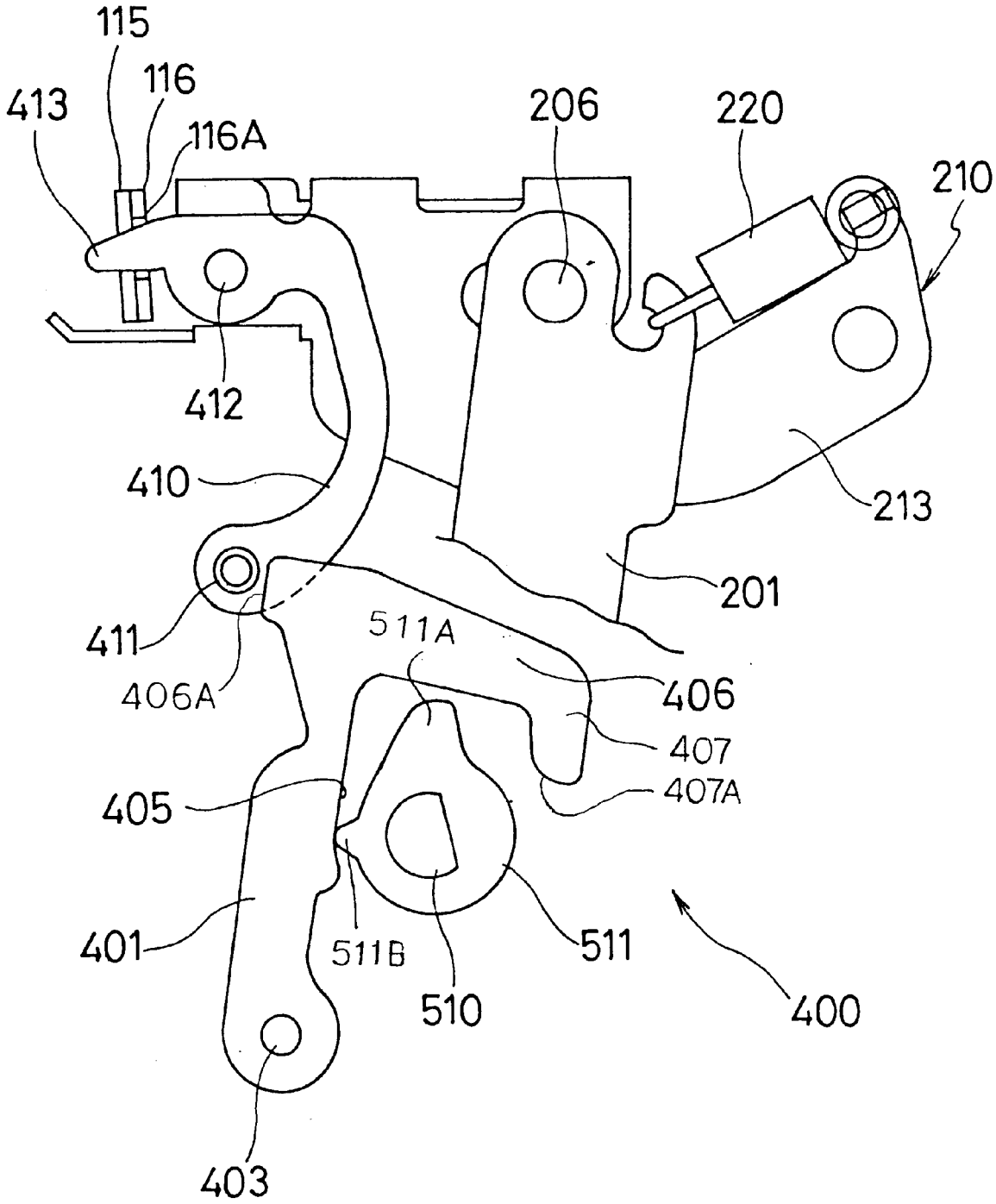
FIG. 20 is an explanatory view showing the configuration of a clincher mechanism.

As shown in FIG. 20, the clincher mechanism 400 comprises a pair of the clincher cams 511 provided on the drive shaft 510, a pair of first clincher links 401, a pair of second clincher links 410, and the clinchers 115, 116.

The clincher cam 511 is provided with a projecting portion 511A for clinching and a return projecting portion 511B.

The lower portion of the first clincher link 401 is rotatably attached to an axle 403 that is mounted to the frame 12 via a stud 402. There is formed a contact portion 405, which contacts with the circumferential surface of the clincher cam 511, on the side portion of the first clincher link 401. On the upper portion of the first clincher link 401, formed is a contact portion 406 that extends rearward (to the right in FIG. 20) and contacts with a roller 411 of the second clincher link 410. On the rear end portion of the contact portion 406, formed is a projecting portion 407 that projects downwardly. On the projecting portion 407, formed is a curved inclined surface 407A that is inclined leftward (in FIG. 20) and upward.

The projecting portion 511A of the clincher cam 511 contacts with the contact portion 405 of the first clincher link 401, so that the first clincher link 401 rotates in the counter-clockwise direction about the axle 403.

The second clincher links 410 are formed generally in the shape of letter C and the upper portions thereof are pivotally attached to the end portions (portions protruding sideward from the side plate portions 211, 211) of a shaft 412 (refer to FIG. 13) disposed in between the side plate portions 211, 211 of the first table link 210. There is formed a projection 413 protruding forwardly (leftward in FIG. 20) on the top end of the upper portion of the second clincher link 410. The projection 413 engages the recessed portion 116A of the clincher 116. Likewise, the projection 413 of the other second clincher link 410 engages the recessed portion 116A of the clincher 116. There is provided the roller 411 on the lower portion of the second clincher link 410. The projection 413 of the other second clincher link 410 engages the recessed portion 115A of the clincher 115.

Counter-clockwise rotation of the first clincher links 401 causes the front ends 406A of the contact portions 406 of the first clincher links 401 to contact with the rollers 411 of the second clincher links 410, thus causing the second clincher links 410 to rotate about the shaft 412 in the clockwise direction (in FIG. 20). The rotation of the second clincher links 410, 410 causes each of the clinchers 115, 116 to rotate about the projected axles 117, 118 of the clincher holders 113, 114 in the directions of the arrows from the position shown in FIG. 21(A) to the position shown in FIG. 21(B). The rotation of the clinchers 115, 116 causes the tip portions of a staple to be clinched.

The clinchers 115, 116 are energized by springs (not shown) in the directions opposite to those of the arrows shown in FIG. 21(A) and thus return from the position shown in FIG. 21(B) to that shown in FIG. 21(A) due to the energized force of the springs after the clinching has been effected. In addition, the return causes the second clincher links 410 to return to the position shown in FIG. 20.

The projecting portions 511B of the clincher cams 511 contact with the inclined surfaces 407A of the first clincher links 401, thereby causing the first clincher links 401 to return to the position shown in FIG. 20.

[Staple Drive Mechanism 300]

Figure 22:
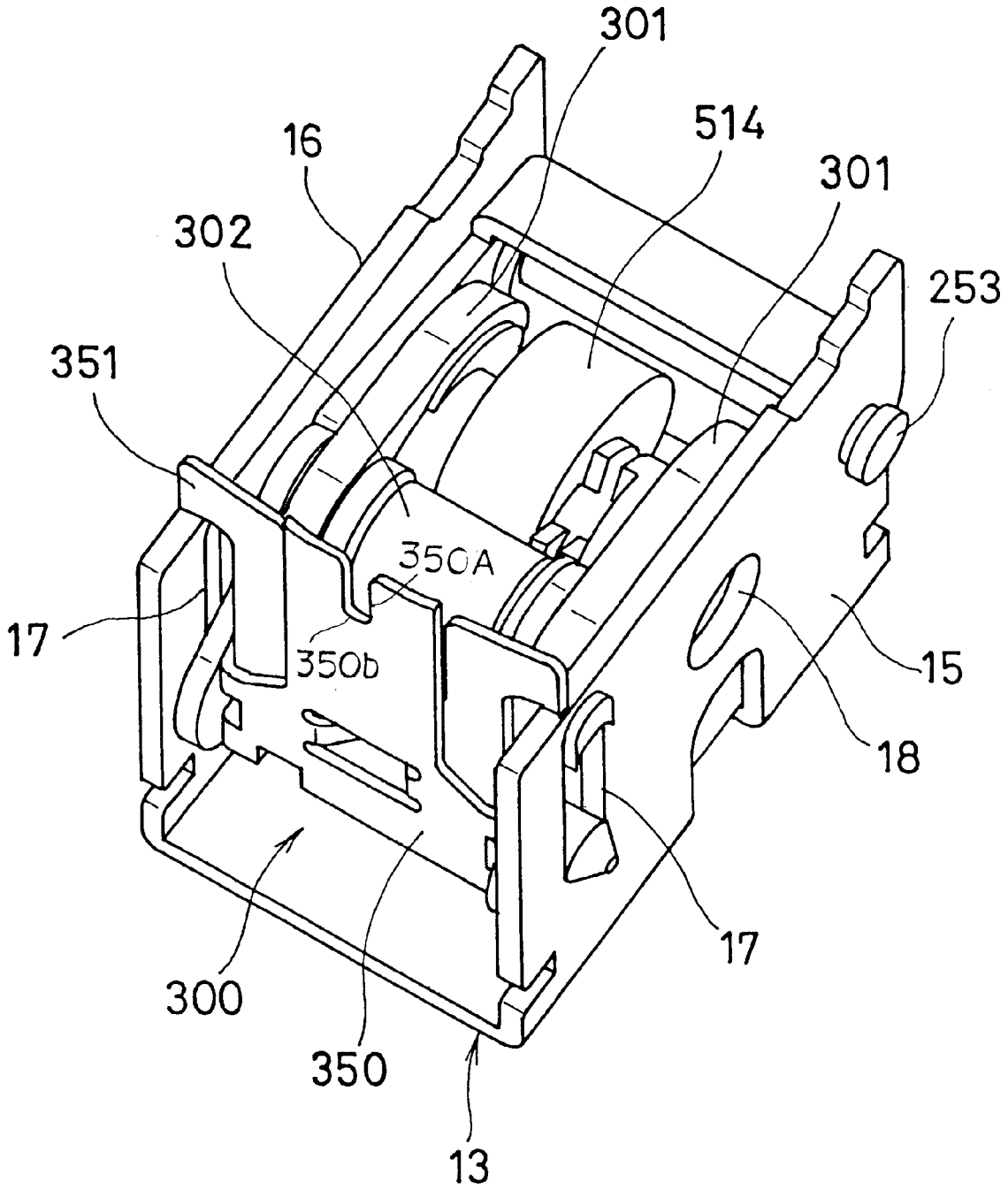
FIG. 22 is a perspective view showing the configuration of a staple drive mechanism.
Figure 23:
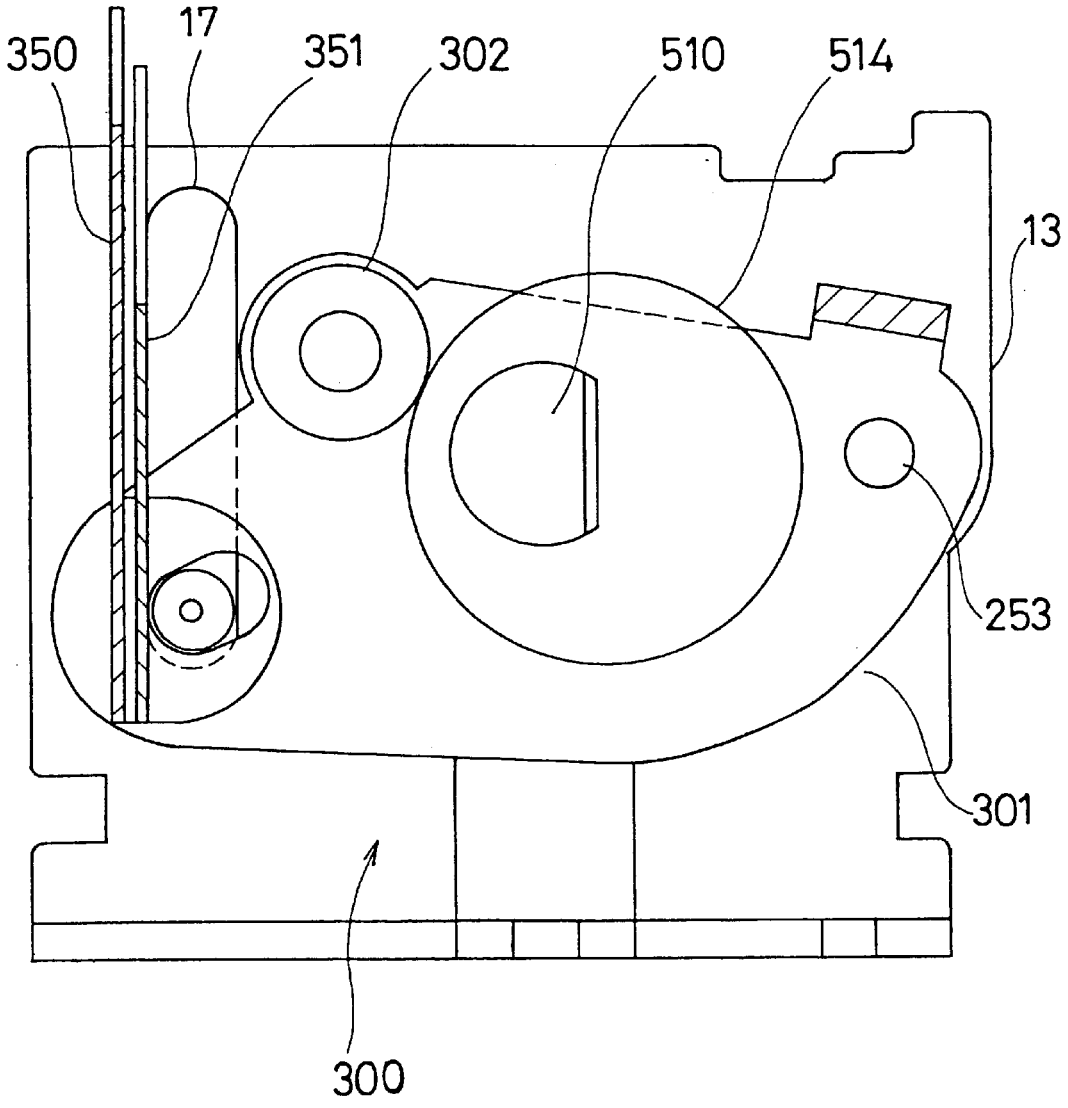
FIG. 23 is a sectional side view showing the staple drive mechanism.

As shown in FIGS. 22 and 23, the staple drive mechanism 300 comprises the driver cam 514 attached to the drive shaft 510, a pair of driver links 301 that are attached rotatably to the axle 253 of the sub-frame 13, and the driver 350 and the forming plate 351 which are attached to the driver links 301. There is provided a roller 302 rotatably in contact with the circumferential surface of the driver cam 514 in between the driver links 301, 301. Rotation of the driver cam 514 allows the driver links 301 to rotate about the axle 253, causing the driver 350 and the forming plate 351 to move up and down along the long holes 17 of the sub-frame 13. That is, one rotation of the driver cam 514 causes the driver 350 and the forming plate 351 to complete one cycle of vertical motion.

[Position Sensor Mechanism 600]

Figure 24:
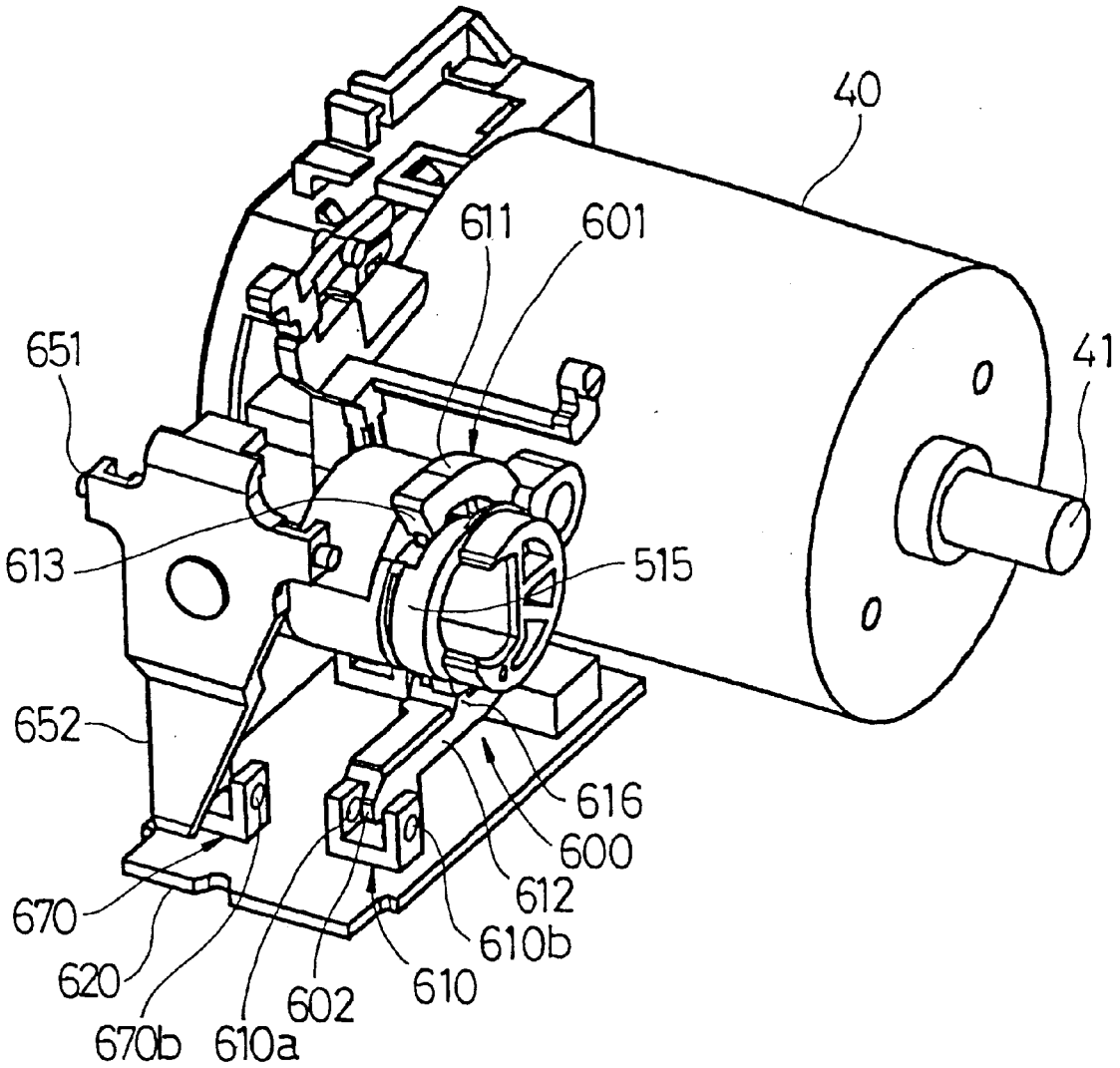
FIG. 24 is a perspective view showing the configuration of a position sensor mechanism and a staple sensor mechanism.
Figure 25:
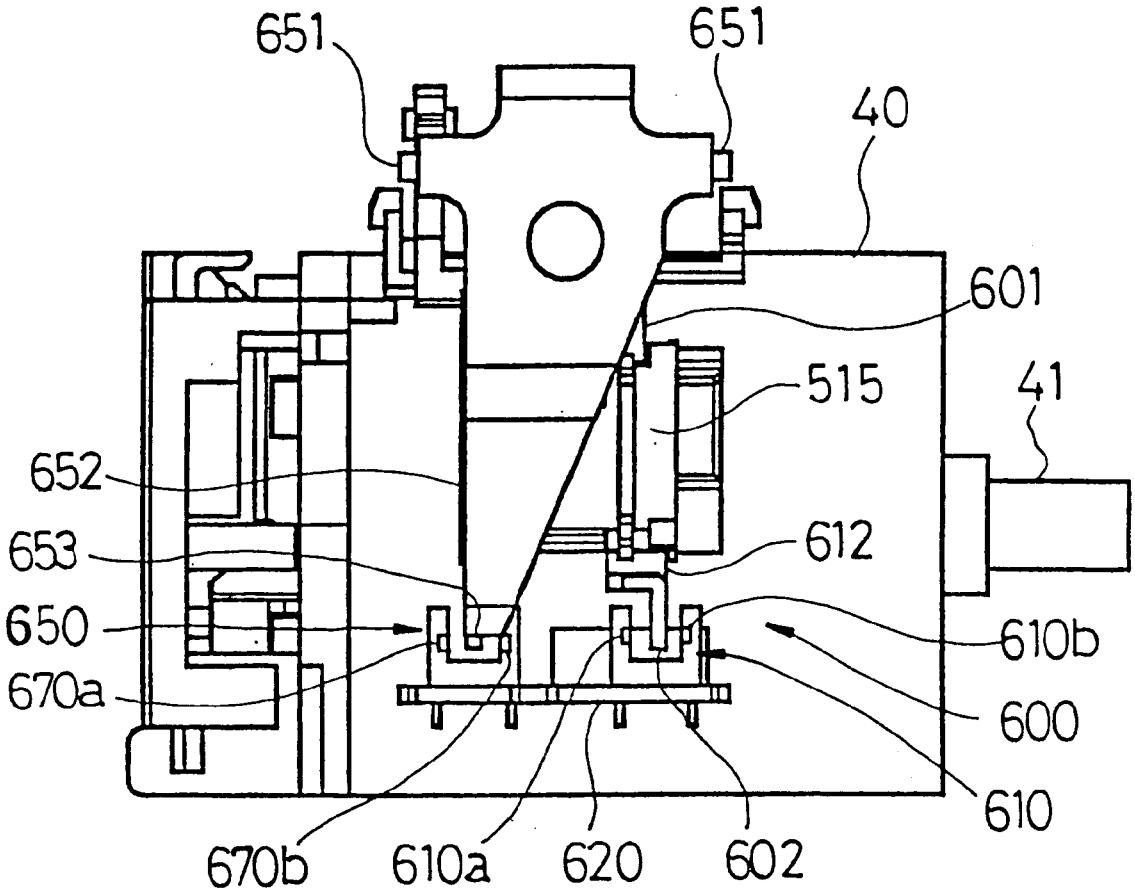
FIG. 25 is a front view showing the configuration of the position sensor mechanism and the staple sensor mechanism.
Figure 26:
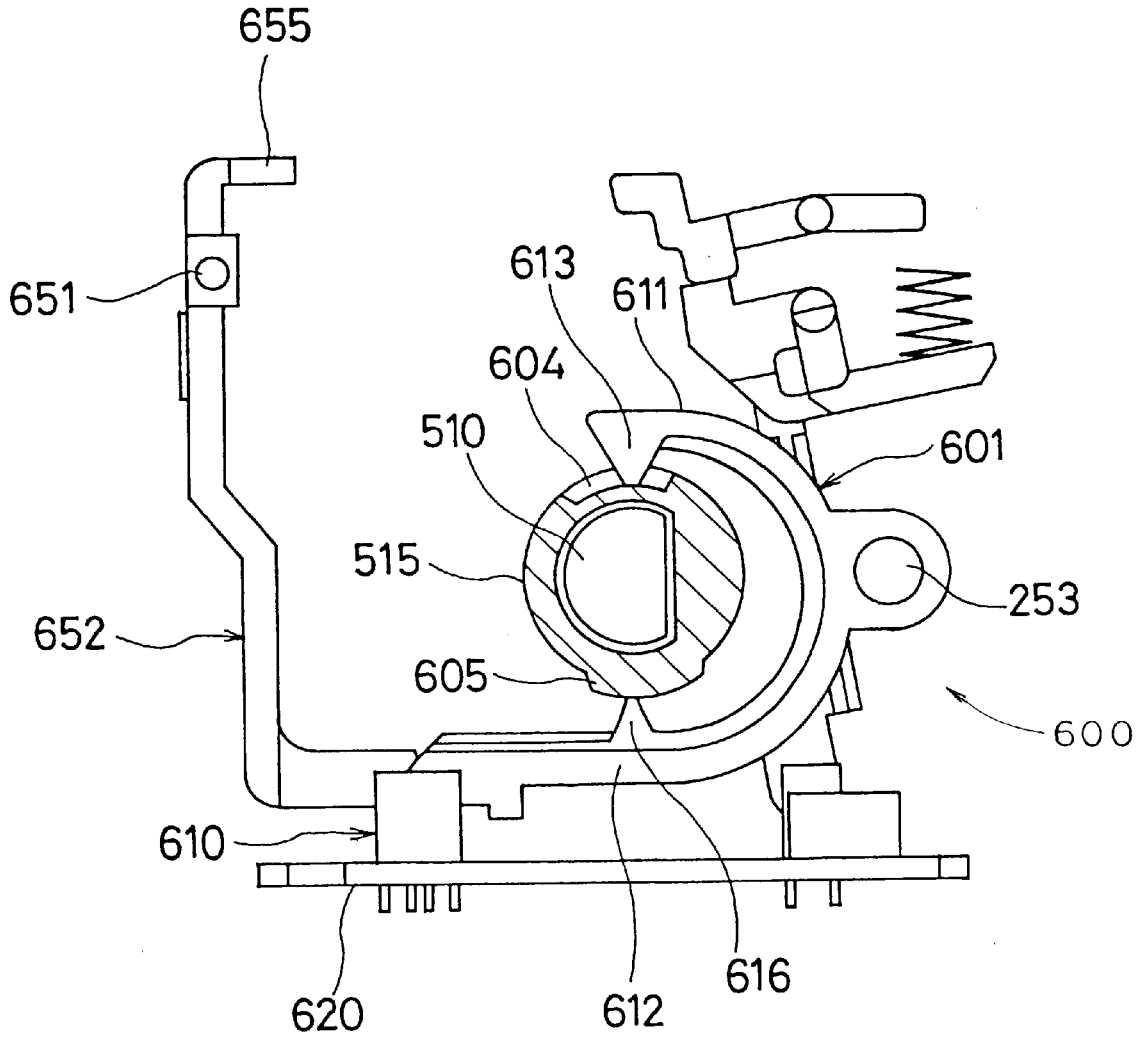
FIG. 26 is a side view showing the configuration of the position sensor mechanism.

As shown in FIGS. 24 to 26, the position sensor mechanism 600 comprises the position cam 515 provided on the drive shaft 510, a sensor arm 601, and a photo-sensor (arm sensor means) 610 for sensing a light shielding plate 602 of the sensor arm 601.

Figure 27:
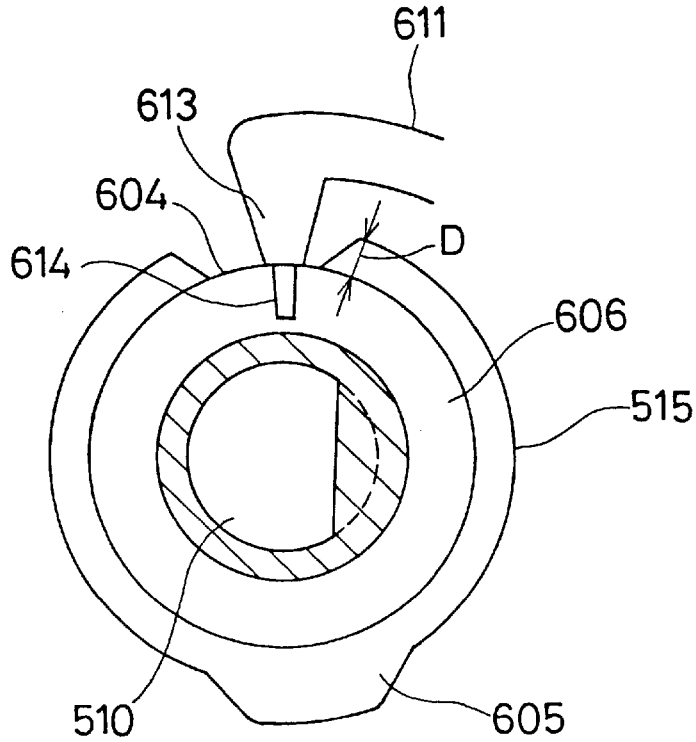
FIG. 27 is a longitudinal sectional view showing a position cam.
Figure 28:
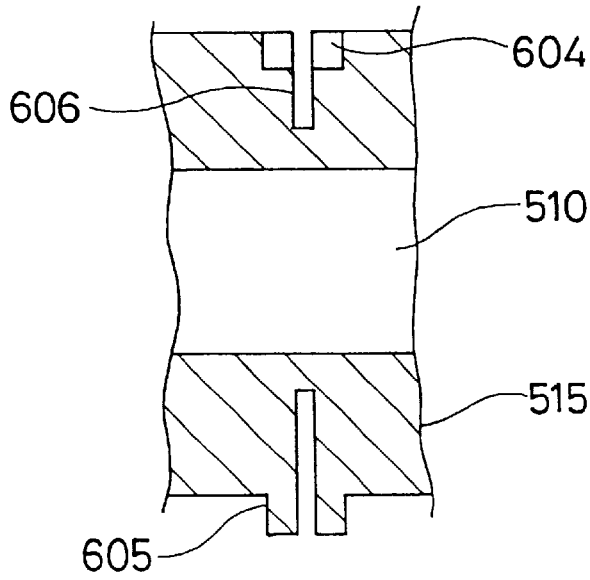
FIG. 28 is a cross sectional view showing the position cam.

As shown in FIGS. 27 and 28, on the position cam 515, formed are a recessed portion 604 for indicating the home position, a projection 605 disposed at the position symmetrically opposite to the recessed portion 604 with respect to the drive shaft 510, and an annular groove 606 passing vertically through the recessed portion 604 and the projection 605. Moreover, the depth of the recessed portion 604 and the height of the projection 605 are made equal to each other, while the annular groove 606 is deeper than the recessed portion 604.

Figure 29:
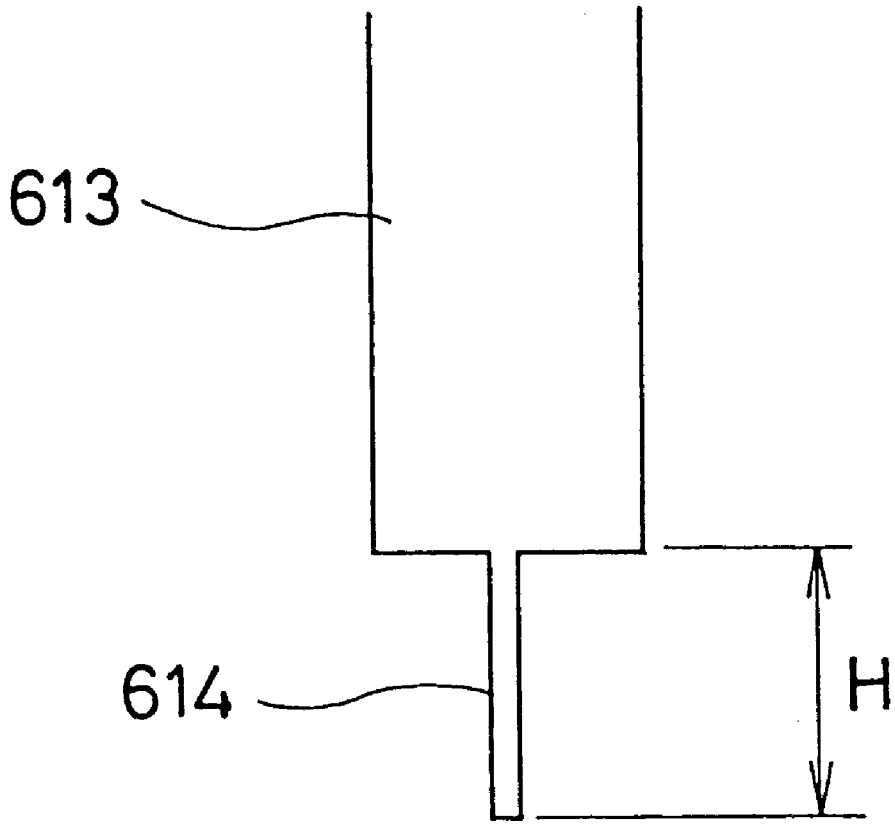
FIG. 29 is an explanatory view showing a projected portion of a first sensor arm and a guide projection.

The sensor arm 601 is attached rotatably to the axle 253 of the sub-frame 13, comprising an arc-shaped first arm portion 611 extending to above the position cam 515 and a second arm portion 612 extending from the lower portion of the first arm portion 611 through under the position cam 515 to the front (leftward in FIG. 26). On the end of the first arm portion 611, formed is a projected portion 613 sliding on the circumferential surface of the position cam 515 in contact therewith. The projected portion 613 is provided with a guide projection 614 that goes into the annular groove 606 of the position cam 515. As shown in FIG. 29, the height H of the guide projection 614 is adapted to be greater than the depth D of the recessed portion 604 of the position cam 515. The guide projection 614 allows the projected portion 613 of the first arm portion 611 to be prevented from deviating in the axial direction and to slide on the circumferential surface of the position cam 515.

On the second arm portion 612, there is formed a projected portion 616 that slides on the circumferential surface of the position cam 515 in contact therewith. The projected portion 616 is disposed symmetrically to the projected portion 613 of the second arm portion 612 with respect to the center of rotation of the drive shaft 510. In addition, the light shielding plate 602 is provided on the end of the second arm portion 612.

When the projected portion 613 of the first arm portion 611 enters into the recessed portion 604 of the position can 515, the projected portion 616 of the second arm portion 612 is adapted to sit on the projection 605 of the position cam 515. That is, the projected portion 613 of the first arm portion 611 and the projected portion 616 of the second arm portion 612 are adapted to sandwich the position cam 515 all the time.

The photo-sensor 610 is provided on a circuit board 620 mounted on the sub-frame 13. The photo-sensor 610 comprises a light-emitting diode 610*a* and a light-receiving diode 610*b* for receiving light emitted by the light-emitting diode 610*a*. The light shielding plate 602 intercepts light emitted from the light-emitting diode 610*a* and thereby the photo-sensor 610 senses the light shielding plate 602.

As shown in FIG. 26, when the projected portion 613 of the first arm portion 611 goes into the recessed portion 604 of the position cam 515, that is, when the projected portion 616 of the second arm portion 612 sits on the-projection 605 of the position cam 515, the light shielding plate 602 of the photo-sensor 610 is adapted to intercept light emitted from the light-emitting diode 610*a*. This happens when the table 100 comes to the home position shown in FIG. 1. That is, when the table 100 comes to the home position shown in FIG. 1, the light shielding plate 602 of the photo-sensor 610 is adapted to intercept light emitted from the light-emitting diode 610*a*.

[Staple Sensor Mechanism 650]

Figure 30:
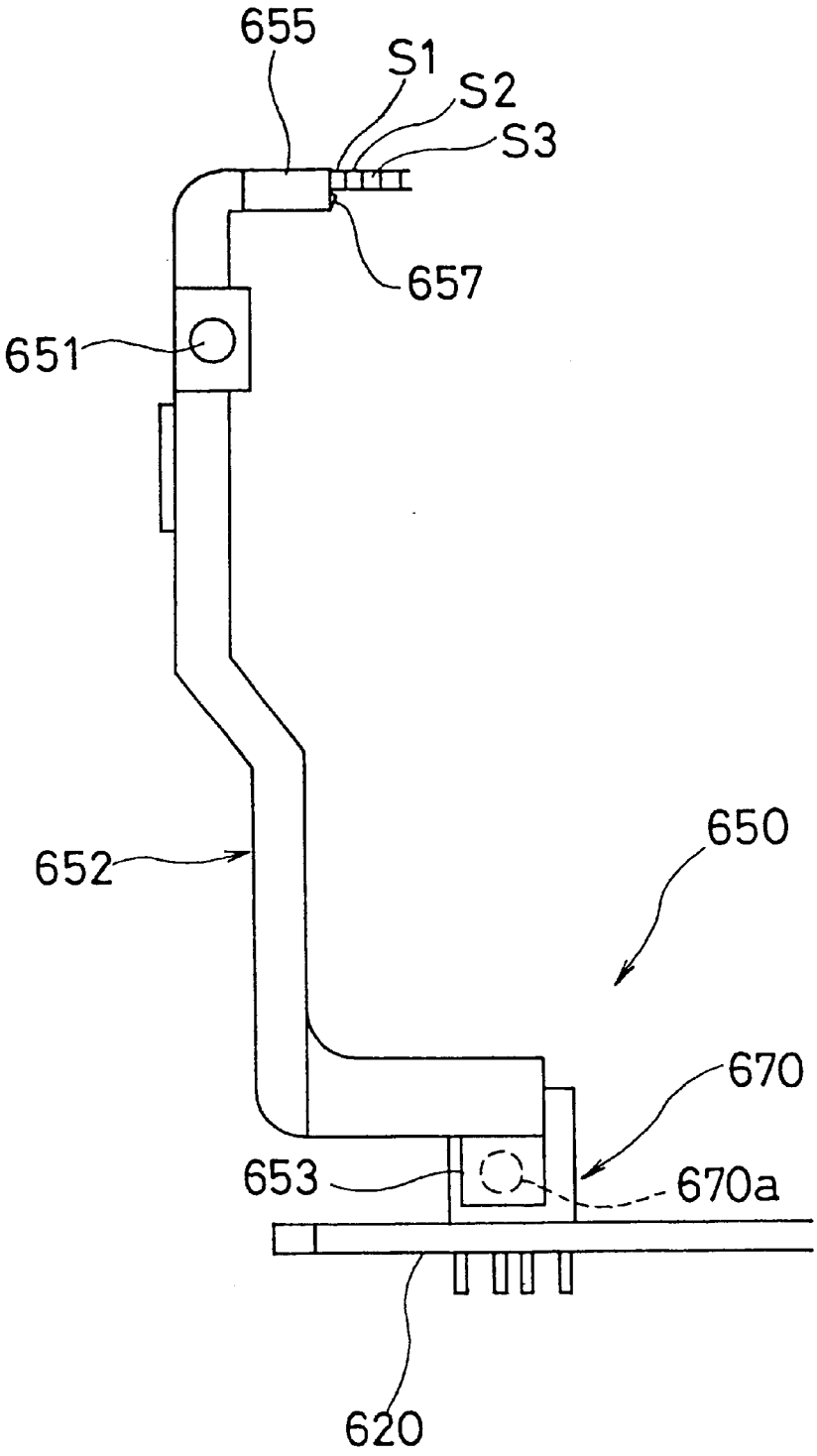
FIG. 30 is an explanatory view showing the configuration of the staple sensor mechanism.

As shown in FIG. 30, the staple sensor mechanism 650 comprises an actuator 652 having a shaft 651, an a photo-sensor (actuator sensor means) 670 for sensing a light shielding plate 653 provided on the lower portion of the actuator 652. The shaft 651 of the actuator 652 is rotatably pivoted by a pair of bearing portions 44A, 44A formed on the front wall 44 of the magazine 14. Thus, the actuator 652 is pivotal about the shaft 651 and is energized in the clockwise direction (in FIG. 30) by means of a spring (not shown).

Figure 31:
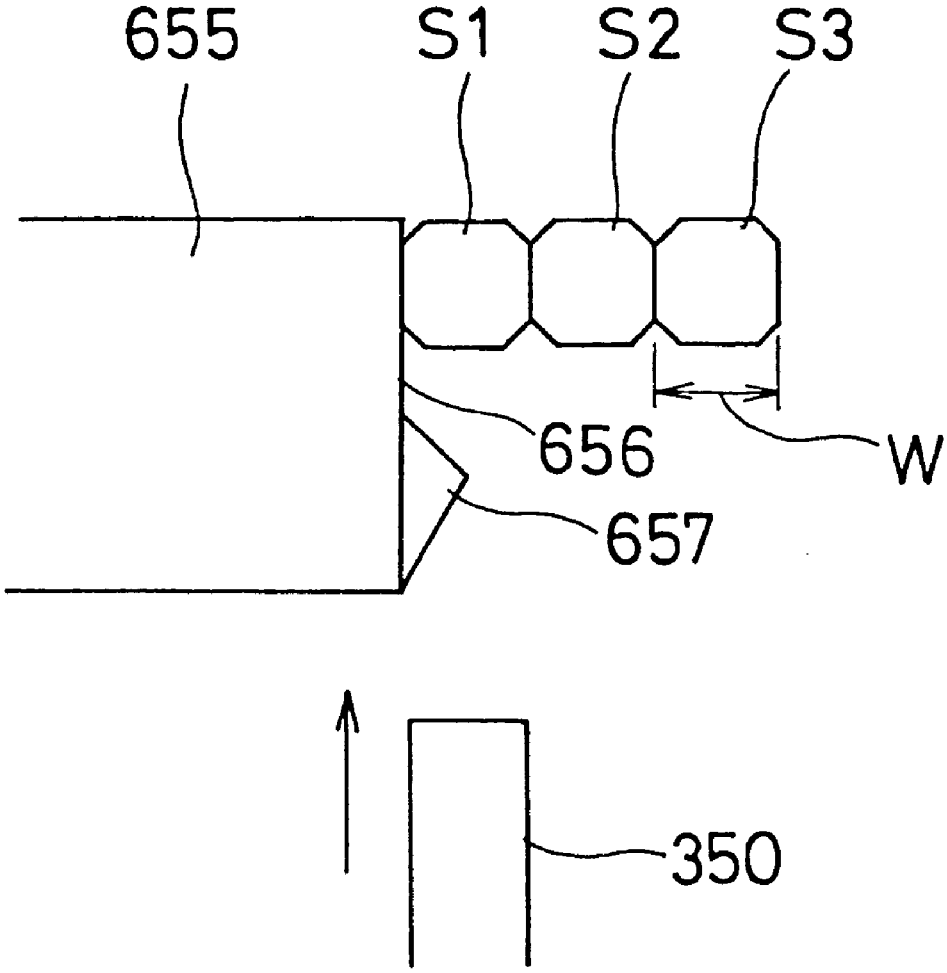
FIG. 31 is an explanatory view showing the relation between the contact portion of an actuator of the staple sensor mechanism and staples, etc.

On the upper end portion of the actuator 652, provided is a contact portion 655 for contacting with the staples S. As shown in FIG. 31, there is formed a flat contact surface 656 on the contact portion 655, where the upper portion of the contact surface 656 is adapted to contact with the staples S. There is formed a projected portion 657 on the lower portion of the contact surface 656.

The photo-sensor 670 comprises a light-emitting diode 670*a* and a light-receiving diode 670*b* for receiving light emitted from the light-emitting diode 670*a* (refer to FIG. 25). The light shielding plate 653 intercepts the light emitted from the light-emitting diode 670*a*, thereby allowing the photo-sensor 670 to sense the light shielding plate 653.

When a staple S1 is located in a space 765 of the staple drive portion 50 of the cartridge 700 to be described later, the actuator 652 is located at the position shown in FIG. 30 with the contact surface 656 being in contact with the staple S1. At this time, the light shielding plate 653 of the actuator 652 intercepts the light emitted from the light-emitting diode 670*a* and thus the light-receiving diode 670*b* receives no light. This causes a control unit (not shown) to judge that the staple S1 is located in the space 765.

Figure 32:
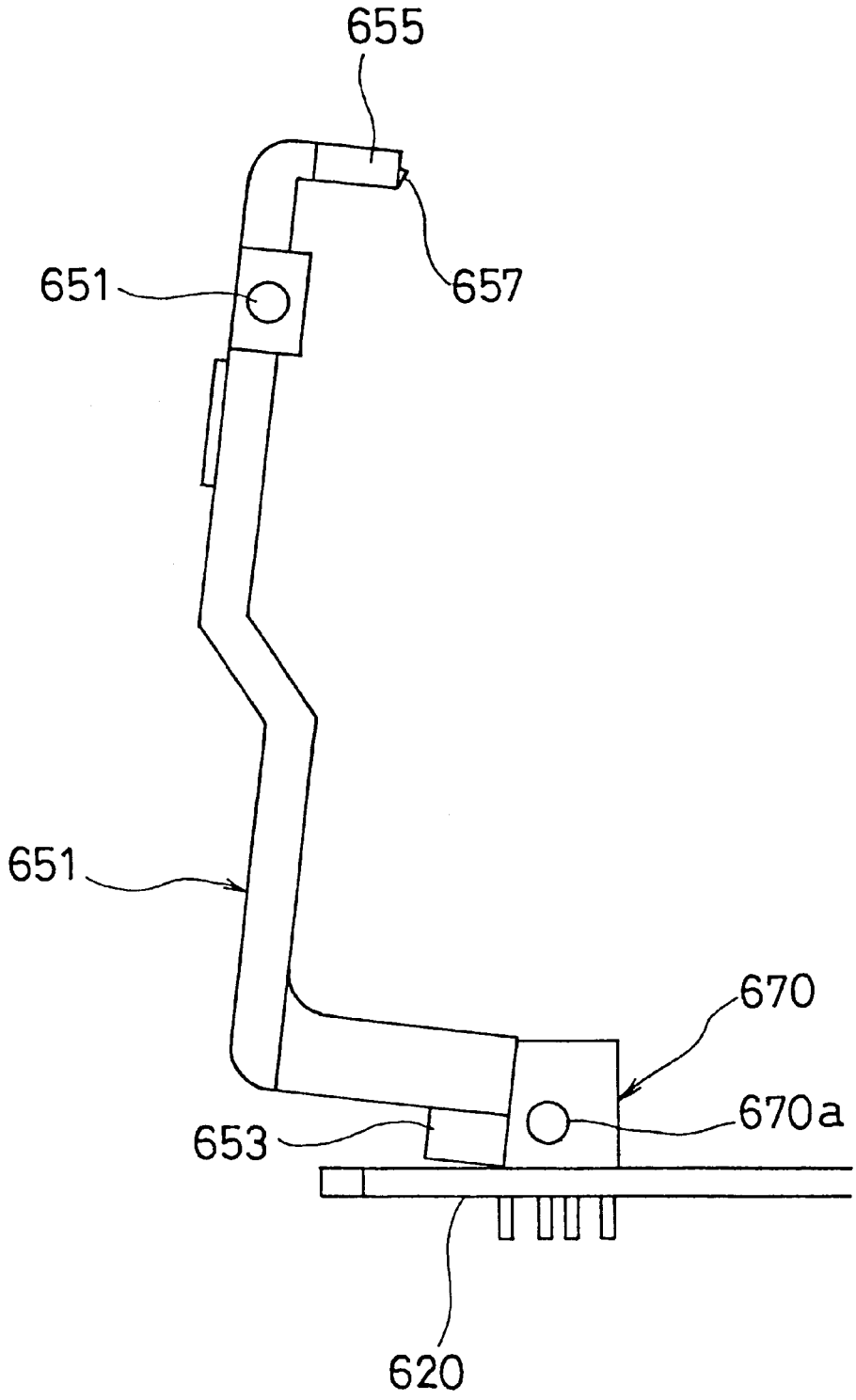
FIG. 32 is an explanatory view showing the actuator of the staple sensor mechanism, which has been rotated.

As shown in FIG. 32, when the staple S1 is not located in the space 765, the actuator 652 rotates about the shaft 651 of the actuator 652 to cause the light shielding plate 653 of the actuator 652 to move away from between the light-emitting diode 670*a* and the light-receiving diode 670*b*, thus allowing the light-receiving diode 670*b* to receive the light emitted from the light-emitting diode 670*a*. The reception of the light causes the control unit (not shown) to judge that the staple S1 is not located in the space 765.

In addition, the projected portion 657 provided on the contact surface 656 of the actuator 652 allows the driver 350 to contact with the projected portion 657 and not to contact the contact surface 656 when the driver 350 moves upward to drive the staple SI. That is, the actuator 652 rotates in the counter-clockwise direction (in FIG. 30) about the shaft 651 when the driver 350 contacts with the projected portion 657, thereby preventing the driver 350 from contacting with the contact surface 656. This prevents the driver 350 from wearing the contact surface 656 and thus prevents the occurrence of malfunction that the staple S1 present in the space 765 is not sensed. In addition, the prevention of the contact surface 656 from being worn improves the durability of the actuator 652.

[Cartridge 700]

As shown in FIGS. 33 to 39, the cartridge 700 comprises an outer case 701, an inner case 800 provided movably up and down inside the outer case 701, and a holder 790 provided movably up and down inside the inner case 800.

[Outer case 701]

Figure 36:
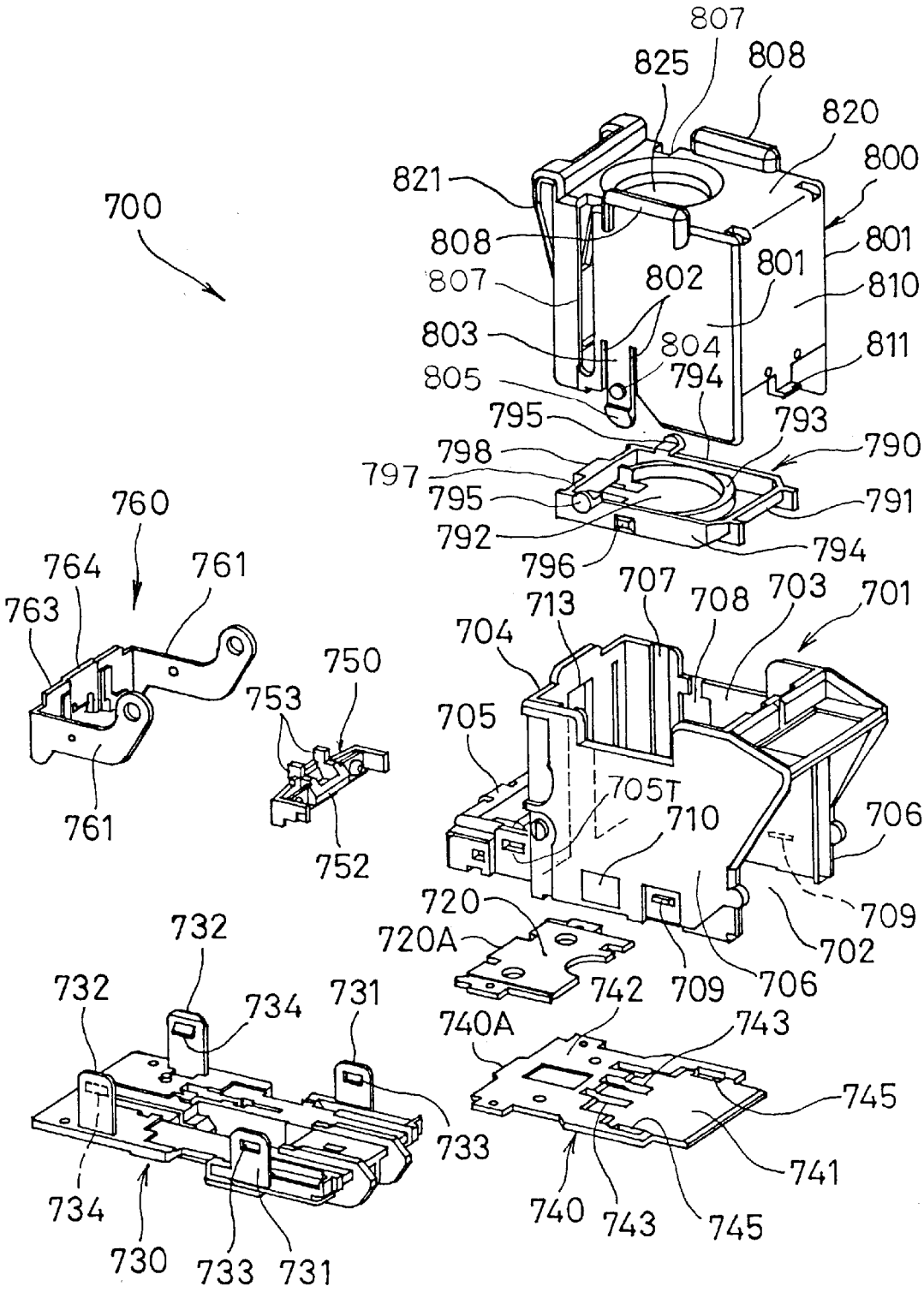
FIG. 36 is an exploded perspective view showing the configuration of the cartridge.
Figure 37:
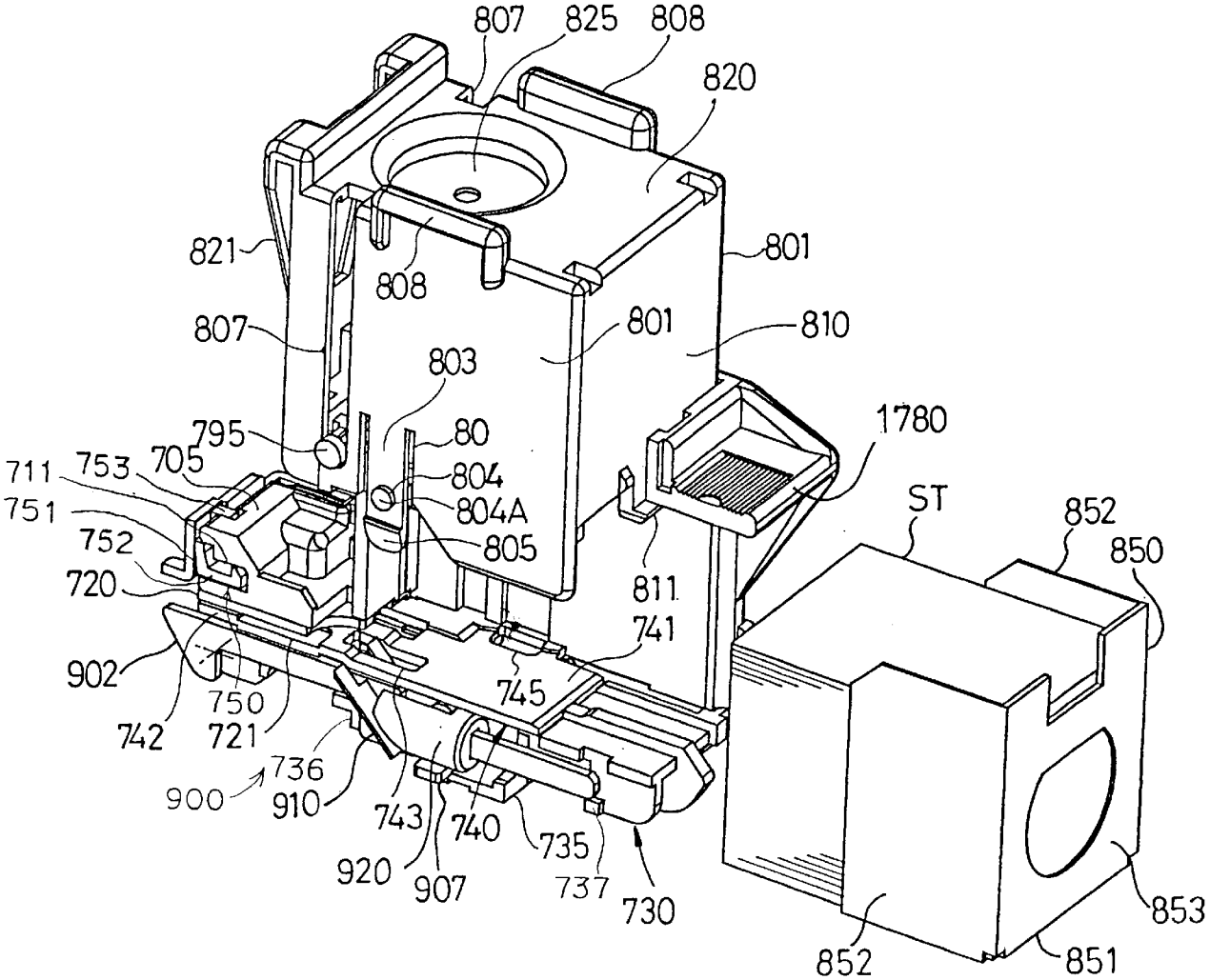
FIG. 37 is a partially sectional perspective view showing the configuration of the cartridge.

As shown in FIG. 36, the outer case 701 has openings 702, 703 formed at the back (on the right) and the upper portion thereof, and a holder portion 705 provided to be extended forwardly on the lower portion of a front wall portion 704. In addition, the outer case 701 has an opening on the lower portion thereof and a pair of spaced-apart side walls 706. On the inner sides of the side walls 706, formed are guide recessed portions 707, 708 that extend vertically. On the lower portions of the outer sides of the side walls 706, formed are projections 709 and recessed portions 710 at the positions corresponding to those of the guide recessed portions 708. Moreover, on the front wall portion 704, there is formed a window 713 that extends upwardly from the lower end of the front wall portion 704.

There is provided a guide plate 720 on the lower surface of the holder portion 705. The holder portion 705 is also provided with a pusher member 750 that is movable back and forth. There is provided a guide holder 730 on the lower portion of the side walls 706, 706. In addition, there is provided a hole 711 on the front surface of the holder portion 705.

The guide holder 730 is provided with a guide plate 740 and the feed mechanism 900. At the back and front of the guide holder 730, provided are pairs of support plate portions 731, 732 that extend upwardly. Engagement holes 733 are formed in the support plate portions 731, while engagement projections 734 are provided on the inner sides of the support plate portions 732. The engagement holes 733, 733 of the support plate portions 731, 731 are engaged with the projections 709, 709 of the side walls 706, 706 of the outer case 701. On the other hand, the engagement projections 734, 734 of the support plate portions 732, 732 are engaged with recessed portions 705T that are provided on the both sides of the holder portion 705. This configuration allows the guide holder 730 to be attached to the outer case 701. In addition, the guide holder 730 is provided with an accommodating portion 735 for accommodating the feed mechanism 900 and engagement portions 736, 737 at the back and front of the accommodating portion 735.

The guide plate 740 is provided with a holder portion 741 for receiving a bottom wall portion 851 of a case 850 in which sheet staples ST are stacked, which will be described later. The guide plate 740 is also provided with a guide portion 742 that is a step higher than the surface of the holder portion 741. The height of the step between the holder portion 741 and the guide portion 742 is made equal to the thickness of the bottom wall portion 851 of the case 850. Moreover, the guide portion 742 and the guide plate 720 of the holder portion 705 form a transport path 721 for feeding the staple S forwardly. Projected portions 720A, 740A are formed on the top ends of guide plates 720, 740, respectively.

As such, the guide portion 742 of the guide plate 740 provided on the guide holder 730 of the outer case 701 and the guide plate 720 attached to the holder portion 705 of the outer case 701 form the transport path 721. Accordingly, this determines the dimensional accuracy of the gap (height) of the transport path 721 regardless of the configuration of the stapler body 10. This reduces the accumulated tolerance of dimensional accuracy and the performance of feeding the staple S can be thereby controlled only by the cartridge 700.

In addition, The guide plate 740 is provided with a pair of slits 743, 743 that extend back and forth from the front of the holder portion 741 to the back of the guide portion 742. A pair of holes 745 are formed on the both sides of the holder portion 741.

Figure 40:
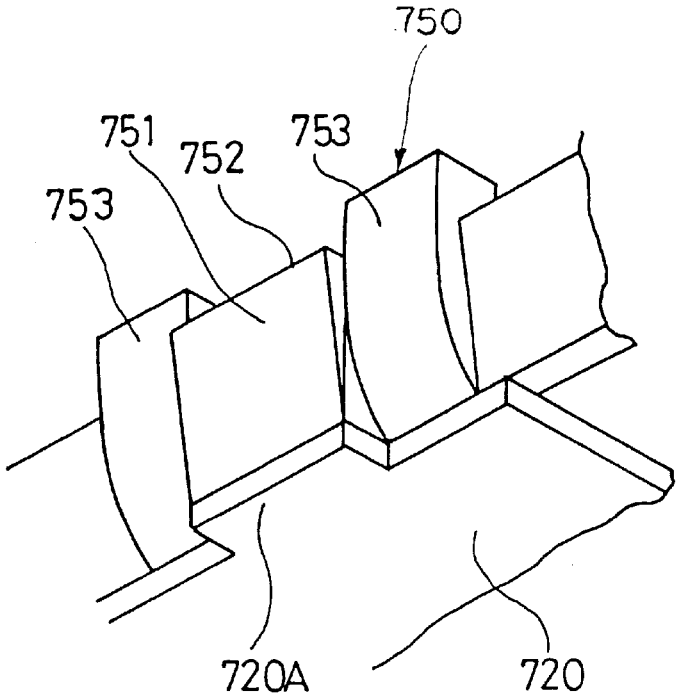
FIG. 40 is a perspective view showing the relation between a pusher and a driver.
Figure 40:
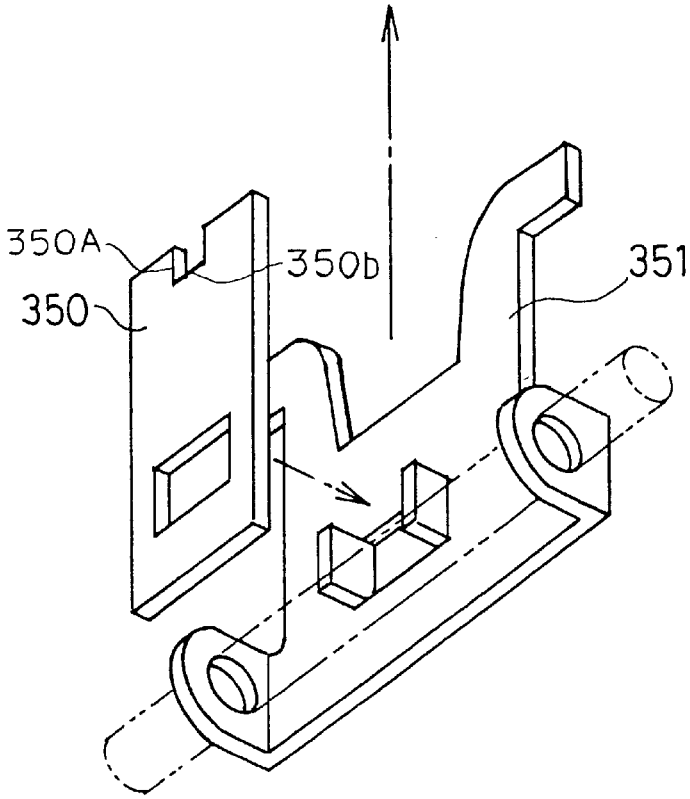

The pusher member 750 has an inclined surface 751 on the front surface thereof, a projected portion 752 that is projected rearward and inserted in a hole 711 of the holder portion 705, and contact surfaces 753 formed on the both sides of the projected portion 752 as shown in FIG. 40. The pusher member 750 is energized forwardly by means of a spring (not shown).

Figure 34:
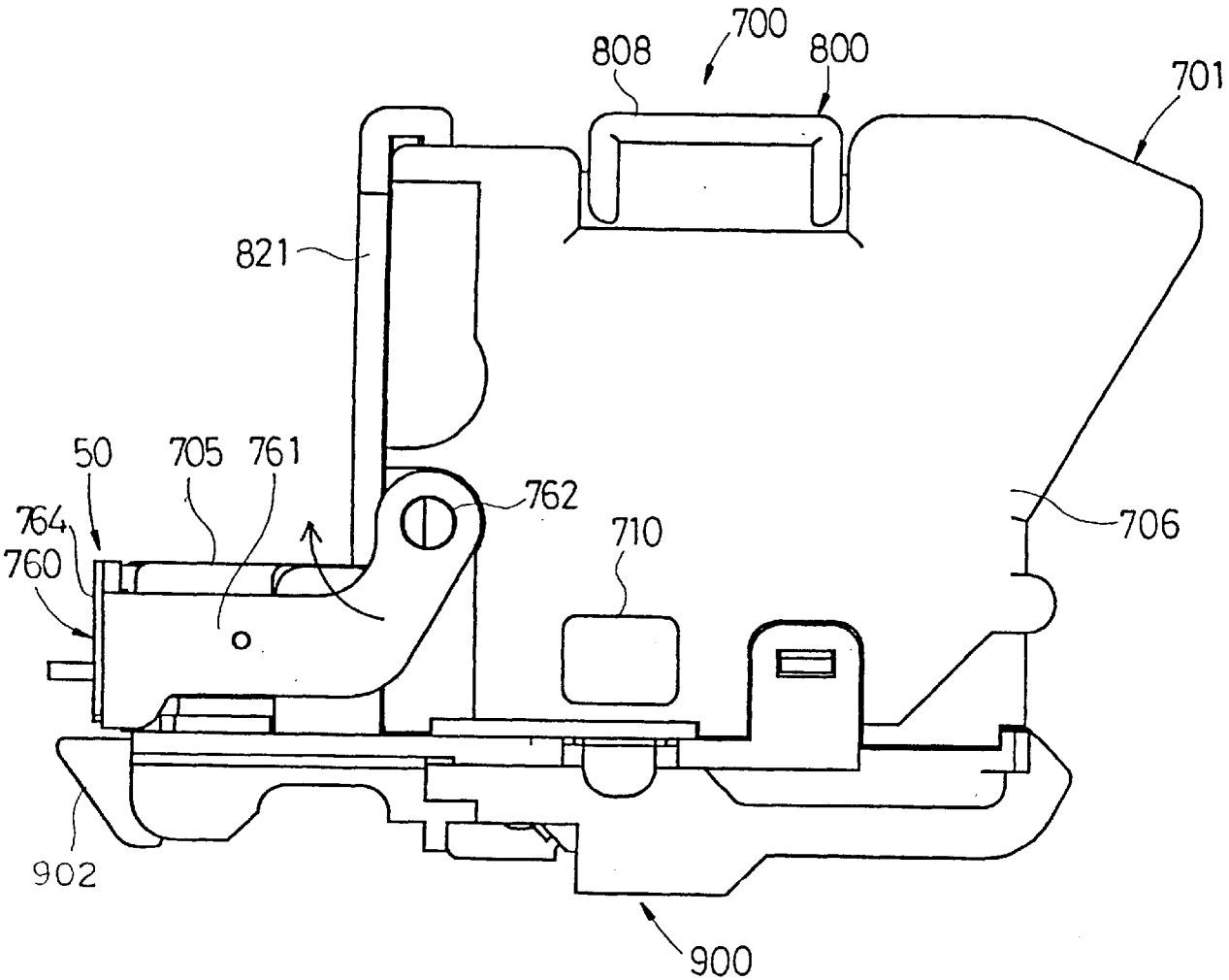
FIG. 34 is a side view showing the cartridge.
Figure 41:
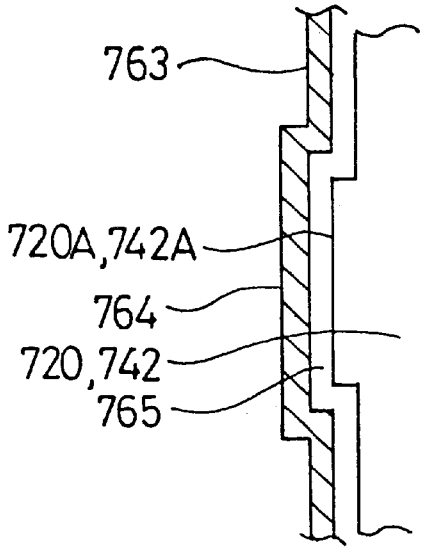
FIG. 41 is an explanatory view showing a face plate portion.

In addition, arm portions 761, 761 of a face plate member 760 are pivoted on the side walls 706, 706 of the outer case 701 and are pivotable about a shaft 762 in the direction of the arrow (refer to FIG. 34). The face plate member 760 comprises a flat face plate portion 763 on which formed is a face portion 764 that is projected forwardly as shown in FIG. 41. The space 765 into which the driver 350 goes is formed between the face portion 764 and each of projected portions 720A, 740A of the guide plates 720, 740. Then, the staple S is driven to sheets of paper (not shown) placed on the anvil 45 (refer to FIG. 1) of the magazine 14 from a space (a driving outlet) 51 between the upper portion of the face plate portion 763 and the upper portion of the holder portion 705. The face plate portion 763 and the holder portion 705 constitute the staple drive portion 50.

[Inner Case 800]

The inner case 800 is formed in the shape of a housing whose lower and front surfaces are opened, and is provided with notches 802 on the lower portion of side walls 801. The notches 802 form elastic leg portions 803 on which formed are projections 804 extending outwardly and engagement claws 805 projecting outwardly under the projections 804. The projections 804 are inserted in the guide recessed portions 708 of the side walls 706 of the outer case 701 and top end portions 804A of the projections 804 are in contact with contact surfaces 708A of the guide recessed portions 708 (refer to FIG. 39).

Figure 39:
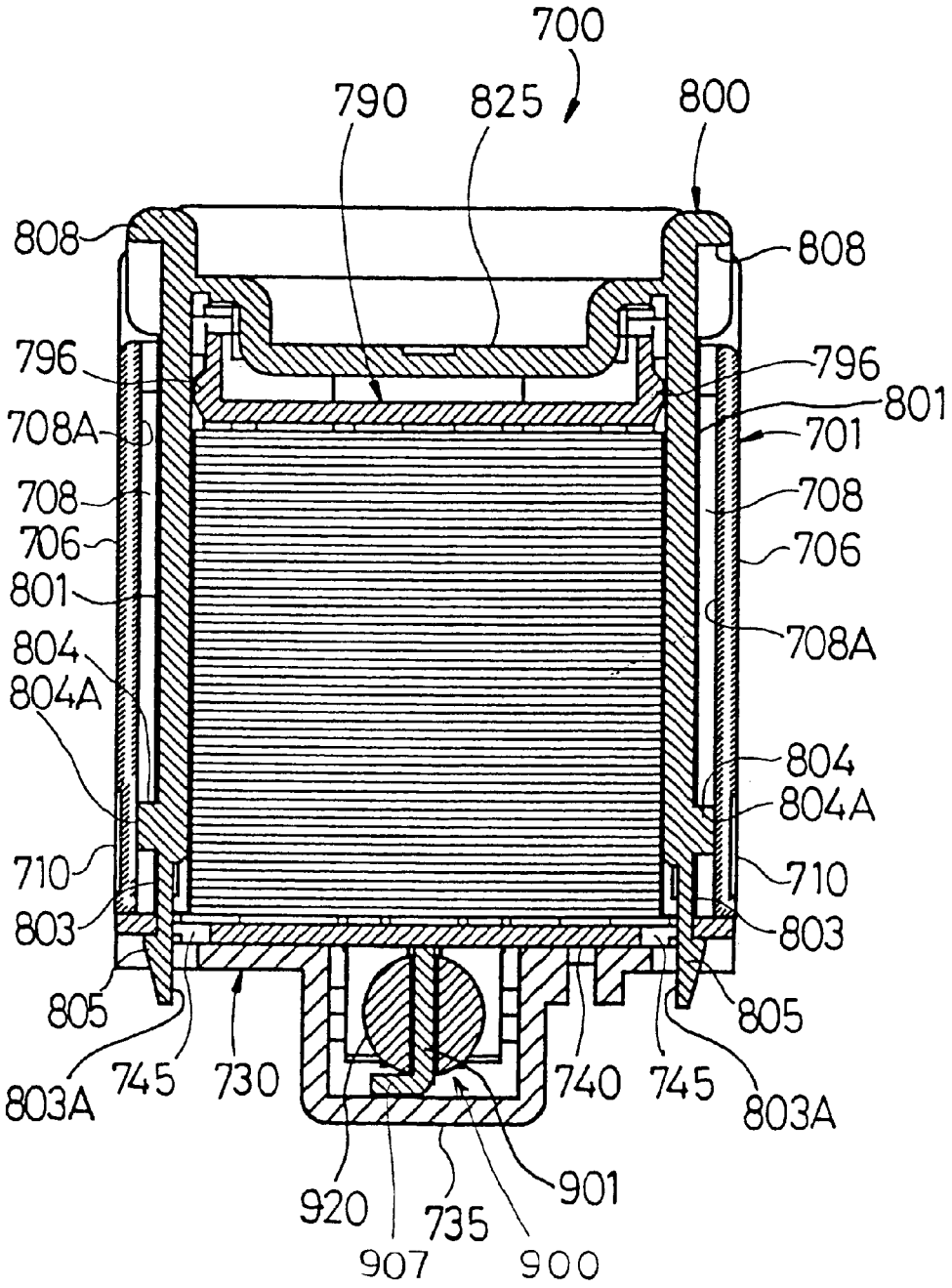
FIG. 39 is a cross sectional view showing the configuration of the cartridge.

In addition, as shown in FIG. 39, inner sides 803A of the elastic leg portions 803 under the projections 804 are spaced apart more than the inner sides of the side walls 801. Thus, the distance between the inner sides 803A, 803A is larger than that between the inner sides of the side walls 801.

The both side walls 801 of the inner case 800 are in contact with the insides of the side walls 706 of the outer case 701. Thus, the inner case 800 is adapted to slidably move up and down relative to the outer case 701. As shown in FIG. 39, when the inner case 800 is inserted completely into the outer case 701, the elastic leg portions 803 of the inner case 800 are to be inserted into the holes 745 of the guide plate 740 provided on the guide holder 730 and the engagement claws 805 of the elastic leg portions 803 are to engage the holes 745. Moreover, at this time, the projections 804 of the elastic leg portions 803 are to be located at the position of the recessed portions 710 of the side walls 706 of the outer case 701.

Furthermore, there are formed long holes 807 extending vertically on the front of the both side walls 801 and grip portions 808 projecting upwardly on the upper portion of the both side walls 801. There is formed an engagement projection 811 at the lower end of a rear wall 810 of the inner case 800. On the front end of a top plate 820, formed is a V-shaped support plate portion 821 that is spaced apart from the front end of the side walls 801 by a predetermined distance and extends downwardly. There is formed a projection 823 projecting rearward on the lower portion of the support plate portion 821. The projection 823 goes into the lower portion (refer to FIG. 35) of the window 713 of the front wall portion 704 of the outer case 701. Moreover, there is provided a spring mount portion 825 projecting downwardly on the top plate 820.

[Holder 790]

The holder 790 has a frame 791 formed in the shape of a rectangle (refer to FIG. 36) and a bottom plate 792 formed on the lower portion of the frame 791. There is formed a cylindrical wall portion 793 at the center of the bottom plate 792. In addition, on both side wall portions 794 of the frame 791, formed are projections 795 inserted in the long holes 807 of the side walls 801 of the inner case 800 (refer to FIG. 37) and projected portions 796 in contact with the side walls 801 of the inner case 800 (refer to FIG. 39). The holder 790 is so adapted that the projections 795 are guided by the long holes 807 of the side walls 801 and the projected portions 796 thereof slide up and down on the side walls 801 of the inner case 800.

In addition, on the front wall portion 797 of the frame 791, formed is an engagement projection 798 that is inserted in the window 713 of the front wall portion 704 of the outer case 701 from a front opening 800A of the inner case 800.

Figure 42:
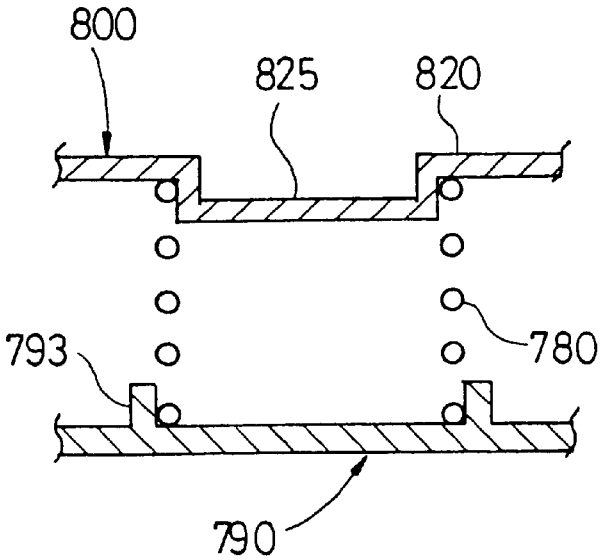
FIG. 42 is an explanatory view showing a holder that has been energized.

As shown in FIG. 42, the lower portion of a spring 780 is attached to the inside of the cylindrical wall portion 793 of the frame 791, while the upper portion of the spring 780 fits to the spring mount portion 825 of the top plate 820 of the inner case 800. The biasing force of the spring 780 causes the holder 790 to be downwardly energized to press the sheet staples ST accommodated in the inner case 800 downwardly (refer to FIG. 39).

The stacked sheet staples ST are held with the case 850 made of paper. The case 850 has openings at the front and upper surfaces, the bottom wall portion 851, side wall portions 852, and a rear wall portion 853.

[Feed Mechanism 900]

As shown in FIGS. 43 to 46, the feed mechanism 900 comprises a ratchet plate 901 extending back and forth, a feed claw 910, a pressing member 920 for pressing the feed claw 910 forwardly, and a feed spring 930 (not shown in FIGS. 43 and 46) for biasing the pressing member 920 forwardly.

[Ratchet plate 901]

Figure 47:
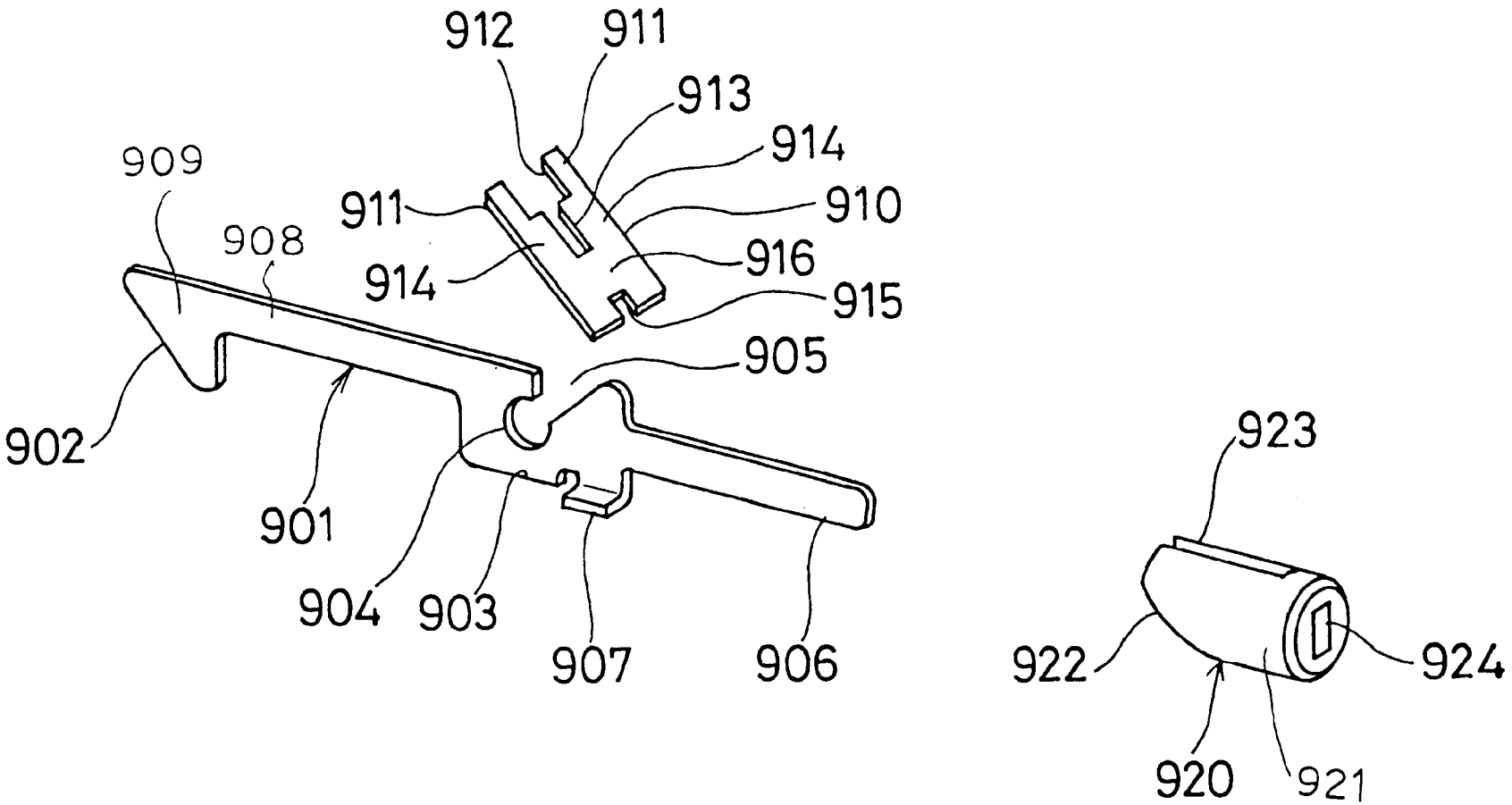
FIG. 47 is an exploded perspective view showing the configuration of the feed mechanism.
Figure 48:
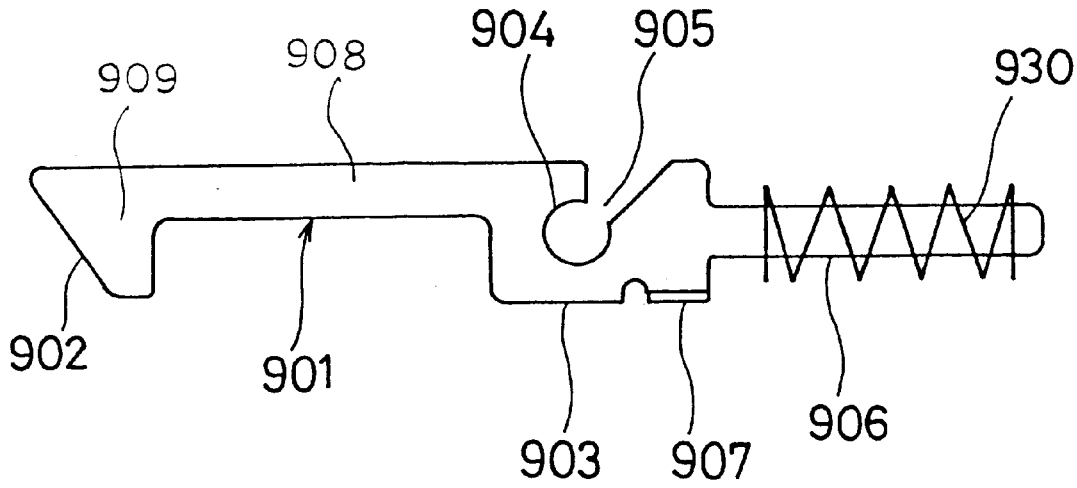
FIG. 48 is a side view showing a ratchet plate.

As shown in FIGS. 47 and 48, the ratchet plate 901 has an arm portion 908 extending back and forth. On a top end portion 909 of the arm portion 908, formed is an inclined surface 902 that is inclined forwardly and upwardly. On the rear portion of the arm portion 908, formed is a wide loader portion 903 that is provided with a circular hole 904. There is also provided a notch 905 that extends from the upper edge of the loader portion 903 to the hole 904. On the rear edge of the loader portion 903, formed is a narrow rod portion 906 that extends rearward. There is also formed a receiving portion 907 projecting sideward on the lower portion of the rear portion of the loader portion 903.

Figure 43:
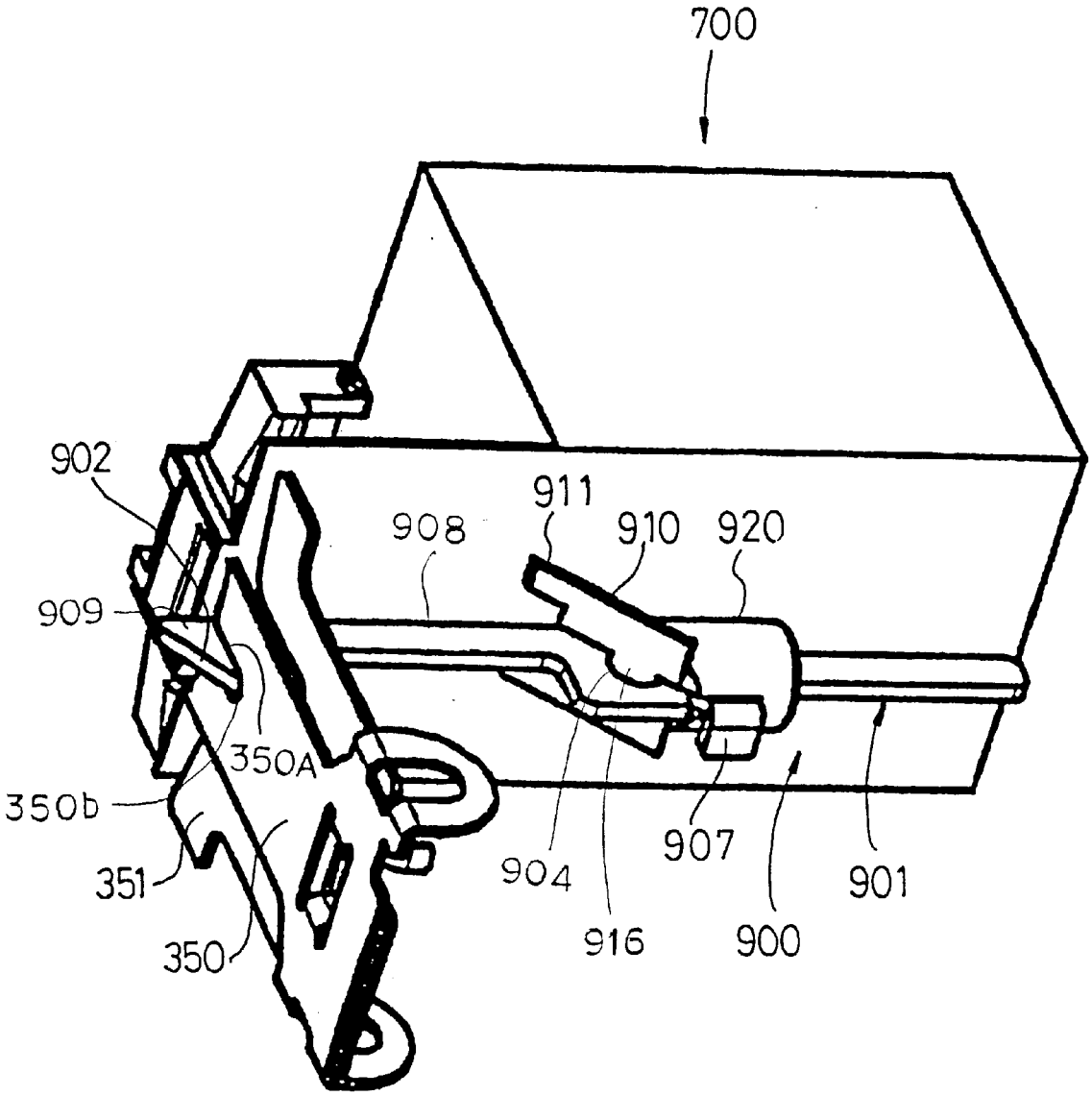
FIG. 43 is a perspective view showing a feed mechanism.
Figure 44:
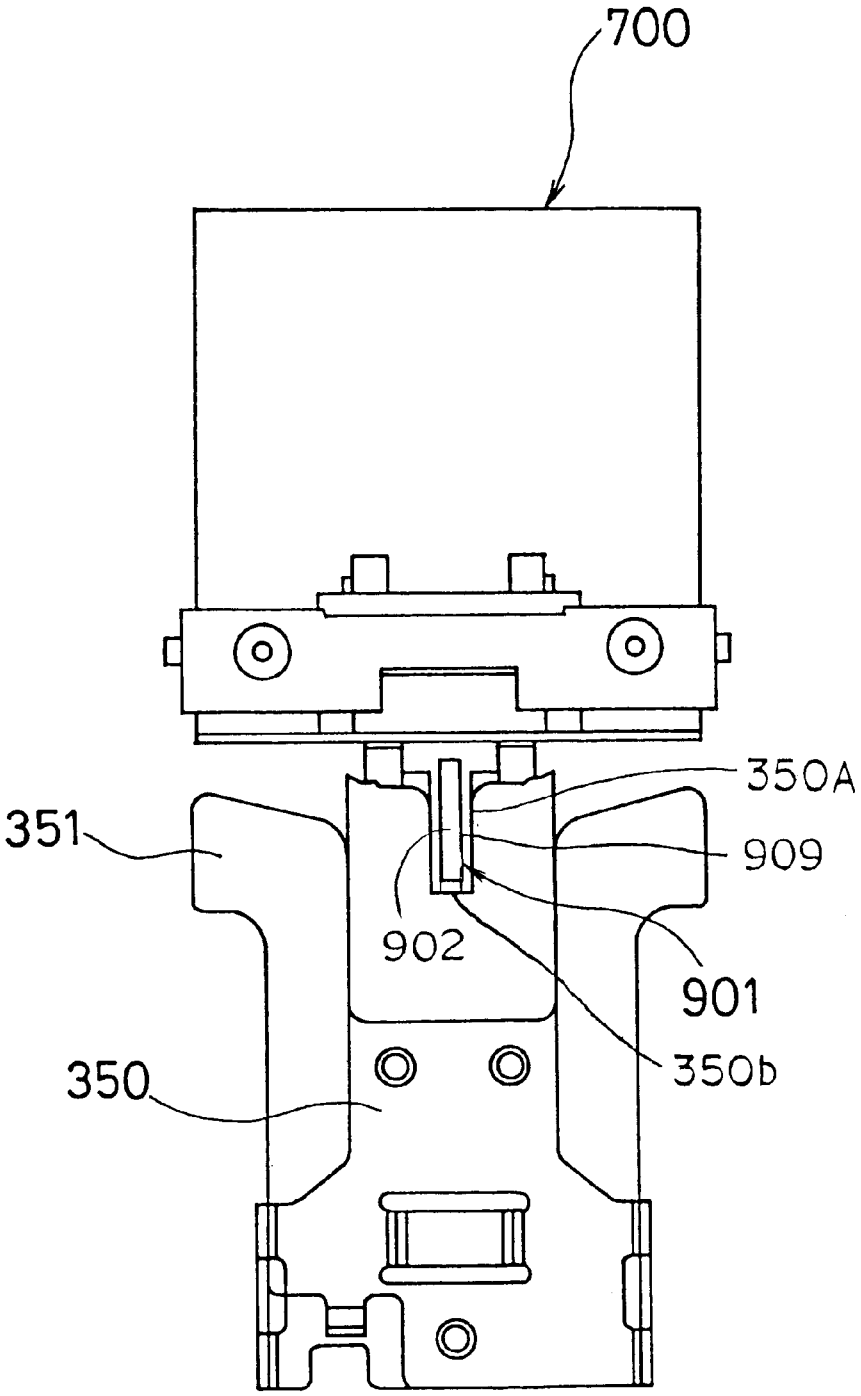
FIG. 44 is a front view of FIG. 43.

The top end portion 909 of the ratchet plate 901 goes into a notch 350A of the driver 350 (refer to FIG. 43).

[Feed claw 910]

Figures 49A, 49B:
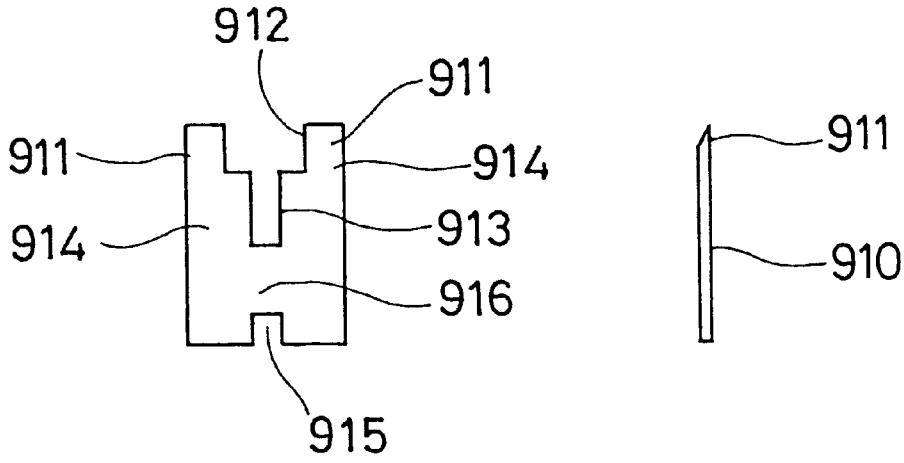
FIG. 49(A) is a front view showing a feed claw.
FIG. 49(B) is a side view of the feed claw.

As shown in FIG. 49, the feed claw 910 comprises a pair of claw portions 911 with sharp tips. There are formed a wide notch 912 in between the claw portions 911 and a narrow notch 913 at the middle of the notch 912. The both sides of the notch 913 serve as leg portions 914, 914. In addition, there is formed a notch 915 at the rear edge of the feed claw 910 and the portion between the notch 915 and the notch 913 serves as a connecting portion 916. The connecting portion 916 is inserted into the hole 904 of the ratchet plate 901 and the leg portions 914, 914 of the feed claw 910 sit astride from the hole 904 of the ratchet plate 901 to the upper edge of the loader portion 903, and thus the feed claw 910 is loaded to the loader portion 903 of the ratchet plate 901.

[Pressing Member 920]

Figure 50:
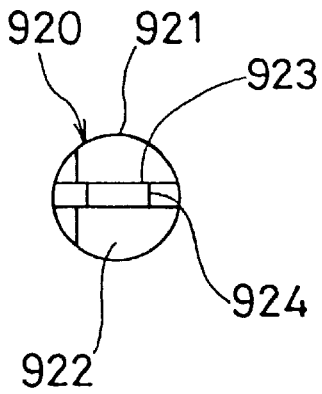
FIG. 50(A) is a front view showing a pressing member.
FIG. 50(B) is a bottom view of the pressing member.
FIG. 50(C) is a rear view of the pressing member.
FIG. 50(D) is a side view of the pressing member.
Figure 50:
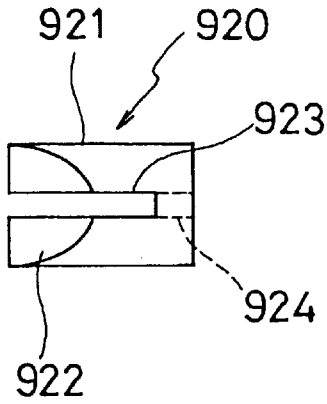
Figure 50:
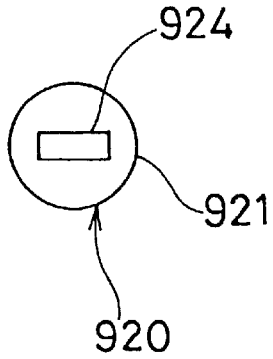
Figure 50:
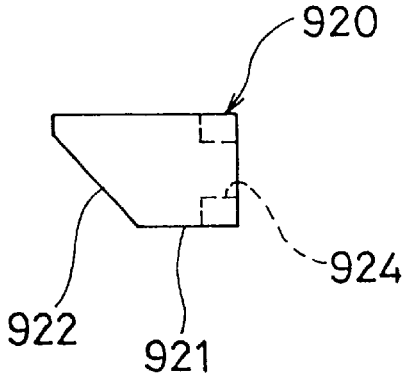

As shown in FIG. 50, the pressing member 920 has a cylindrical body 921. The front surface of the cylindrical body 921 is an inclined surface 922 ascending forwardly. The cylindrical body 921 is also provided with a notch 923 extending rearward from the inclined surface 922. Moreover, there is formed a hole 924 in communication with the notch 923, on the rear surface of the cylindrical body 921.

Figure 45:
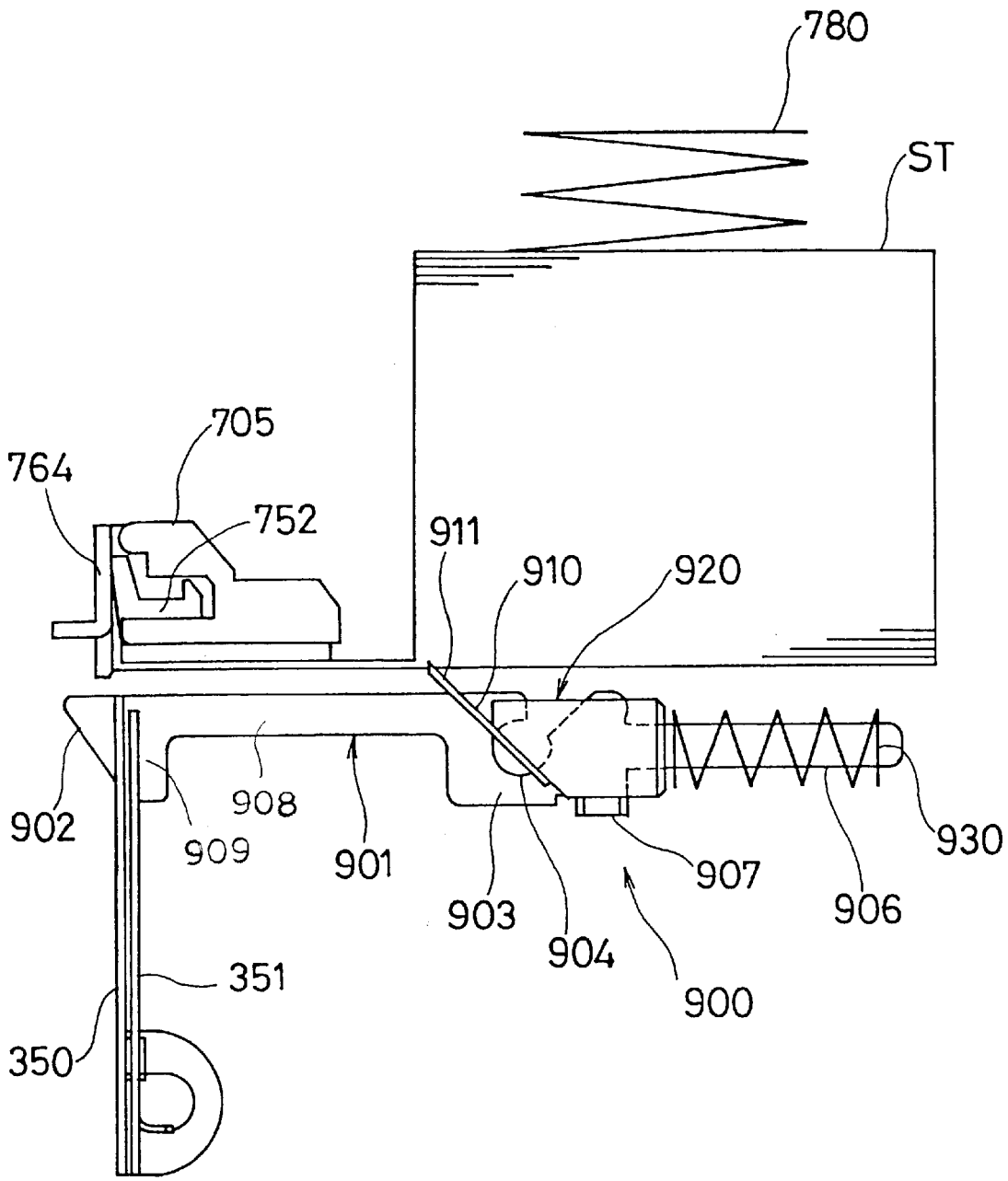
FIG. 45 is a side view showing the configuration of the feed mechanism.
Figure 46:
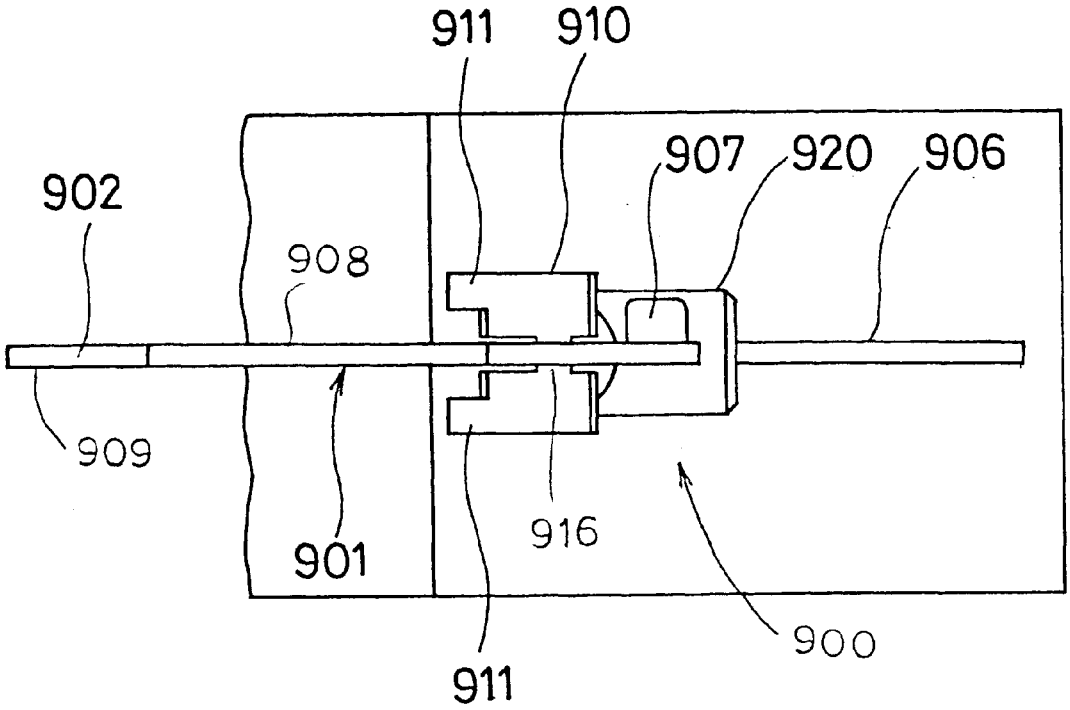
FIG. 46 is a bottom view showing the configuration of the feed mechanism.

As shown in FIG. 45, the rod portion 906 of the ratchet plate 901 penetrates the hole 924 of the pressing member 920 and the loader portion 903 of the ratchet plate 901 goes into the notch 923 of the pressing member 920, so that the feed claw 910 loaded to the ratchet plate 901 is brought into contact with the inclined surface 922 of the pressing member 920. In addition, the feed spring 930 is attached to the rod 906.

Figure 35:
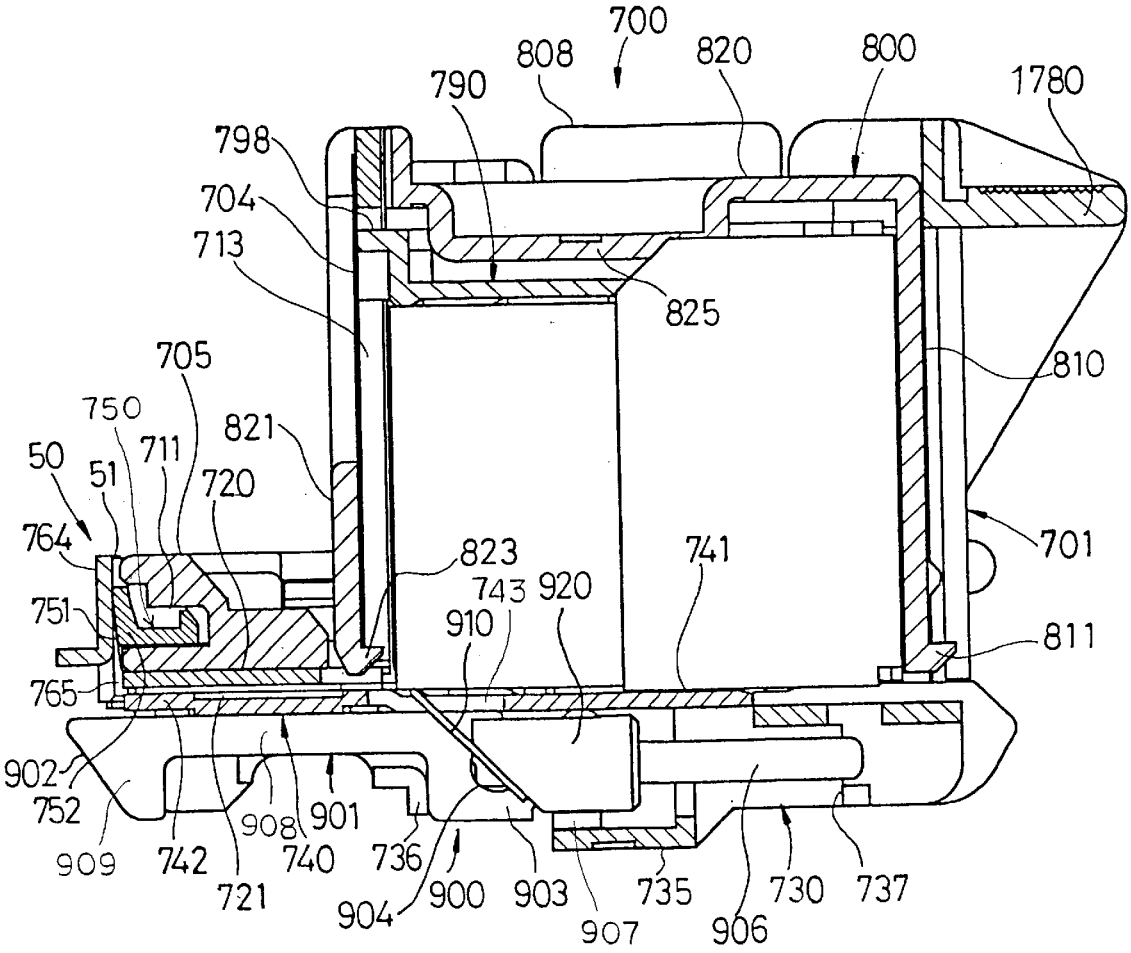
FIG. 35 is a sectional view of the cartridge of FIG. 34.

As shown in FIGS. 35 and 39, the pressing member 920 is accommodated in the accommodating portion 735 of the guide holder 730 and the receiving portion 907 of the ratchet plate 901 is in contact with a bottom surface 735A of the accommodating portion 735. The receiving portion 907 supports movably back and forth the ratchet plate 901 and the pressing member 920. Moreover, one end of the feed spring 930 engages an engaging portion 737 of the guide holder 703 and the other end of the feed spring 930 is in contact with the rear surface of the cylindrical body 921. The feed spring 930 energizes forwardly the ratchet plate 901 and the pressing member 920. The loader portion 903 of the ratchet plate 901 is in contact with an engaging portion 736 of the guide holder 730 to prevent the ratchet plate 901 and the pressing member 920 from moving forward from the position shown in FIG. 35.

The claw portions 911 of the feed claw 910 are inserted in the slits 743 of the guide plate 740 so as to protrude from the upper surface of the holder portion 741.

[Operation of Feed Mechanism 900]

Figure 51:
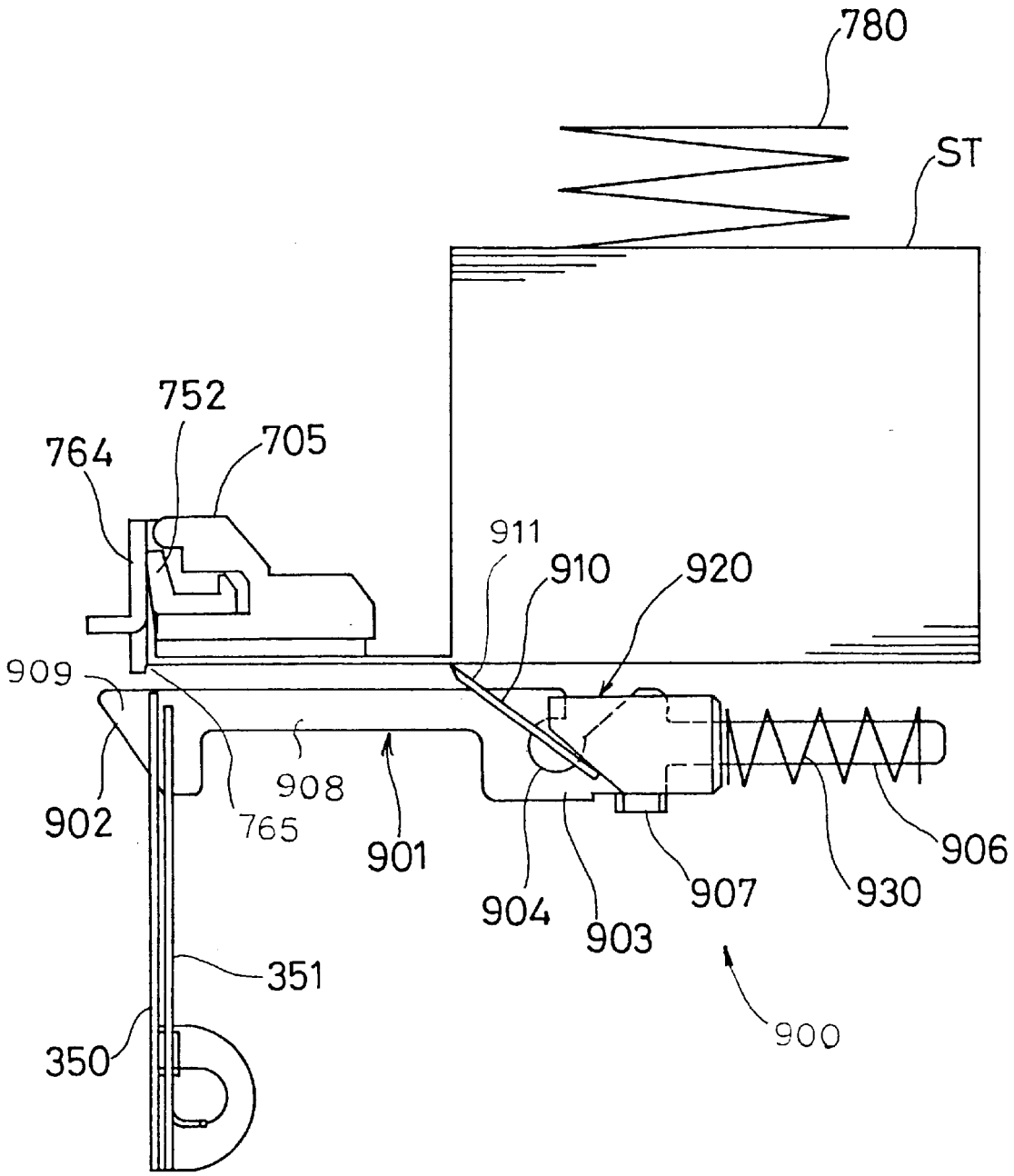
FIG. 51 is an explanatory view showing a feed claw in a submerged position.

As shown in FIG. 51, when the stacked sheet staples ST are placed on the holder portion 741 of the guide plate 740, the feed claw 910 falls down due to the weight thereof, causing the claw portions 911 of the feed claw 910 to retract from the slits 743 of the guide plate 740. The feed claw 910 rotates in the counter-clockwise direction (in FIG. 51) about the hole 904 of the ratchet plate 901 to cause the feed claw 910 to fall down (submerge). At the time of the rotation, the pressing member 920 is to move slightly rearward (to the right in FIG. 51) against the biasing force of the feed spring 930.

Figure 52:
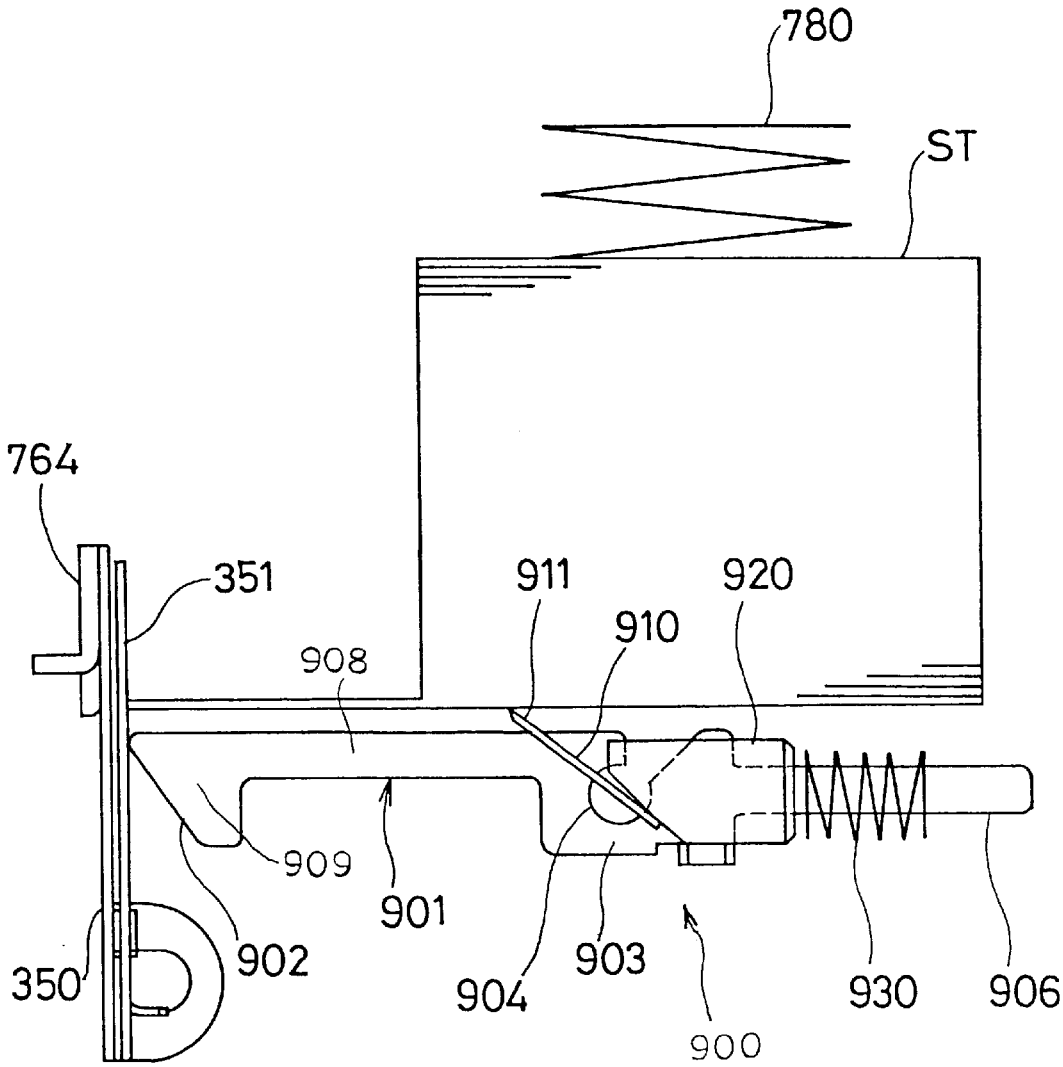
FIG. 52 is an explanatory view showing a ratchet plate and the feed claw and the like, which have been moved backward.

Then, as the driver 350 and the forming plate 351 go up, a bottom portion 350*b* of the notch 350A of the driver 350 is brought into contact with the inclined surface 902 of the ratchet plate 901. As the driver 350 and the forming plate 351 go up further, the inclined surface 902 causes the ratchet plate 901 and the pressing member 920 to move further rearward against the biasing force of the feed spring 930 in the state shown in FIG. 51. Then, when the ratchet plate 901 moves rearward up to a predetermined distance, the inclined surface 902 of the ratchet plate 901 is brought into contact with the forming plate 351 to cause the forming plate 351 to move rearward to the position shown in FIG. 52.

When the driver 350 and the forming plate 351 go down to the initial position after a staple S has been driven by the driver 350, the biasing force of the feed spring 930 causes the pressing member 920 to push the feed claw 910 forward. At this time, the inclined surface 922 of the pressing member 920 raises the feed claw 910 as shown in FIG. 45. Then, the forward movement of the ratchet plate 901 in conjunction with the pressing member 920 caused by the biasing force of the feed spring 930 allows the claw portions 911 of the raised feed claw 910 to protrude upwardly from the slits 743 of the guide plate 740, causing the top end portions of the claw portions 911 to go into between staples S and S of the sheet staples ST. Accordingly, as the ratchet plate 901 moves, the claw portions 911 feed the sheet staples ST forward.

As described above, when the biasing force of the feed spring 930 causes the pressing member 920 to keep pressing the feed claw 910, the inclined surface 922 of the pressing member 920 raises the feed claw 910 as shown in FIG. 45 and the biasing force of the feed spring 930 causes the sheet staples ST to be fed. One feed spring 930 feeds the sheet staples ST and raises the feed claw 910 as such, so that no spring is required to raise the feed claw 910, thus reducing the number of parts.

When no sheet staple ST is available in the transport path 721, the ratchet plate 901 moves up to the position shown in FIG. 45 and FIG. 51 so as to increase the amount of feed of the sheet staples ST. When the sheet staples ST are available in the transport path 721, the ratchet plate 901 moves forward by the width W (refer to FIG. 31) of one staple S from the position shown in FIG. 52.

Forward movement of the ratchet plate 901 by W causes the forming plate 351 to be raised and brought into contact with the inclined surface 902 of the ratchet plate 901, so that the ratchet plate 901 moves rearward.

[Operation of the Motor-Driven Stapler]

Now, the operation of the motor-driven stapler 1 configured as described above will be explained.

First, the cartridge 700 in which sheet staples ST stacked in the case 850 are accommodated is loaded in the stapler body 10 in advance. When the motor 40 is not activated, the table 100 is located in the initial position (home position) shown in FIG. 1.

Activation of the motor 40 by means of a sheet signal from a copier (not shown) causes the drive shaft 510 to rotate in the clockwise direction (in FIG. 7) via the gears 501–504, allowing the cams 511–515 to rotate in conjunction with the drive shaft 510.

As shown in FIG. 17, the rotation of the table link cams 512 causes the second table links 201 to move downward, thereby causing the first table link 210 to rotate in the counterclockwise direction about the axles 27 of the frame 12. The table 100 rotates in conjunction with the first table link 210 and moves downward. When the table 100 has moved down to the position (the bottom dead point) shown in FIG. 17, the anvil 45 and the table 100 sandwich sheets of paper (not shown) present in between the anvil 45 of the magazine 14 and the table 100.

When the sheets of paper are sandwiched, the table 100 collides with the anvil 45 of the magazine 14 while the table 100 is rotating about the axles 27 of the first table link 210. That is, one end of the table 100 is supported by the axles 27 to allow the other end to collide the anvil 45. Therefore, the table 100 collides with the anvil 45 with less impact, compared with a collision without being supported. The less impact can serve to stabilize the feed of the staple S and provide less noise at the time of collision.

In addition, the table 100 is adapted to rotate about the axles 27 of the first table link 210, so that only the relation between the axles 27 and the axle holes 216 of the first table link 210 determines the guidance property (operation stability), providing a simple configuration for the relation between the axles 27 and the guide holes 216. Furthermore, stapes S can be fed in the stable state and the stabilized operation can provide improved reliability.

On the other hand, the driver cam 514 is rotated to allow the driver links 301 to lift the driver 350 and the forming plate 351 to press the sheets of paper. Thereafter, the driver 350 and the forming plate 351 go into the space 765 of the staple drive portion 50 of the cartridge 700 through a hole (not shown) of the magazine 14. Then, the forming plate 351 forms the staple S3 (refer to FIG. 31) into the shape of a Japanese letter "コ". Then, the driver 350 launches the staple S1 formed in the shape of the Japanese letter "コ" from the launching outlet 51 of the staple drive portion 50 to the sheets of paper.

Figure 55:
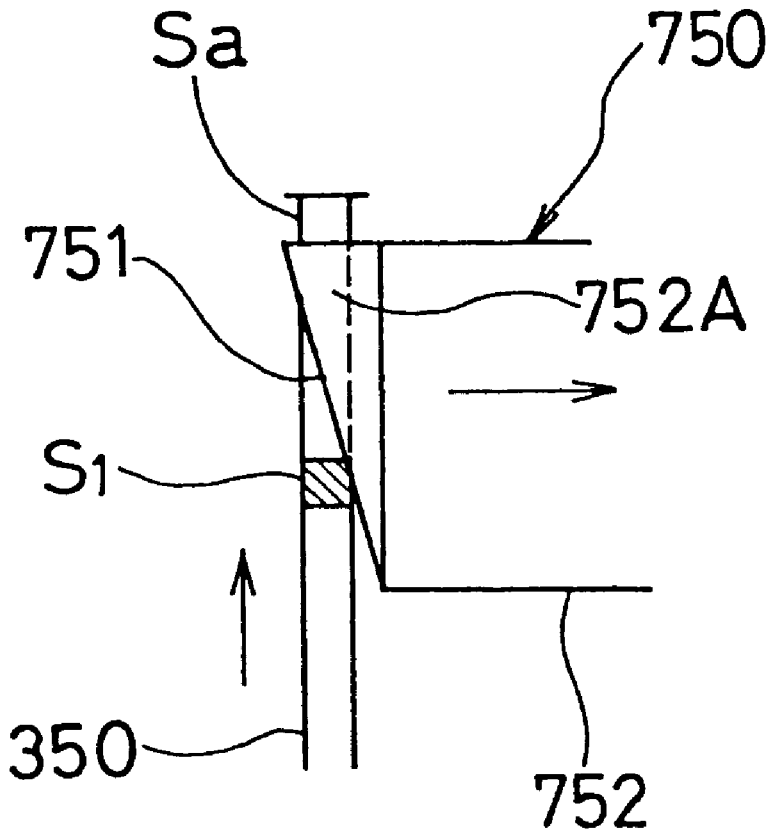
FIG. 55 is an explanatory view showing the operation of a pusher member.

At the time of launching the staple S1, the staple S1 is launched astride and along the inclined surface 751. Accordingly, as the driver 350 goes up, the pusher member 750 retracts against the biasing force of the spring. At this time, as shown in FIG. 55, the leg portions Sa of the staple S1 are kept in contact with a side 752A of the projected portion 752, so that the leg portions Sa are prevented from buckling.

AS the driver 350 comes down after having launched the staple S1, the pusher member 750 advances due to the biasing force of the spring. The advancement causes the contact surfaces 753 of the pusher member 750 to push forward the leg portions Sb of the staple S3 formed in the shape of the Japanese letter "コ". Consequently, the staple S is fed forward.

When the driver 350 launches the staple, force F is applied to the table 100 from the direction of the arrow shown in FIG. 17. The force F forces the first table link 210 to rotate about the axles 27 in the clockwise direction. However, the second table links 201 cannot move upward since the rollers 203 of the second table links 201 are pressed by means of the table link cams 512. Consequently, this causes the second table links 201 to rotate about the rollers 203 in the counter-clockwise direction to allow the first table link 210 to rotate in the clockwise direction. However, the biasing force of the paper thickness adjusting springs 220 prevents the second table links 201 from rotating in the counter-clockwise direction.

That is, application of force F caused by the launching of the staple by means of the driver 350 to the table 100 would not cause the table 100 to move due to the biasing force of the springs 220.

Figure 53:
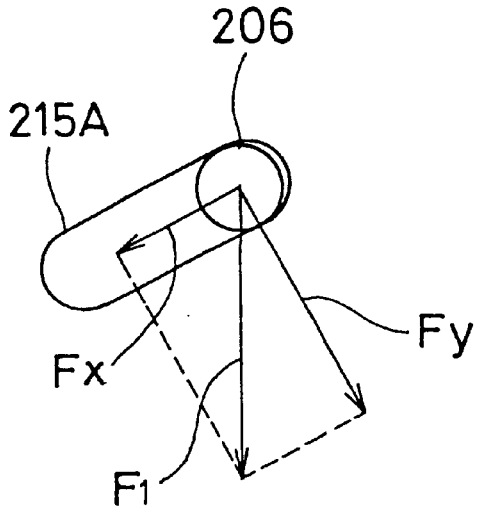
FIG. 53 is an explanatory view showing components of a force acting on an axle.
Figure 54:
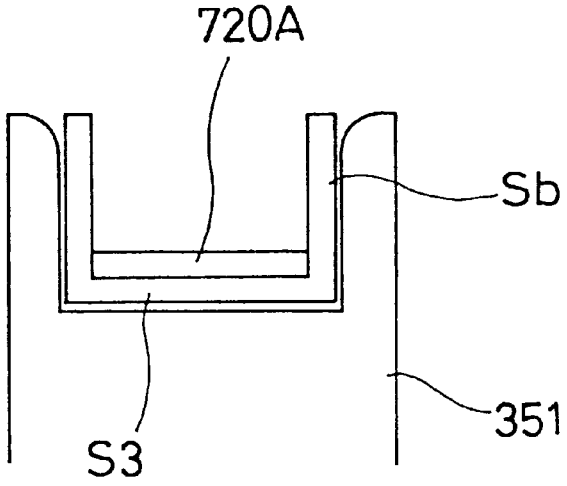
FIG. 54 is an explanatory view showing a staple formed in the shape of a Japanese letter "コ"

As shown in FIG. 53, suppose that the axles 206 require force F1 to support the table 100 when the force F is applied to the table 100. Then, a component Fx of F1 is supported by the paper thickness adjusting springs 220, while the component Fy of F1 is supported by the drive shaft 510, etc. That is, F1 is distributed to Fx and Fy to allow only Fx to be supported by means of the paper thickness adjusting springs 220, so that the biasing force of the paper thickness adjusting springs 220 can be made less.

Incidentally, the paper thickness adjusting springs 220 would serve as a compressive spring if the direction of the inclination of long holes 215A was reversed so that the second table links 201 would rotate in the clockwise direction when the force F was applied to the table 100.

Figure 56:
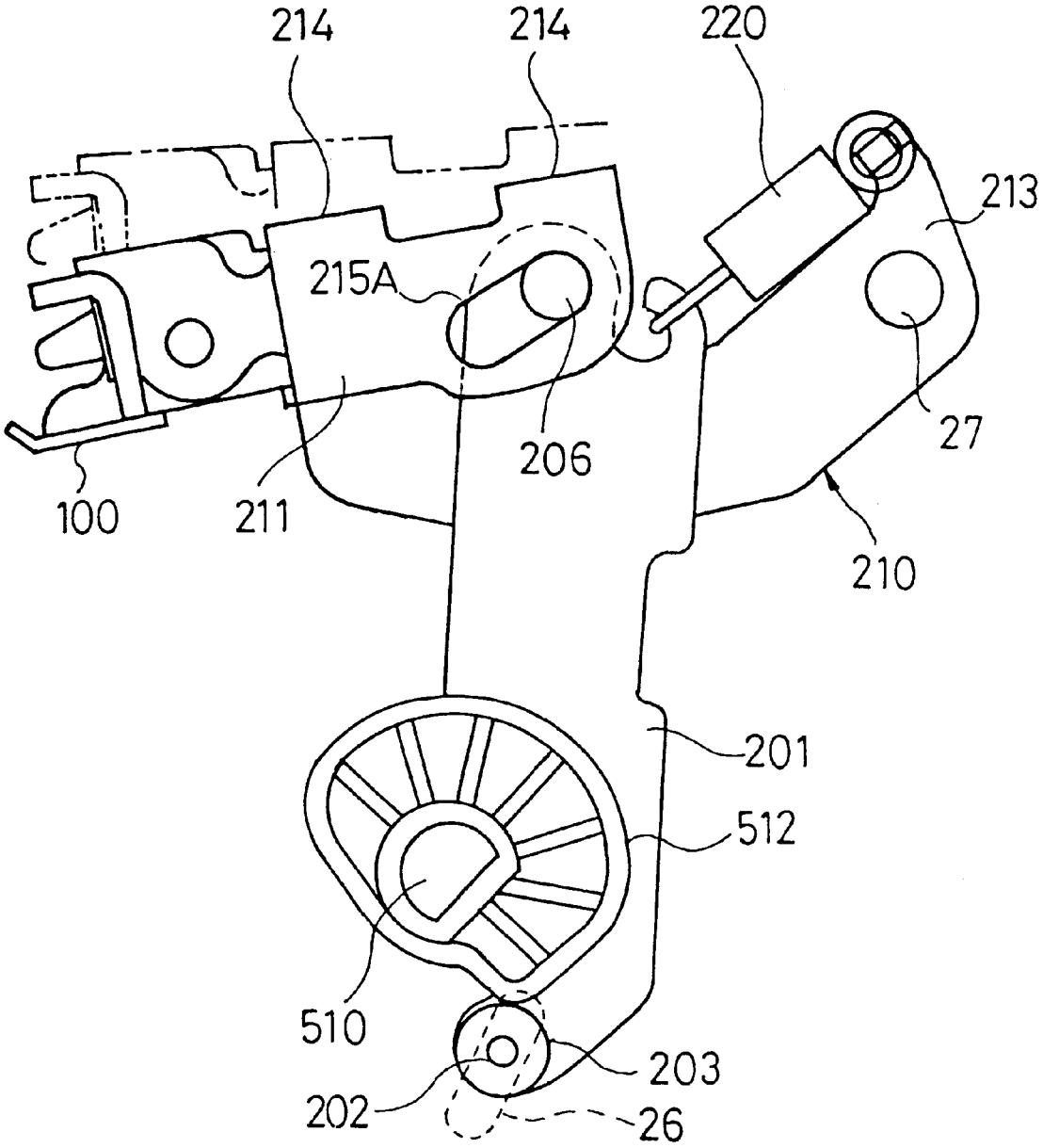
FIG. 56 is an explanatory view showing the relation between the downwardly positioned the table and table link cams, etc., when sheets of paper are thick.
Figure 57:
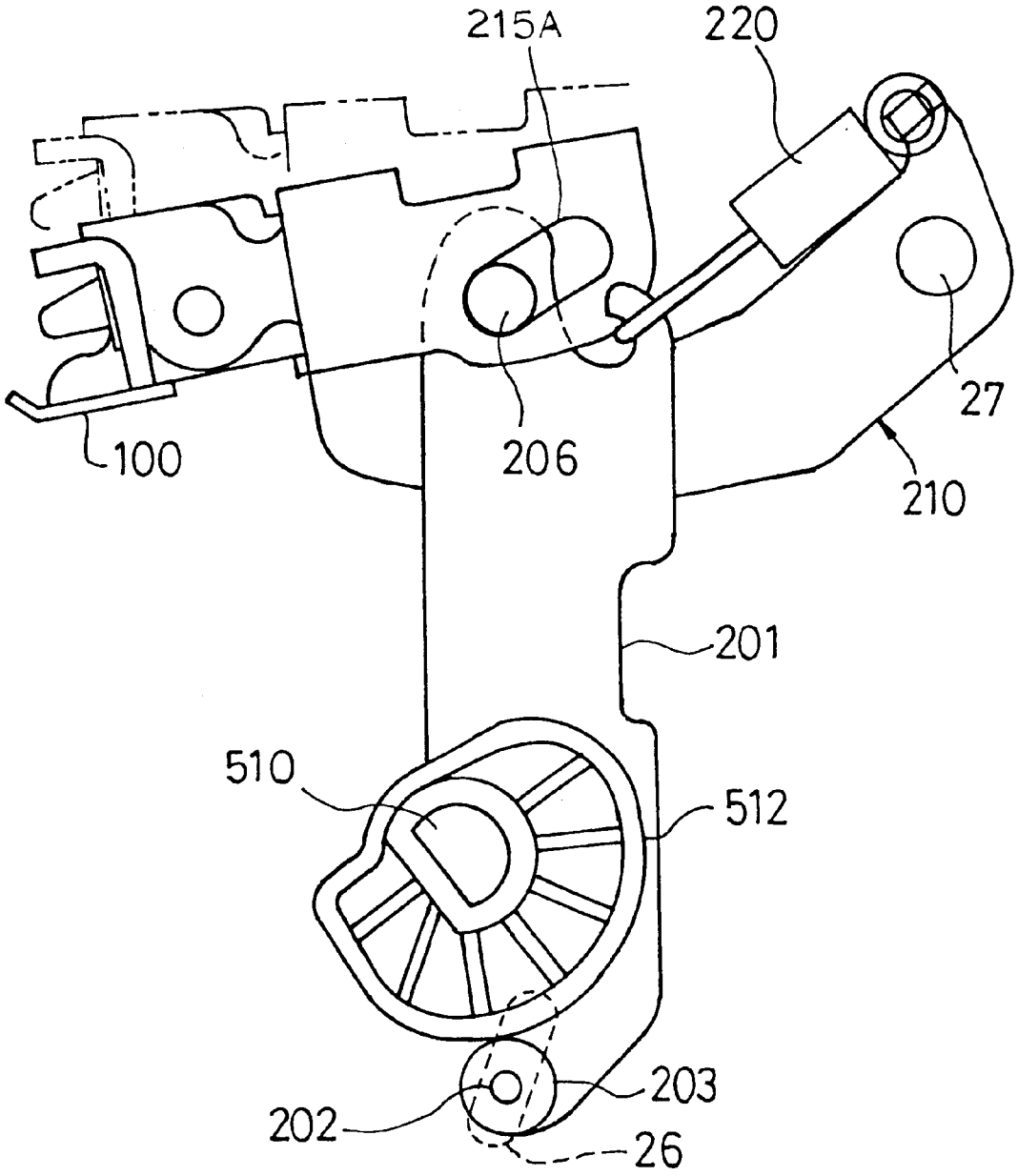
FIG. 57 is an explanatory view showing that the table link cams are not locked when the sheets of paper are thick.

When the sheets of paper are thick, the table 100 will not go down to the bottom dead point but stop, for example, at the position shown in FIG. 56. However, as shown in FIG. 57, rotation of the table link cams 512 will cause the second table links 201 to go down while the axles 206 of the second table links 201 are being guided by the long holes 215A, 215B of the first table link 210 and the axles 202 of the second table links 201 are being guided by the guide holes 26 of the frame 12. The moving downwardly of the second table links 201 will cause the table link cams 512 to keep rotating without being locked regardless of the thickness of the sheets of paper.

Moreover, the second table links 201 go down along the long holes 215A, 215B of the first table link 210 against the biasing force of the paper thickness adjusting springs 220. However, the paper thickness adjusting springs 220 require less 6 biasing force, so that even a small rotational force will not cause the table link cams 512 to be locked.

When the driver 350 and the forming plate 351 go up to get into the space 765 (refer to FIGS. 35 and 51) of the staple drive portion 50 of the cartridge 700 through the hole of the magazine 14, the ratchet plate 901 and the feed claw 910 and the like of the feed mechanism 900 move backward.

Figure 21:
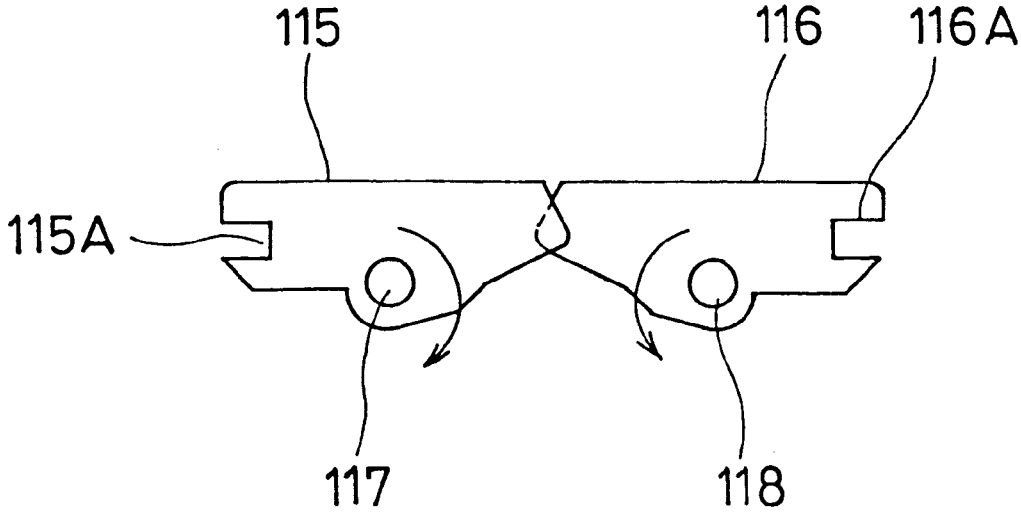
FIG. 21(A) is an explanatory view showing clinchers.
FIG. 21(B) is an explanatory view showing clinchers that have rotated.
Figure 21:
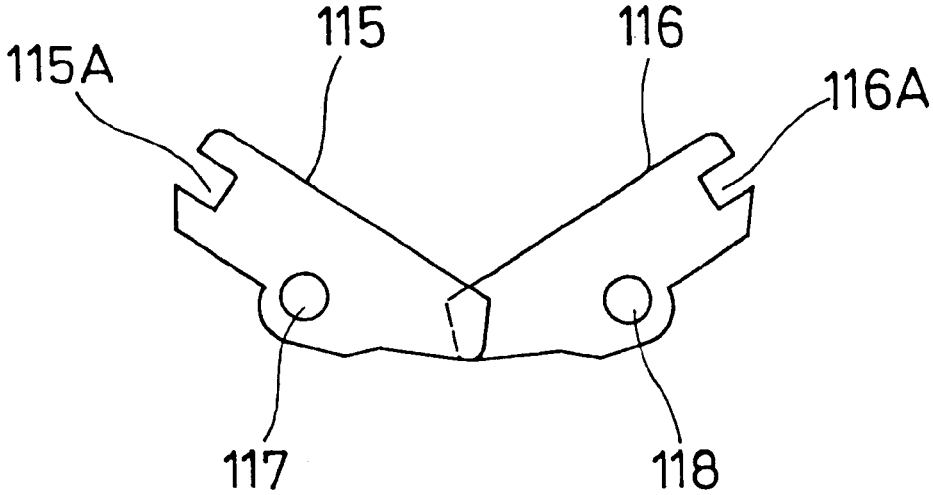

On the other hand, rotation of the clincher cams 511 causes the first clincher links 401 to rotate in the counter-clockwise direction (in FIG. 20) after the staple SI has been launched. This rotation causes the second clincher links 410 to rotate in the clockwise direction. As shown in FIG. 21, rotation of the second clincher links 410, 410 causes the clinchers 115, 116 to rotate about the projected axles 117, 118, respectively. This rotation allows the clinchers 115, 116 to clinch the tip end portions of the leg portions of the staple S1 that has penetrated the sheets of paper.

After the clinching has been completed, the forming plate 351 and the driver 350 go down and the first and second clincher links 401, 410 and the clinchers 115, 116 go back to their original positions.

When the forming plate 351 and the driver 350 go back to their original positions, the biasing force of the feed spring 930 causes the ratchet plate 901 and the feed claw 910 to move forward in conjunction with the pressing member 920 to feed forward the sheet staples ST by the width W of the staple S (refer to FIG. 31).

In addition, after clinching has been completed, rotation of the table return cams 513 causes the table return levers 250 to bring the table 100 back to its original stand-by position (home position).

When the table 100 has returned to the stand-by position, the position cam 515 has rotated once in conjunction with the drive shaft 510. At this time, as shown in FIG. 26, the projected portion 613 of the first arm portion 611 of the sensor arm 601 has gone into the recessed portion 604 of the position cam 515 and the projected portion 616 of the second arm portion 612 has sit on the projection 605 of the position cam 515. Under this condition, the light shielding plate 602 of the sensor arm 601 intercepts the light emitted from the light-emitting diode 610*a*. This interception will cause the light-receiving diode 610*b* of the position sensor 610 to output a position sensor signal. This position sensor signal allows the control circuit to determine that the table 100 has returned to the home position, and allows the stapler to stand by for the subsequent stapling operation.

Incidentally, the sensor arm 601 is provided with the projection 605 corresponding to the recessed portion 604 of the position cam 515, and the projected portion 613 of the first arm portion 611 and the projected portion 616 of the second arm portion 612 sandwich the position cam 515 all the time. This obviates the need for a spring to keep the projected portion 613 of the first arm portion 611 in contact with the circumferential surface of the position cam 515 all the time. Thus, spaces can be saved and the number of parts required can be reduced. Furthermore, since the projected portion 613 of the first arm portion 611 and the projected portion 616 of the second arm portion 612 sandwich the position cam 515, the projected portion 613 of the first arm portion 611 is always kept in contact with the circumferential surface of the position cam 515 even when the position cam 515 is rotated at high speeds. This prevents the projected portion 613 from being spaced apart from the circumferential surface and thus prevents the occurrence of chattering.

[Refilling Sheet Staples ST]

Now, refilling the cartridge 700 with the stacked sheet staples ST will be explained.

Figure 58:
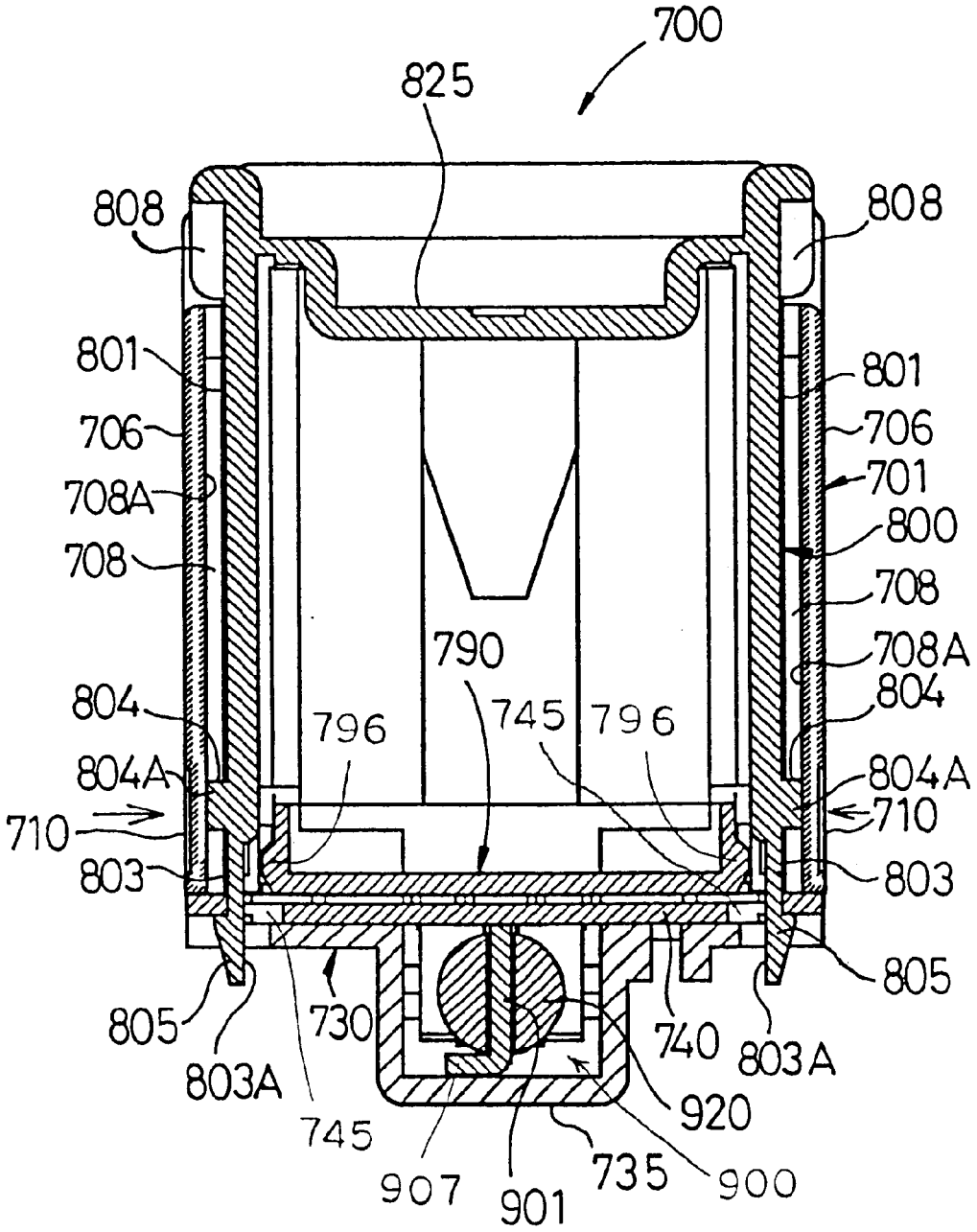
FIG. 58 is a cross sectional view showing the positional relation between an inner case and a holder when no sheet staples are left in the inner case.

First, the cartridge 700 is removed from the stapler body 10. As shown in FIG. 58, when no sheet staples ST are left in the inner case 800 of the cartridge 700, the holder 790 has moved to the bottom portion of the inner case 800 due to the biasing force of the spring 780. In this case, the projected portions 796 of the holder 790 are located at a lower position than the projections 804 of the inner case 800 and off the side walls 801 of the inner case 800.

Next, when the recessed portions 710 of the side walls 706 of the outer case 701 are pressed by a finger in the direction of the arrow, the elastic leg portions 803 of the inner case 800 are deformed elastically toward the inside thereof since the projections 804 of the inner case 800 are in contact with the side walls 706 of the outer case 701. This causes the engagement claws 805 of the elastic leg portions 803 are disengaged from the holes 745 of the guide plate 740. Then, the grip portions 808 of the inner case 800 are grasped to slidingly move the inner case 800 upward relative to the outer case 701.

Figure 38:
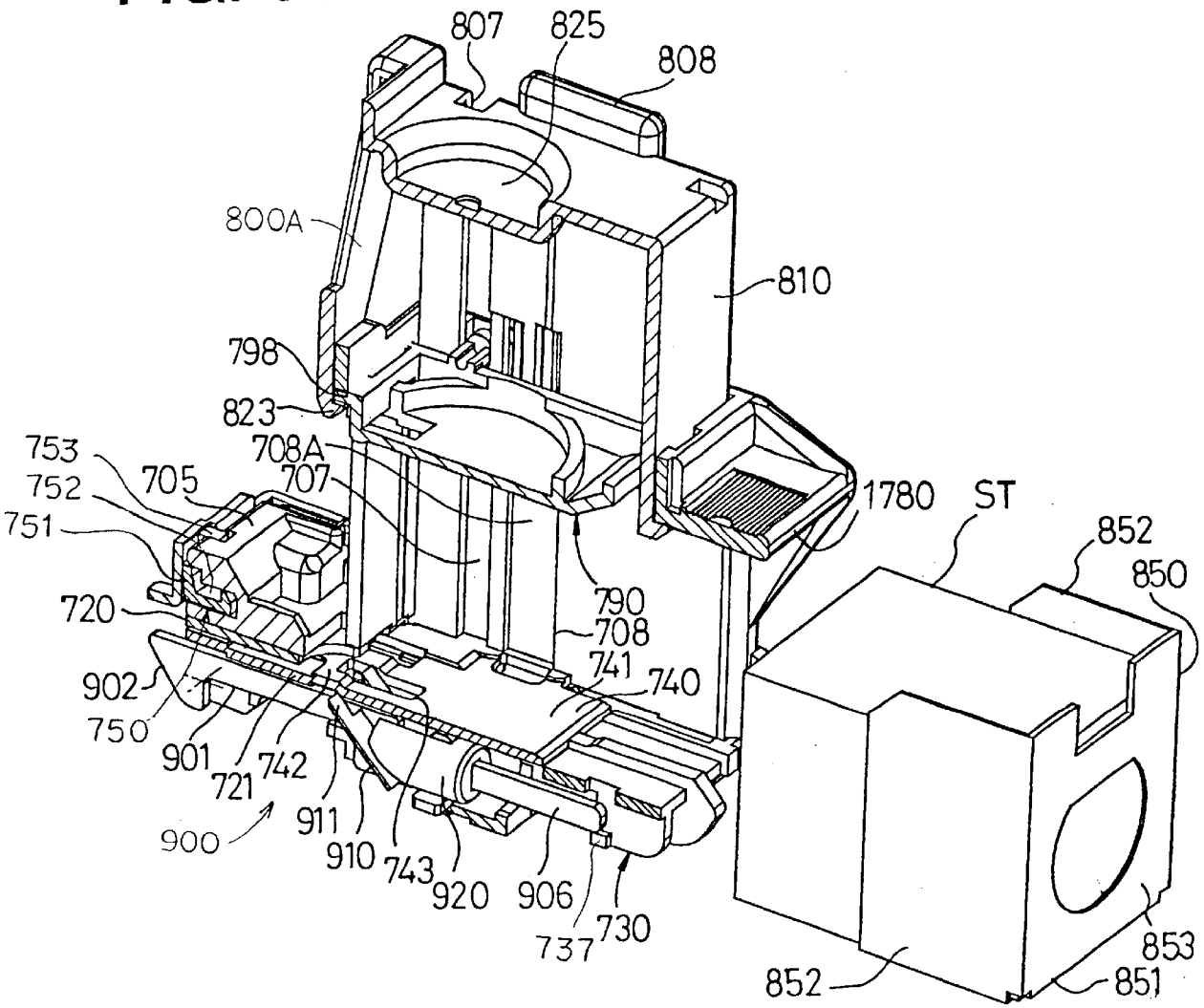
FIG. 38 is a longitudinal sectional view showing the configuration of the cartridge.
Figure 59:
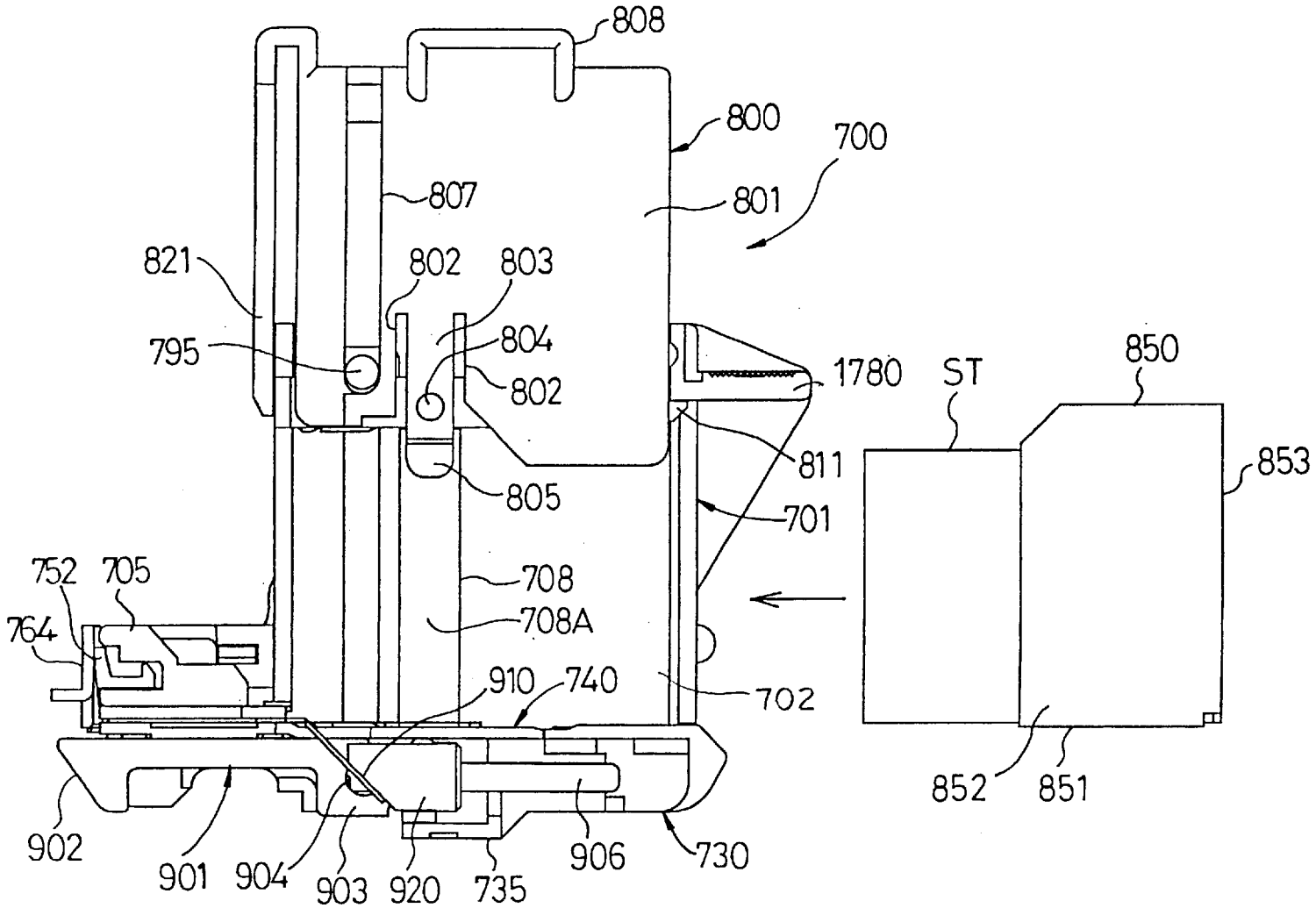
FIG. 59 shows an explanatory view where a case with sheet staples stacked therein is inserted from an opening of an outer case.

As shown in FIG. 59, when the inner case 800 is slidingly moved to the uppermost position of the outer case 701, the engagement projection 811 of the inner case 800 is engaged with the holding portion 1780 of the outer case 701 so as to prevent the inner case 800 from dropping off from the outer case 701. Moreover, as shown in FIG. 38, when the inner case 800 is slidingly moved, the projection 823 of the inner case 800 engages the engagement projection 798 of the holder 790 to cause the holder 790 to move upwardly in conjunction with the inner case 800.

Figure 60:
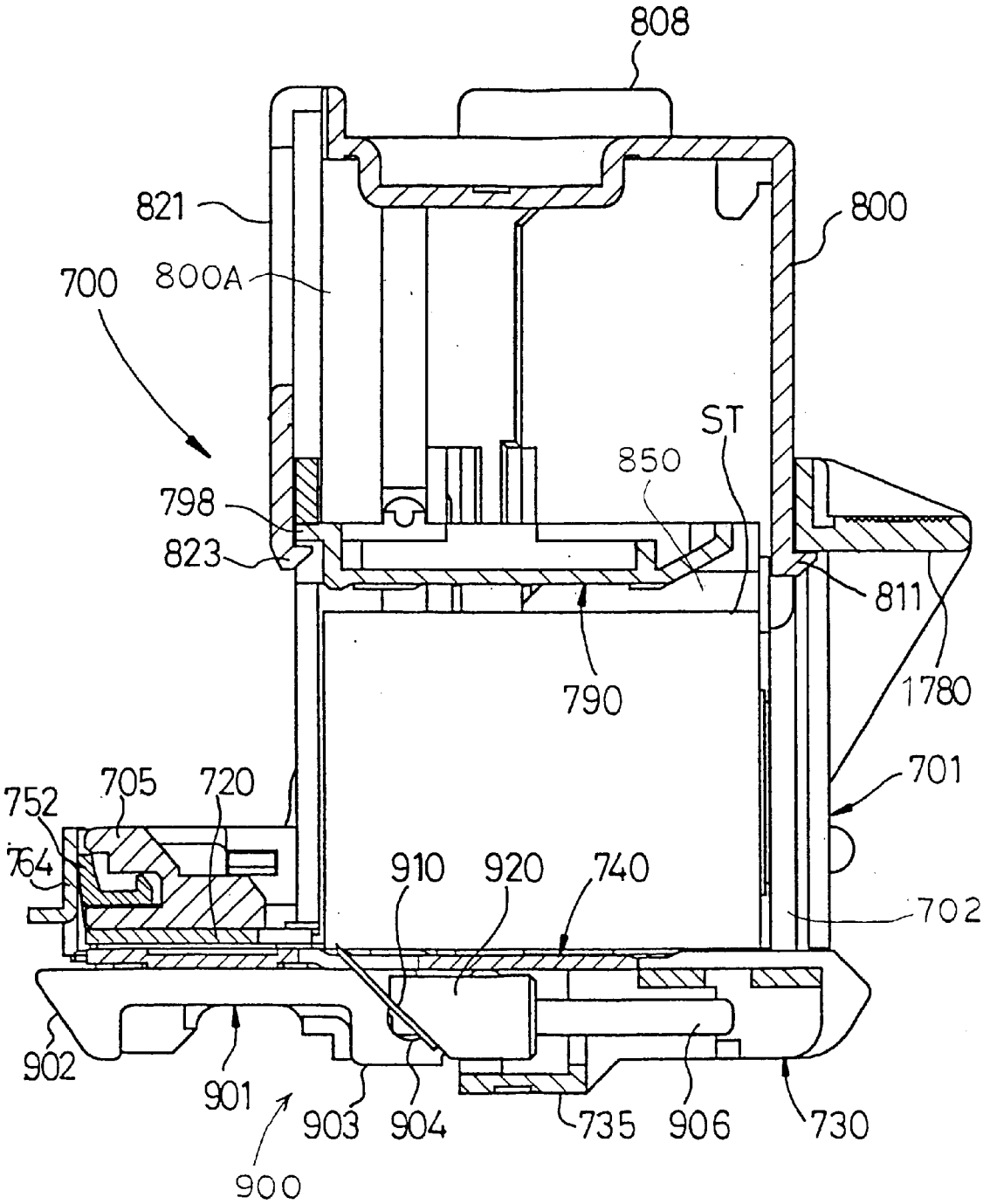
FIG. 60 shows an explanatory view where a case with sheet staples stacked therein is loaded to the outer case.

Accordingly, when the inner case 800 has been slidingly moved to the position shown in FIG. 59, the opening 702 at the back of the outer case 701 is completely opened. In addition, the inner case 800 is sustained at the position shown in FIG. 59 due to frictional force. Then, the stacked sheet staples ST are inserted into the outer case 701 in the case 850 from the opening 702 as shown in FIG. 60. At this time, the inner case 800 is retained at the position shown in FIG. 59, thus facilitating the insertion of the case 850.

The sliding movement of the inner case 800 to the position shown in FIG. 59 as such also causes the holder 790 to move upwardly, thereby resulting in the complete opening of the opening 702 at the back of the outer case 701, Moreover, the inner case 800 is retained at the position shown in FIG. 59. Thus, this facilitates the replacement of the case 850.

After the case 850 in which the sheet staples ST are stacked has been inserted into the outer case 701, the inner case 800 is pushed from the top thereof so as to go down to the position shown in FIG. 39. Then, this causes the engagement claws 805 of the elastic leg portions 803 of the inner case 800 are inserted into the holes 745 of the guide plate 740 to cause the engagement claws 805 to engage the holes 745.

As shown in FIG. 39, when the stacked sheet staples ST are left in the inner case 800 of the cartridge 700, the elastic leg portions 803 cannot be deformed toward the inside thereof since the sheet staples ST press against the both side walls 801 of the inner case 800 even when the cartridge 700 is removed from the stapler body 10 at the time of maintenance and the recessed portions 710 of the outer case 701 are accidentally pressed. Accordingly, this prevents the engagement claws 805 of the elastic leg portions 803 from being removed from the holes 745 of the guide plate 740. Thus, pressing the recessed portions 710 of the outer case 701 would not cause the inner case 800 to slidingly move upward due- to the biasing force of the spring 780. Accordingly, the stacked sheet staples ST are prevented from being scattered from the opening 702.

Figure 61:
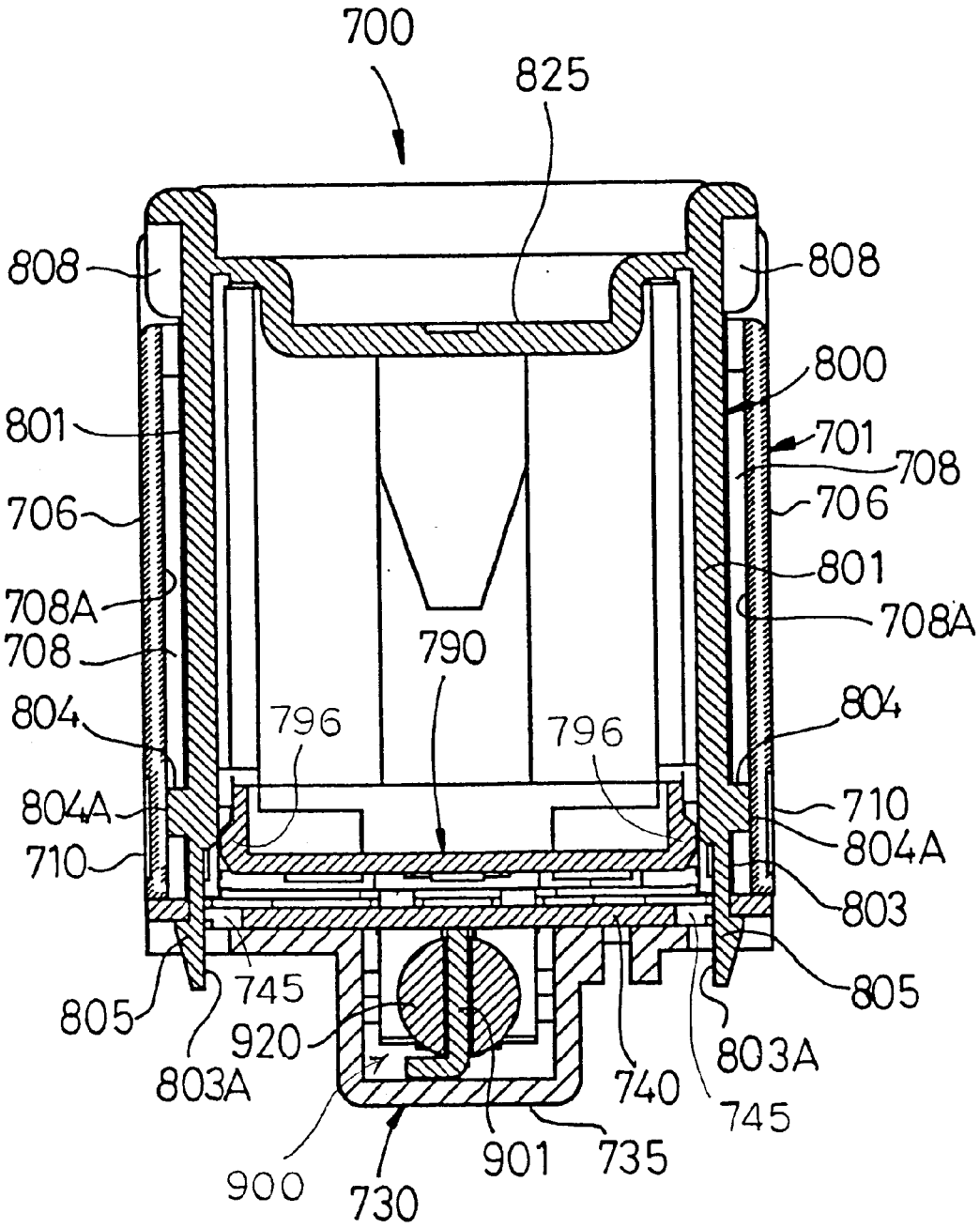
FIG. 61 is an explanatory view showing the downwardly positioned the holder when part of sheet staples has been transported halfway in a transport path and left in the inner case.

Furthermore, when part of the sheet staples ST has been fed halfway in the transport path 721 and left in the inner case 800, the holder 790 goes down to the position shown in FIG. 61 and the projected portions 796 of the holder 790 are brought into contact with the side walls 801 of the inner case 800 since the guide portion 742 of the guide plate 740 is located at a higher position than the holder portion 741. Accordingly, since the projected portions 796 of the holder 790 are in contact with the side walls 801 of the inner case 800, the elastic leg portions 803 of the inner case 800 are not deformed elastically toward the inside thereof even when the recessed portions 710 of the outer case 701 are pressed against.

Therefore, the inner case 800 can be slidingly moved upward without disengaging the engagement claws 804 of the elastic leg portions 803 with the holes 745 of the guide plate 740. Accordingly, this prevents the case 850 in which the sheet staples ST are stacked from being inserted from the opening 702 at the back of the outer case 701.

If the inner case 800 could be slidingly moved upward even when part of the sheet staples ST being transported was left in the inner case 800, the case 850 in which the sheet staples ST were stacked would be inserted from the opening 702 at the back of the outer case 701 without noticing that part of the sheet staples ST was left in the inner case 800. In this case, the sheet staples ST left would be forcedly pushed into the transport path 721 by the stacked sheet staples ST, causing sheet staples to sit on another in the transport path 721 and thus resulting in jamming.

According to this embodiment, when at least one sheet of staples ST is left in the inner case 800, the inner case 800 cannot be slidingly moved upward, thus preventing the occurrence of jamming.

Furthermore, the feed mechanism 900 is provided in the guide holder 730 of the outer case 701 of the cartridge 700. This allows one to ensure the performance of feeding staples S only by the control of the cartridge 700, thus providing improved productivity and reliability. Incidentally, provision of the feed mechanism 900 on the stapler body 10 would exert an effect on the positional relation between the cartridge 700 and the stapler body 10, thus requiring greater dimensional accuracy between the cartridge 700 and the stapler body 10.

[Second Embodiment]

Figure 62:
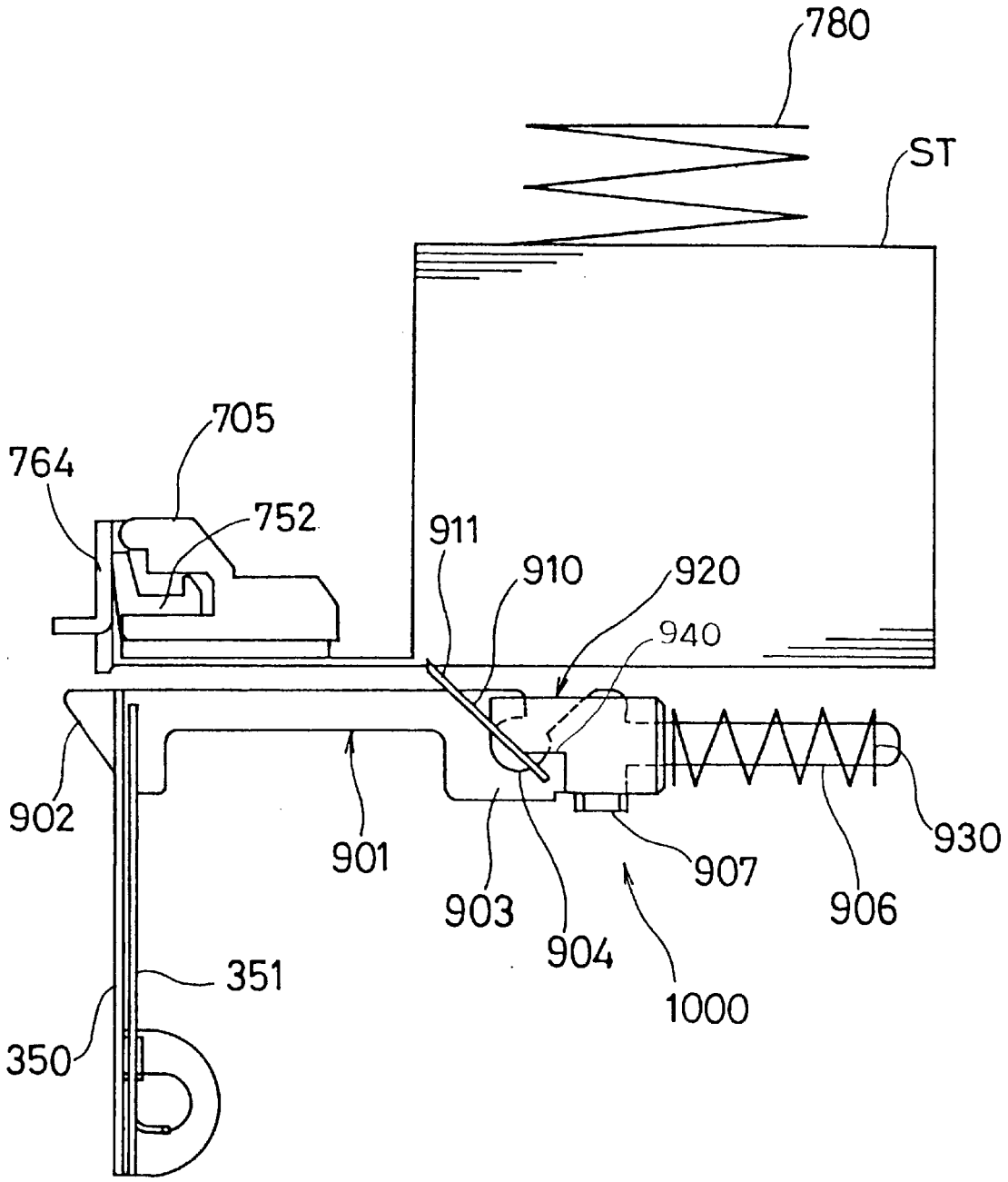
FIG. 62 is an explanatory view showing a feed mechanism according to a second embodiment.
Figure 63:
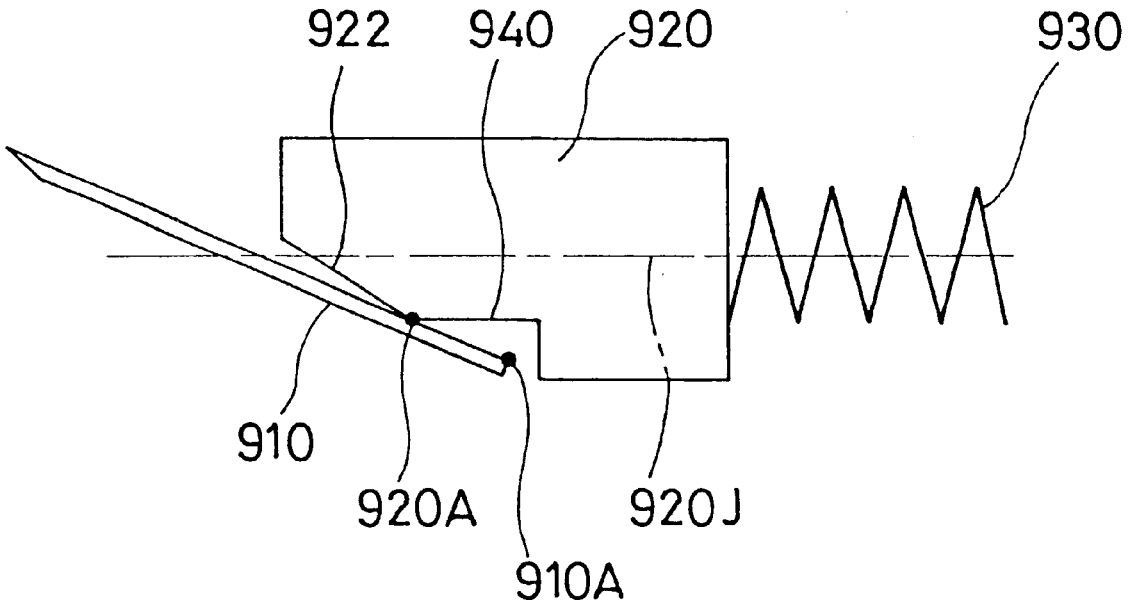
FIG. 63 is an explanatory view showing a point of action acting on the feed claw.

FIG. 62 is a view showing a feed mechanism 1000 according to a second embodiment. In this second embodiment, the inclined surface 922 of the pressing member 920 is provided with a recessed portion 940. The recessed portion 940 causes the pressing member 920 to move rearward against the biasing force of the feed spring 930 when the feed claw 910 submerges. The position of a point of action 920A acted from the feed claw 910 on the pressing member 920 is brought closer to the axial line 920J of the pressing member 920 as shown in FIG. 63. On the other hand, when the recessed portion 940 is not present, the point of action will sit on the lower portion 910A of the feed claw 910. The closer the point of action to the axial line 920J, the less the force for moving the pressing member 920 rearward becomes.

That is, a change in the position of the point of action will cause a change in submerging weight of the feed claw 910, and thus the submerging weight of the feed claw 910 can be freely adjusted depending on the position where the recessed portion 940 is provided. Furthermore, when the spring load of the feed spring 930 is increased, the submerging weight of the feed claw 910 needs not to be changed by changing the position of the point of action.

What is claimed is:

1. A motor-driven stapler comprising a table arranged as opposed to a staple drive portion for driving a staple and provided movably up and down on a stapler body, and a driver for driving a staple from said staple drive portion to sheets of paper when said table has been moved to press said sheets of paper against said staple drive portion, said motor-driven stapler being provided with a position sensor mechanism for sensing a home position of said table, wherein said position sensor mechanism comprises a position cam provided on a drive shaft for moving said table up and down, a sensor arm one end of which is rotatably pivoted, and arm sensor means for sensing that said sensor arm has rotated to a predetermined position, said position cam is provided, on a circumferential surface thereof, with a recessed portion for indicating said home position and a projected portion symmetrically opposite to the recessed portion, and said sensor arm has a first arm portion where a first top end portion is slidingly in contact with the circumferential surface of said position cam, a second arm portion where a second top end portion is slidingly in contact with the circumferential surface of said position cam, wherein said first top end portion and said second top end portion sandwich said position cam, said first top end portion is slidingly in contact with said recessed portion, and said second top end portion is slidingly in contact with said projected portion and said sensor arm rotates to a predetermined position.

2. The motor-driven stapler according to claim 1, wherein said position cam is provided, on the circumferential surface thereof, with an annular groove passing vertically through said recessed portion and said projection, and said first top end portion is provided with a guide projection that sits in said annular groove.

3. The motor-driven stapler according to claim 2, comprising a staple sensor mechanism for sensing whether any staple is present in said staple drive portion, wherein said staple sensor mechanism has an actuator to be rotated to a predetermined position by causing a staple of said staple drive portion to contact with a top end thereof and actuator sensor means for sensing that said actuator has been rotated to said predetermined position, said actuator is provided, on a top end thereof, with a flat contact surface with which a staple is brought into contact, and a projected portion is provided on said contact surface at a position closer to a side onto which said driver comes than a contact portion of said contact surface with which said staple is brought into contact.

4. The motor-driven stapler according to claim 1, comprising a staple sensor mechanism for sensing whether any staple is present in said staple drive portion, wherein said staple sensor mechanism has an actuator to be rotated to a predetermined position by causing a staple of said staple drive portion to contact with a top end thereof and actuator sensor means for sensing that said actuator has been rotated to said predetermined position, said actuator is provided, on a top end thereof, with a flat contact surface with which a staple is brought into contact, and a projected portion is provided on said contact surface at a position closer to a side onto which said driver comes than a contact portion of said contact surface with which said staple is brought into contact.

* * * * *